US011077345B2

(12) United States Patent
Martell et al.

(10) Patent No.: US 11,077,345 B2
(45) **Date of Patent: *Aug. 3, 2021**

(54) SUB-ASSEMBLY FOR A GOLF BAG AND A GOLF BAG SYSTEM FOR RECIPIENT SELF-ASSEMBLY

(71) Applicant: KARSTEN MANUFACTURING CORPORATION, Phoenix, AZ (US)

(72) Inventors: James Martell, Phoenix, AZ (US); John Loudenslager, Austin, TX (US); Brian McGuire, Phoenix, AZ (US); Ryan Bruce, Phoenix, AZ (US); David Higdon, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 119 days.

This patent is subject to a terminal disclaimer.

(21) Appl. No.: 16/200,280

(22) Filed: Nov. 26, 2018

(65) Prior Publication Data

US 2019/0091531 A1 Mar. 28, 2019

Related U.S. Application Data

(63) Continuation of application No. 15/437,337, filed on Feb. 20, 2017, now Pat. No. 10,173,113, which is a (Continued)

(51) Int. Cl.
*A63B 55/40* (2015.01)
*A63B 55/53* (2015.01)

(Continued)

(52) U.S. Cl.
CPC ..... *A63B 55/40* (2015.10); *A63B 55/20* (2015.10); *A63B 55/408* (2015.10); *A63B 55/53* (2015.10); *A63B 55/57* (2015.10)

(58) Field of Classification Search
CPC ..... A45C 3/12; A63B 55/40; A63B 55/408; A63B 55/20; A63B 55/53; A63B 55/57; A63B 55/00

(Continued)

(56) References Cited

U.S. PATENT DOCUMENTS 1,438,311 A 12/1922 Kerlogue
1,769,011 A 7/1930 Daniel (Continued)

FOREIGN PATENT DOCUMENTS

CN 201227506 4/2009
CN 202122804 1/2012

(Continued)

OTHER PUBLICATIONS

PCT International Search Report and Written Opinion dated May 11, 2016 from corresponding PCT Int'l Application No. PCT/US16/020333, filed Mar. 2, 2016.

(Continued)

*Primary Examiner* — Sue A Weaver

(57) ABSTRACT

A golf bag includes a collapsible sub-assembly including a divider top and a base, a plurality of first snap-fit connectors provided around a portion of an outer perimeter of the divider top, and a flat having a divider top end opposite a base end, an interior side, and an exterior side. The flat includes a plurality of second snap-fit connectors provided along a portion of the divider top end. The flat attaches to the sub-assembly by mating snap-fit engagement of the plurality of first snap-fit connectors around the divider top with the plurality of second snap-fit connectors along the divider top end.

19 Claims, 38 Drawing Sheets

Related U.S. Application Data continuation of application No. 15/405,154, filed on Jan. 12, 2017, now Pat. No. 10,173,112, which is a continuation of application No. 15/058,414, filed on Mar. 2, 2016, now Pat. No. 9,586,109.

(60) Provisional application No. 62/295,567, filed on Feb. 16, 2016, provisional application No. 62/211,568, filed on Aug. 28, 2015, provisional application No. 62/151,155, filed on Apr. 22, 2015, provisional application No. 62/127,033, filed on Mar. 2, 2015.

(51) Int. Cl.
*A63B 55/00* (2015.01)
*A63B 55/57* (2015.01)
*A63B 55/20* (2015.01)

(58) Field of Classification Search
USPC ..... 206/315.5, 315.6
See application file for complete search history.

(56) References Cited

U.S. PATENT DOCUMENTS 2,148,947 A 2/1939 Jackson
3,547,054 A 12/1970 Caldwell et al.
3,674,072 A 7/1972 Shuto
3,901,299 A 8/1975 Picco
4,226,389 A 10/1980 Neth
4,249,586 A 2/1981 Setani
4,282,983 A 8/1981 Swartzbaugh
4,350,194 A 9/1982 Brown
4,383,563 A * 5/1983 Kirchhoff, Jr. ..... A63B 55/00 206/315.2
4,459,827 A 7/1984 Rhodes
4,600,100 A 7/1986 Solheim
D288,653 S 3/1987 Crymes
4,735,394 A 4/1988 Facco
4,753,342 A * 6/1988 Pulichino, Jr. ..... A47G 25/54 190/109
4,767,039 A 8/1988 Jacober
4,778,136 A 10/1988 Reimers
4,834,235 A 5/1989 Solheim et al.
4,898,352 A 2/1990 Hoffman
4,995,510 A 2/1991 Fletcher
5,005,679 A 4/1991 Hjelle
5,158,220 A * 10/1992 Glass ..... A45C 1/02 224/235
5,160,109 A 11/1992 de Leeuw
5,178,273 A 1/1993 Igarashi
5,245,898 A 9/1993 Somal et al.
5,314,063 A * 5/1994 Lee ..... A63B 55/00 206/315.7
5,329,712 A 7/1994 Keller
5,339,951 A 8/1994 Chen
5,351,921 A 10/1994 Chen
5,354,131 A 10/1994 Mogil
5,356,003 A 10/1994 Gretz et al.
5,392,907 A 2/1995 Blanchard et al.
5,402,883 A * 4/1995 Shin ..... A63B 55/408 206/315.3
5,407,155 A 4/1995 Chung
5,415,285 A 5/1995 Reimers
5,505,300 A 4/1996 Joh
5,529,385 A 6/1996 Tsao
5,538,813 A 7/1996 Biafore, Jr. et al.
5,566,825 A * 10/1996 Price ..... A63B 55/00 206/315.5
5,597,144 A 1/1997 Lee
5,634,616 A 6/1997 Wang et al.
5,640,855 A 6/1997 Crescenzo et al.
5,657,869 A 8/1997 Caroll, III
5,662,303 A 9/1997 Rellinger et al.
5,722,253 A 3/1998 Todd
5,765,691 A 6/1998 Hall
5,769,220 A 6/1998 Hong
5,799,786 A 9/1998 Beck et al.
5,816,544 A 10/1998 Hsieh
5,823,485 A 10/1998 Park
5,853,086 A 12/1998 Chang
5,899,328 A 5/1999 Dulyea
5,915,551 A 6/1999 Vavro
5,964,346 A 10/1999 O'Connor
5,988,377 A * 11/1999 Pugel ..... B63B 32/80 206/315.1
5,988,379 A * 11/1999 Yearous ..... A45C 5/06 206/315.3
5,997,105 A 12/1999 Wu
6,068,270 A 5/2000 Kim
6,068,271 A 5/2000 Vanaman
6,099,097 A 8/2000 Hocker et al.
6,220,433 B1 4/2001 Kang
6,234,582 B1 5/2001 Wu
6,283,260 B1 9/2001 Yasuda, Sr.
6,296,117 B1 10/2001 Chen
6,311,836 B1 11/2001 Maeng
6,382,572 B1 5/2002 Lin
6,386,362 B1 5/2002 Cheng
6,390,295 B2 5/2002 Rhee
6,394,325 B1 5/2002 Taylor
6,427,835 B1 8/2002 Chang
6,481,674 B1 11/2002 Lin
6,494,416 B2 12/2002 Wang
6,510,944 B2 1/2003 Chang
6,513,661 B1 2/2003 Mogil
6,598,744 B2 7/2003 Chen
6,609,615 B2 8/2003 Lin
6,637,590 B1 * 10/2003 Matsuki ..... A45C 5/06 206/315.5
6,834,891 B2 12/2004 Matsubara et al.
7,025,202 B2 4/2006 Janen et al.
7,445,399 B2 11/2008 Dunn et al.
7,681,859 B2 3/2010 Kim
7,762,518 B2 7/2010 Ogawa et al.
7,837,032 B2 * 11/2010 Smeltzer ..... A63B 55/00 206/315.5
7,870,954 B2 1/2011 Quartarone, III
7,886,902 B1 2/2011 Cimini et al.
8,141,705 B2 3/2012 Aubery et al.
8,410,748 B2 4/2013 Wilson
8,573,393 B2 11/2013 Cole et al.
8,757,373 B2 6/2014 Aubery
8,827,073 B2 9/2014 Herron et al.
8,869,981 B2 10/2014 Tang
8,910,785 B2 12/2014 Loudenslager
8,997,981 B1 4/2015 Gilkerson
9,307,813 B2 4/2016 Bruce
9,314,679 B2 4/2016 Engel
9,586,109 B2 * 3/2017 Martell ..... A63B 55/57
9,662,553 B2 5/2017 Cheng
9,713,754 B2 7/2017 Herron et al.
9,827,471 B1 11/2017 Wang
9,931,554 B2 4/2018 Marquez et al.
10,173,112 B2 * 1/2019 Martell ..... A63B 55/40
10,610,751 B2 * 4/2020 Martell ..... A63B 55/57
2002/0043475 A1 4/2002 Wang
2002/0125381 A1 9/2002 Yoon
2003/0015634 A1 1/2003 Yoon
2003/0146120 A1 * 8/2003 Chi ..... A45C 5/06 206/315.5
2004/0020805 A1 * 2/2004 Klock ..... A63B 55/40 206/315.5
2004/0035729 A1 2/2004 Chang
2004/0079659 A1 4/2004 Feng
2004/0108234 A1 6/2004 Meissner
2005/0051982 A1 3/2005 Su
2005/0072696 A1 4/2005 Yang
2007/0138040 A1 6/2007 Chan
2007/0193902 A1 8/2007 Myers et al.
2007/0246384 A1 10/2007 Shiao
2008/0135431 A1 6/2008 Tan
2008/0164166 A1 7/2008 Quartarone
2008/0314941 A1 12/2008 Knych et al.

(56) References Cited

U.S. PATENT DOCUMENTS

| | | | |
|---|---|---|---|
| 2010/0051489 | A1 | 3/2010 | Shiao |
| 2010/0140122 | A1 | 6/2010 | Quartarone et al. |
| 2010/0294404 | A1 | 11/2010 | Anderson |
| 2011/0180575 | A1 | 7/2011 | Abramowitz et al. |
| 2012/0055820 | A1 | 3/2012 | McGuire et al. |
| 2013/0032499 | A1 | 2/2013 | Loudenslager |
| 2014/0034527 | A1 | 2/2014 | Anderson |
| 2015/0014196 | A1 | 1/2015 | Hargis |
| 2015/0265020 | A1 | 9/2015 | McCue et al. |
| 2016/0213986 | A1 | 7/2016 | Foxman |

FOREIGN PATENT DOCUMENTS

| | | |
|---|---|---|
| CN | 202387180 | 8/2012 |
| CN | 202478518 | 10/2012 |
| CN | 102764495 | 11/2012 |
| CN | 202933449 | 5/2013 |
| CN | 202961748 | 6/2013 |
| CN | 203090379 | 7/2013 |
| CN | 203196243 | 9/2013 |
| CN | 203540000 | 4/2014 |
| CN | 203874408 | 10/2014 |
| CN | 104338305 | 2/2015 |
| CN | 103230668 | 12/2015 |
| CN | 205042058 | 2/2016 |
| CN | 207153029 | 3/2018 |
| GB | 2327361 | 1/1999 |
| GB | 2333712 | 8/1999 |
| JP | 3188092 | 1/2014 |
| KR | 1020140115142 | 9/2014 |

OTHER PUBLICATIONS

Callaway ORG. 14 Cart Bag; https://www.callawaygolf.com/accessories/golf-bags/cart-bags/bags-2018-org-14-cart.html; date accessed: Dec. 17, 2018.

PCT International Search Report and Written Opinion, dated Nov. 1, 2018, from PCT Int'l Appl. No. PCT/US18/47613, filed Aug. 22, 2018.

* cited by examiner

SUB-ASSEMBLY FOR A GOLF BAG AND A GOLF BAG SYSTEM FOR RECIPIENT SELF-ASSEMBLY

CROSS-REFERENCE TO RELATED APPLICATIONS

This is a continuation of U.S. Non-Provisional patent application Ser. No. 15/437,337, now U.S. Pat. No. 10,173,113, filed Feb. 20, 2017, which is a continuation of U.S. Non-Provisional patent application Ser. No. 15/405,154, now U.S. Pat. No. 1,173,112, filed on Jan. 12, 2017, which is a continuation of U.S. Non-Provisional patent application Ser. No. 15/058,414, now U.S. Pat. No. 9,586,109, filed on Mar. 2, 2016, which claims the benefit of U.S. Provisional Patent Application No. 62/127,033, filed on Mar. 2, 2015, U.S. Provisional Patent Application No. 62/151,155, filed on Apr. 22, 2015, U.S. Provisional Patent Application No. 62/211,568, filed on Aug. 28, 2015, and U.S. Provisional Patent Application No. 62/295,567, filed on Feb. 16, 2016, the contents of all of which are incorporated fully by reference herein.

FIELD OF THE INVENTION

The present disclosure relates to a golf bag. More specifically, the disclosure relates to a golf bag formed of a plurality of components that interconnect by snap-fit or otherwise to simplify bag assembly by eliminating rivets, and that reduces packaging volume resulting in more efficient and cost effective shipping. The disclosure also relates to a sub-assembly for a golf bag that allows for recipient self-assembly.

BACKGROUND

A golf bag is a specially designed bag used to transport golf clubs. A golf bag generally falls within one of two basic classes. The first class is commonly referred to as a cart bag. The cart bag is typically about 9 to 14 inches in diameter, includes a plurality of pockets for storing golf accessories (e.g. golf balls, rain gear, range finder, etc.), and is typically fabricated of a relatively stiff and heavy material including leather or synthetic leather. Due to its substantial size, weight, and capacity for storing golf accessories, the cart bag is not typically carried by a golfer while playing golf. Instead, the cart bag is transported by a caddy, a motorized cart, a push cart, or a pull cart. Non-limiting examples of a cart bag include a staff bag or a tour bag.

The second class of golf bag is commonly referred to as a carry bag. The carry bag typically weighs less than the cart bag. To reduce weight, the carry bag typically is fabricated of lighter weight materials than the cart bag, and may have a smaller diameter. There are several types of carry bags, including a stand bag, which includes retractable legs that deploy to form a tripod and facilitate a free standing position, and a Sunday bag, which is effectively an ultra-lightweight, flexible "sleeve" that receives golf clubs but has minimal storage capacity for golf accessories to further reduce weight.

Known golf bags have certain limitations. For example, known golf bags are typically completely assembled prior to shipment to an end user or point of sale. To account for the size of the assembled bag, a shipping package generally has a volume exceeding 5,000 cubic inches ($in^3$). As shipping package fees shift from a package weight based fee to a package size based fee, golf bags will be subject to additional charges due to excessive package dimensions, substantially increasing shipping costs. Accordingly, there is a need for reducing the package volume when shipping the golf bag and for a system to allow an end user or point of sale recipient to easily assemble the golf bag after receipt.

In addition, assembly of both types of golf bags is often performed where particular parts of the bag (inside and out) are manufactured in different factories and then assembled in a different site. This leads to necessary increases in package size and package volume to ship each component of the golf bag and the overall assembled golf bag itself. As shipping package fees shift from package weight to package size based fee, golf bag components, accessories, and the overall finished product will be subject to additional charges due to excessive package dimensions, substantially increasing shipping costs. Accordingly, there is a need for reducing the package volume for shipping the whole golf bag or parts of the golf bag, and for a method to easily assemble golf bags in a reduced volume shipping supply chain.

Figure 1:
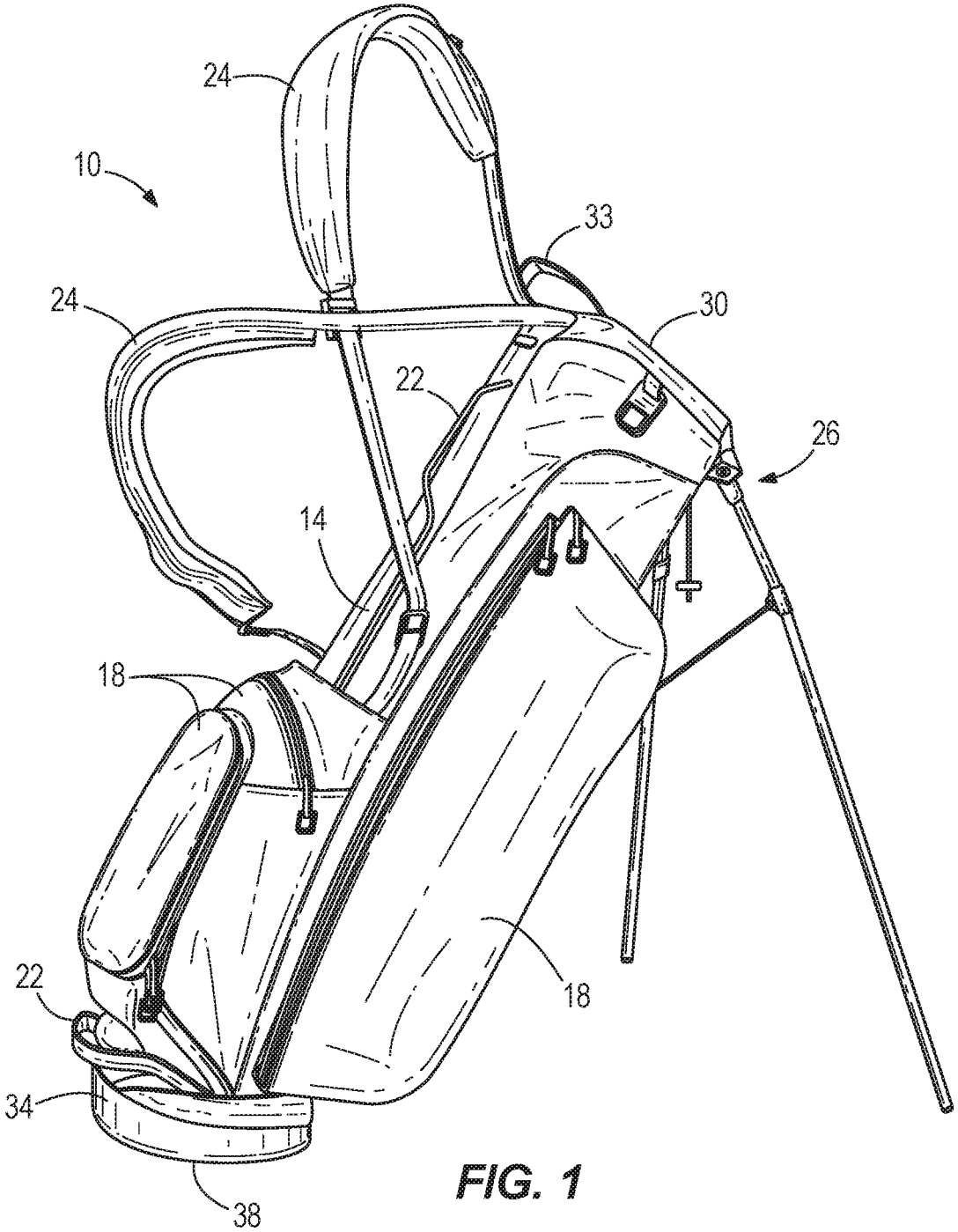
FIG. 1 is a perspective view of a first side of a golf bag having a stand assembly in a deployed, tripod configuration.

Before any embodiments of the disclosure are explained in detail, it should be understood that the disclosure is not limited in its application to the details or construction and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

DETAILED DESCRIPTION

Known cart bags and carry bags have certain common components. Both bags include a base, a top having one or more dividers, at least one stay, and a generally cylindrical outer shell having one or more storage pockets. The at least one stay interconnects the base and the top to define a sub-assembly. The sub-assembly is then connected to the outer housing to define the golf bag. During assembly of the golf bag, the outer shell and the top are positioned to circumferentially overlap. A plurality of rivets are then set around the top circumference to fasten the outer shell and the top. Similarly, the outer shell and the base are also positioned to circumferentially overlap, and a plurality of rivets are then set around the base circumference to fasten the outer shell and the base. This process results in a durable attachment of the golf bag components. Previously, the assembly process is complex, time intensive, and labor intensive. Golf bag components must be properly aligned, which often requires adjustment and realignment. Once aligned, each rivet must be individually set around both the top and the bottom of the bag.

The sub-assembly and outer shell of known golf bags are typically fabricated at a first location, and then shipped to a second location for assembly. The sub-assembly is fabricated to define a golf bag frame with the at least one stay connected to and separating the base and the top. Similarly, the outer shell is fabricated into a generally cylindrical or tubular shape.

The inventors have discovered a golf bag design for either cart bags or carry bags that can be self-assembled through snap-fit components. Utilizing the snap-fit components provides manufacturers with less machinery and equipment overhead for golf bag assembly. Further, shipping volume of the snap-fit components is reduced by approximately 30% to 50%, providing for more efficient use of package volume during shipping and limiting excess shipping costs due to oversized or bulky components. The golf bag includes a collapsible sub-assembly having a divider top and a base, a plurality of first snap-fit connectors provided around a portion of an outer perimeter of the divider top, and a flat having a divider top end opposite a base end, an interior side, and an exterior side, the flat including a plurality of second snap-fit connectors provided along a portion of the divider top end. The flat attaches to the sub-assembly by mating snap-fit engagement of the plurality of first snap-fit connectors around the divider top with the plurality of second snap-fit connectors along the divider top end.

A self-assembly kit for a golf bag includes a collapsible golf bag, the collapsible golf bag including a stay pivotably connected at one end to a golf bag divider top and on an opposite end to a golf bag base, an outer shell, and a self-assembly system for assembling the golf bag from a collapsed state to a deployed state.

A collapsible golf includes a divider top pivotably connected to a first end of a stay by a first hinge, a base pivotably connected to a second end of the stay by a second hinge, and an outer shell connected to the divider top and the base, the outer shell including at least one shoulder strap. The golf bag is configured to be shipped in a collapsed configuration in which the divider top and the base are pivoted about the stay.

A method of self-assembling a golf bag includes pivoting a divider top about a stay via a first hinge from a collapsed configuration to a deployed configuration, pivoting a base about the stay via a second hinge from a collapsed configuration to a deployed configuration, and attaching a portion of a stand assembly to one of a mounting bracket or the base.

A method of manufacturing a collapsible golf bag includes inserting a sub-assembly into an outer shell, the sub-assembly comprising a divider top, a base, and a divider sleeve coupled to the divider top and extending towards the base, the divider sleeve coupled to the base by a plurality of flexible connection members connected to the divider sleeve, wherein the divider sleeve includes a bottom edge that extends a distance from the base. The method further includes coupling a stay to the sub-assembly, such that the stay extends between the divider top and the base, the divider top being pivotably connected to the stay by a first hinge, and the base being pivotably connected to the stay by a second hinge.

The sub-assembly of a golf bag includes a divider top having an outer ring defining a perimeter and a plurality of apertures, and a leg mounting bracket having a mounting channel and a plurality of retention members extending into the mounting channel. A portion of the outer ring is received in the mounting channel and each of the plurality of apertures receives one of the plurality of retention members to form a snap-fit connection.

A snap-fit bracket for connecting a pair of legs to a golf bag includes a leg mounting bracket having a pair of leg anchors provided on a front portion of the bracket, and a pair of legs, each leg includes an end cap having a pair of opposing protrusions that define a pivot axis, each leg anchor being configured to provide a snap-fit connection between the end cap and the leg anchor.

A golf bag includes a collapsible sub-assembly including a divider top, a base defining a perimeter, and a plurality of first apertures provided through a portion of the base about the perimeter, a flat having a divider top end opposite a base end, and a plurality of second apertures through the flat along the base end, and a strip having a plurality of snap tree members. The flat is configured to overlap a portion of the base to align the first apertures with the second apertures, each of the aligned first and second apertures being configured to receive one of the plurality of snap tree members to couple the flat to the base.

Other features and aspects will become apparent by consideration of the following detailed description and accompanying drawings. Before any embodiments of the disclosure are explained in detail, it should be understood that the disclosure is not limited in its application to the details or construction and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

For ease of discussion and understanding, and for purposes of description only, the following detailed description illustrates a golf bag 10 as a stand golf bag having legs that retract to form a first configuration to facilitate carrying of the golf bag by the golfer, and deploy to form a second configuration of a tripod to facilitate a free standing golf bag. It should be appreciated that the stand golf bag is provided for purposes of illustration and aspects of the stand golf bag and associated sub-assembly 42 disclosed herein may be incorporated into a golf bag 10 of any suitable class, type, or size. Generally, the golf bag 10 is of a size suitable to carry a plurality of full length golf clubs, for example a set of golf clubs that includes a combination of one or more of a driver, a wood, a hybrid, an iron, a wedge, and/or a putter. A full length golf club is not collapsible, and has a length of approximately 32 inches to approximately 49 inches, depending on the club.

The following detailed description references a flat 14 as a part of the golf bag 10. The flat 14 is an outer shell or covering of the golf bag that attaches to and extends between a divider top 34 and a base 42. The flat 14 may include, among other features, one or more pockets 18, at least one carrying handle 22, and one or more shoulder straps 24.

The following detailed description also refers to a snap-fit connection, a snap-fit connector, a snap-fit fastener, and a snap-fit attachment. The term snap-fit includes any connection made without a tool. For example, a snap-fit connection, snap-fit connector, snap-fit fastener, and snap-fit attachment may include, but is not limited to, a zipper, snap fastener, hook and loop connection (VELCRO®), an interference fit, hook and hook fastener, buttons, or any other suitable fastener or securing assembly that forms a connection or is otherwise connected by an individual, user, or assembler without the use of a tool. Although rivets could be used, rivets are not necessarily required using the snap-fit connection, a snap-fit connector, a snap-fit fastener, and a snap-fit attachment.

In addition, a self-assembly kit 400 and a self-assembly system 500 for use with the golf bag 10 illustrates the golf bag 10 as a stand bag. It should be appreciated that the stand golf bag 10 is provided for purposes of illustration and aspects of the self-assembly kit 400 and the self-assembly system 500 disclosed herein can be incorporated into a golf bag 10 of any suitable class, type, or size.

It should be appreciated that the term "recipient," as used herein, can include a user of the golf bag 10, one or more persons associated with a point of sale (e.g., a golf shop, etc.), or any other person that receives the golf bag 10 in a disassembled or unassembled or partially assembled state (or configuration) and that uses the self-assembly kit 400 and/or the self-assembly system 500 to assemble the golf bag 10.

FIG. 1 illustrates the golf bag 10. The golf bag 10 includes a flat or an flat 14 that includes a plurality of pockets 18 for storing golf accessories (e.g. golf balls, golf tees, a golf glove, rain gear and other apparel, etc.). The golf bag 10 also includes a plurality of handles 22 and a shoulder carry strap 24 that facilitate grasping and/or carrying of the bag 10. A stand assembly 26 is pivotally connected to the golf bag 10 at a divider top 30 by a mounting bracket 32 (shown in FIGS. 2-3). The divider top 30 includes an additional handle 33 to assist with carrying the golf bag 10. Opposite the divider top 30 is a base 34. In the illustrated freestanding tripod configuration where the stand assembly 26 is deployed, the flat 14 tilts about the base 34 towards the stand assembly 26. This allows a bottom face 38 of the base 34 to maintain contact with a surface upon which the bag 10 is deployed, increasing bag 10 stability while in the tripod configuration.

Figure 2:
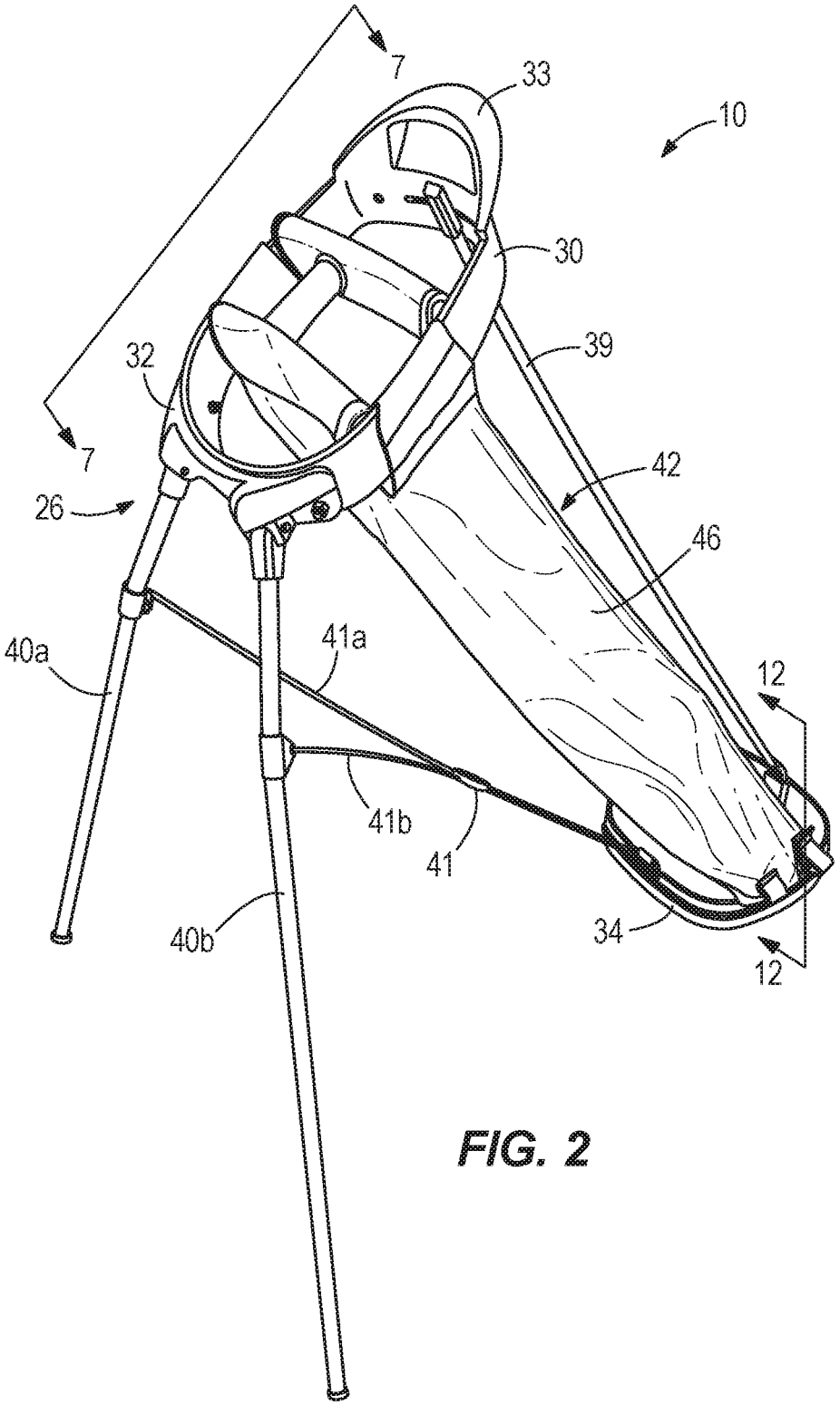
FIG. 2 is a perspective view of a second side of the golf bag of FIG. 1, opposite the first side and with the outer shell removed to illustrate a sub-assembly.
Figure 3:
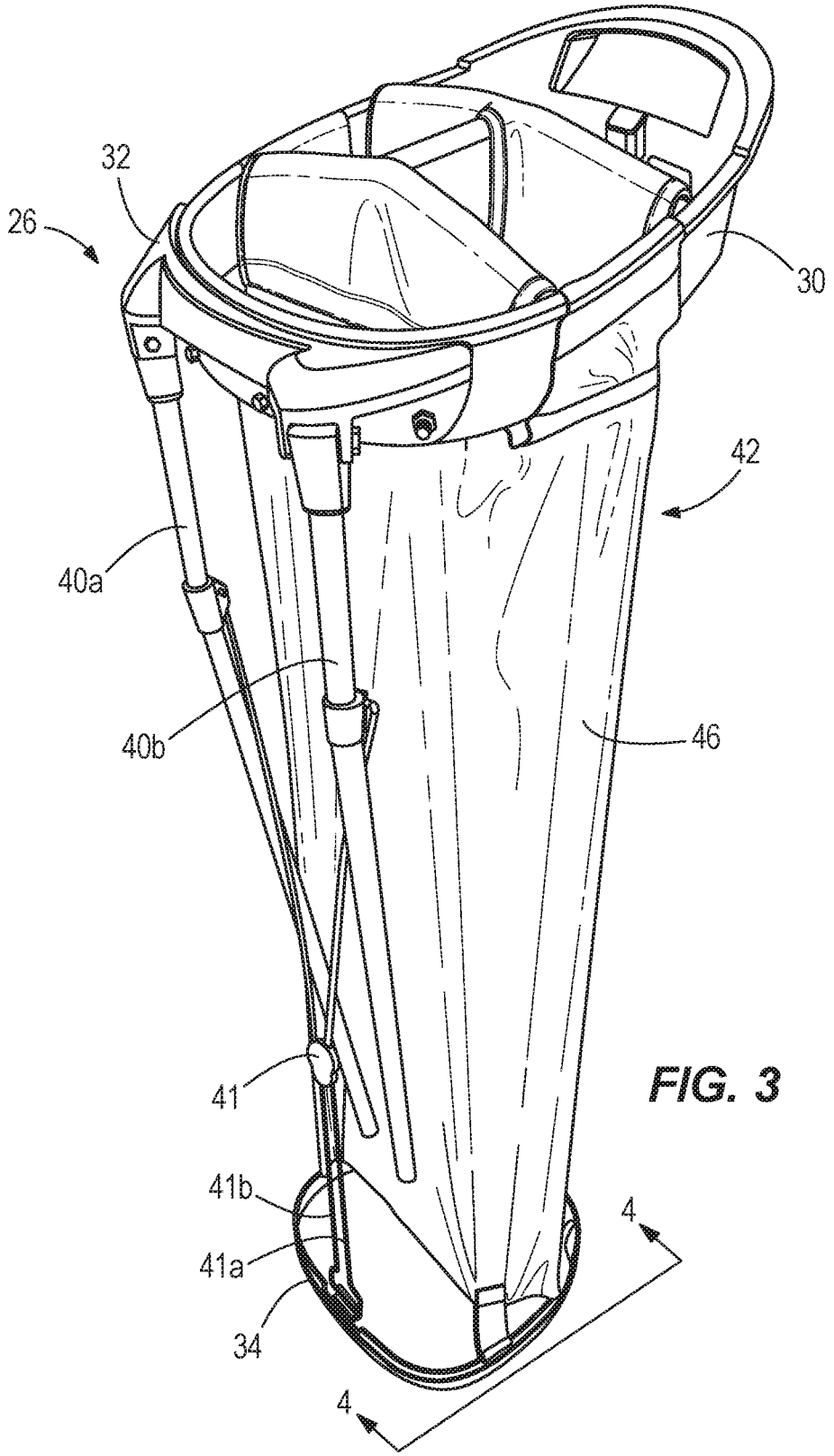
FIG. 3 is a perspective view of the golf bag of FIG. 2, illustrating the sub-assembly with the stand in a retracted configuration to facilitate carrying of the bag.

FIGS. 2 and 3 depict the golf bag 10 with the flat 14 removed. Referring to FIG. 2, a stay 39 extends from the divider top 30 to the base 34. The stand assembly 26 is provided on an opposite side of the bag 10 from the stay 39. The stand assembly 26 includes a pair of legs 40*a, b* that are pivotably connected to the mounting bracket 32. A spring 41 is coupled to the base 34, and includes spring members 41*a*, 41*b*. The spring members 41*a*, 41*b* extend from the base 34 to connect to respective legs 40*a, b*.

Figure 4:
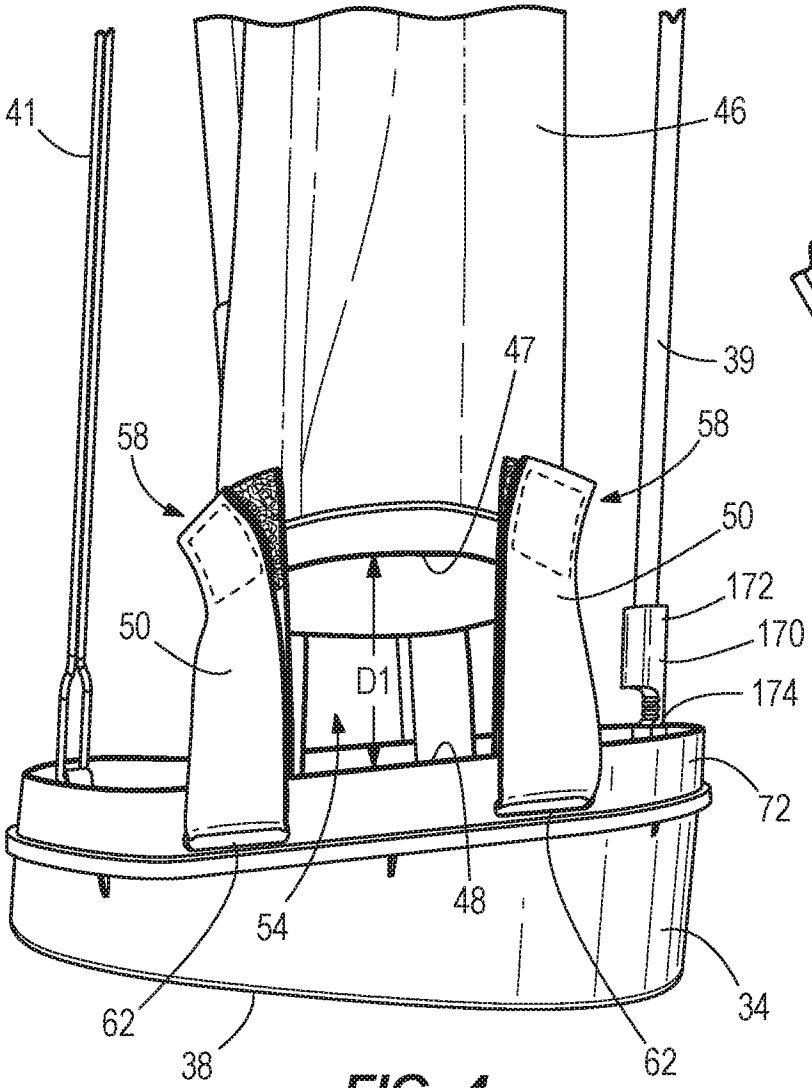
FIG. 4 is a side view of a portion of the golf bag of FIG. 2 taken along line 4-4 of FIG. 3, illustrating a portion of the sub-assembly including a plurality of connection members that couple a divider sleeve to a base, and a gap between the divider sleeve and the base when the stand assembly is in a retracted configuration.

FIGS. 2 and 3 also illustrate an internal sub-assembly 42 according to a preferred embodiment. The sub-assembly 42 includes the divider top 30 and the base 34. In addition, a divider sleeve 46 is coupled to the divider top 30 and extends away from the divider top 30 towards the base 34. The divider sleeve 46 has a generally box-like shape, but in other embodiments may be any suitable or desired shape. Referring to FIG. 4, when the bag 10 is in the retracted configuration (i.e. the stand assembly 26 is retracted, as shown in FIG. 3) the divider sleeve 46 does not extend entirely to the base 34. An end or bottom edge 47 of the divider sleeve 46 is spaced from a top lip or edge 48 of the base 34. A plurality of connection members 50 are connected to the divider sleeve 46, and more specifically connected adjacent the end 47 of the divider sleeve 46 closest the base 34. The connection members 50 couple the divider sleeve 46 to the base 34. When the divider sleeve 46 is coupled to the base 34, a gap or opening or space 54 exists having a first distance D1 that varies about a perimeter of the divider sleeve 46 defined by the end 47. The gaps 54 are each generally defined by the divider sleeve 46 (or the edge 47 thereof), two adjacent connection members 50, and the base 34 (or the top lip 48 thereof).

In the illustrated embodiment of bag 10, a plurality of connection members 50, and more specifically four connection members 50, couple the divider sleeve 46 to the base 34.

In other embodiments, two, three, or five or more connection members 50 may be used to couple the divider sleeve 46 to the base 34. The connection members 50 are preferably formed of a flexible, elastic, stretchable material, such as elastic webbing, to form a flexible and/or elastic connection between the divider sleeve 46 and the base 34. In other embodiments, any suitable material may be used that is sufficiently flexible and/or elastic to allow the connection members 50 to function in accordance with operation of the internal sub-assembly 42 disclosed herein. In addition, an end 56 of the connection member 50 is attached to the divider sleeve 46 (shown in FIG. 5). The end 56 is illustrated as attached to the divider sleeve 46 by stitching, however in other embodiments the end 56 may be attached by adhesive, rivets, or any other known or future developed attachment suitable to maintain the connection between the end 56 and the divider sleeve 46 while allowing the connection members 50 to function in accordance with operation of the internal sub-assembly 42 disclosed herein.

Figure 5:
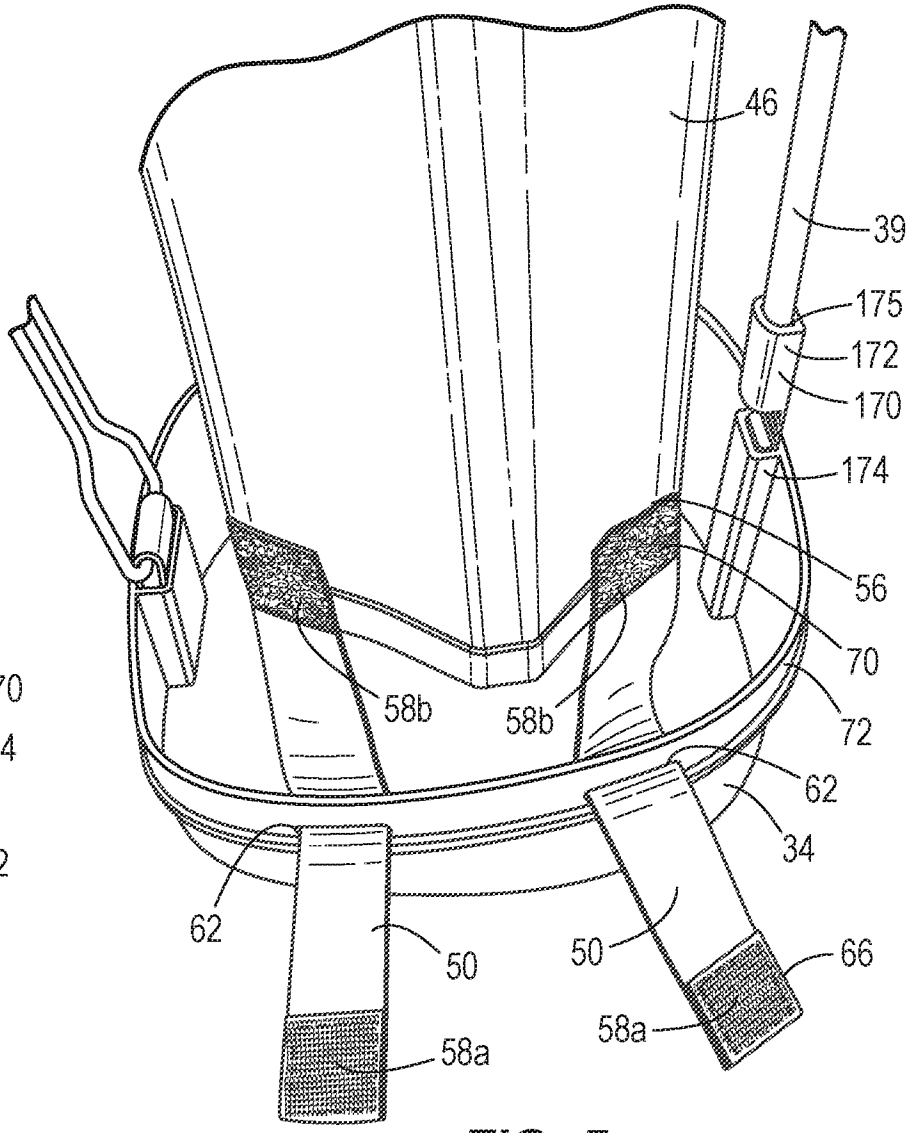
FIG. 5 is a perspective view of the portion of the golf bag of FIG. 4, illustrating the connection members unfastened to depict aspects of self-fastening engagement.

Referring now to FIGS. 4 and 5, in a preferred embodiment each connection member 50 is in self-fastening engagement while coupling the divider sleeve 46 to the base 34 by a self-fastener 58. As shown in FIG. 5, a first portion of the self-fastener 58*a* is spaced from a second portion of the self-fastener 58*b*. Both portions of the self-fastener 58*a*, 58*b* are provided on a same side of the connection member 50. This allows each connection member 50 to be received by a slot 62 in the base 34 (shown in FIGS. 4 and 5), and then self-fastened by connecting the portions of the self-fastener 58*a*, 58*b* (shown in FIG. 4). Stated another way, after the connection member 50 is received by the slot 62, a first portion 66 of the connection member 50 fastens to a second portion 70 of the connection member 50 to form a self-fastening connection. The self-fastening connection allows each connection member 50 to wrap around a portion of the base 34 to couple the divider sleeve 46 to the base 34. A plurality of the slots 62 are provided about a perimeter of the base 34 to receive a respective connection member 50. The slots 62 are provided through a lip 72 that defines the perimeter of the base 34 and extends away from the bottom face 38. While the self-fastener 58 is illustrated in the form of a hook and loop fastener (e.g., VELCRO®), in other embodiments any suitable self-fastener 58 may be used, including a button and button hole, a hook-and-eye closure, or a snap fastener. In addition, in other embodiments the first portion of the self-fastener 58*a* may be the hook or loop portion of the fastener, while the second portion of the self-fastener 58*b* is the other of the loop or hook portion of the fastener. In other embodiments, the first portion 66 of the connection member 50 fastens to the second portion 70 in a permanent or semi-permanent arrangement (e.g. through the use of an adhesive or similar material).

Figure 6:
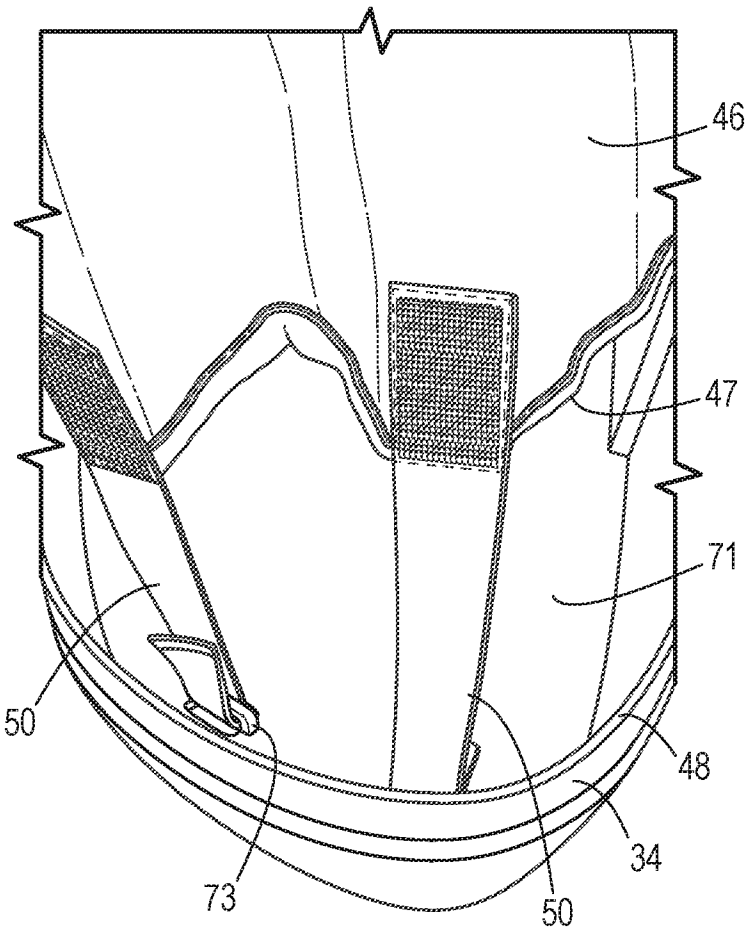
FIG. 6 is a perspective view of a portion of the base of the golf bag of FIG. 2 illustrating an alternative connection between a divider sleeve and the base when the golf bag is in a carrying configuration with legs retracted.

FIG. 6 illustrates an alternative embodiment of the self-fastening engagement of each connection member 50 that couples the divider sleeve 46 to the base 34. The connection members 50 engage a portion of the bottom 71 of base 34 to couple the divider sleeve 46 to the base 34. Specifically, the portion of the bottom 71 includes a plurality of connection portions 73, with each connection portion 73 being defined by two slots or apertures (not shown) formed through the bottom 71 of the base 34. Each connection member 50 wraps around a respective connection portion 73 and forms a self-connection by hook and loop fastener (VELCRO®). In the illustrated golf bag 10, four connection members 50 couple the divider sleeve 46 to the base 34.

Figure 7:
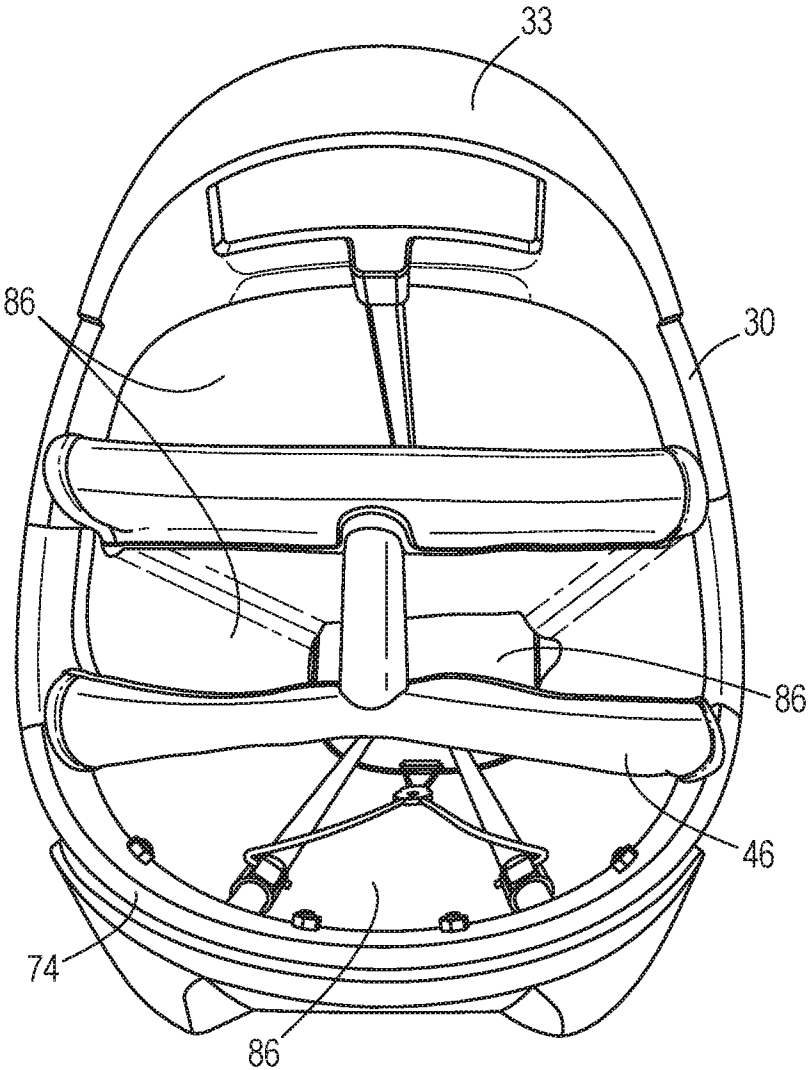
FIG. 7 is a perspective view of a portion of the golf bag of FIG. 2 taken along line 7-7 of FIG. 2, illustrating the divider top with the divider sleeve attached.
Figure 8:
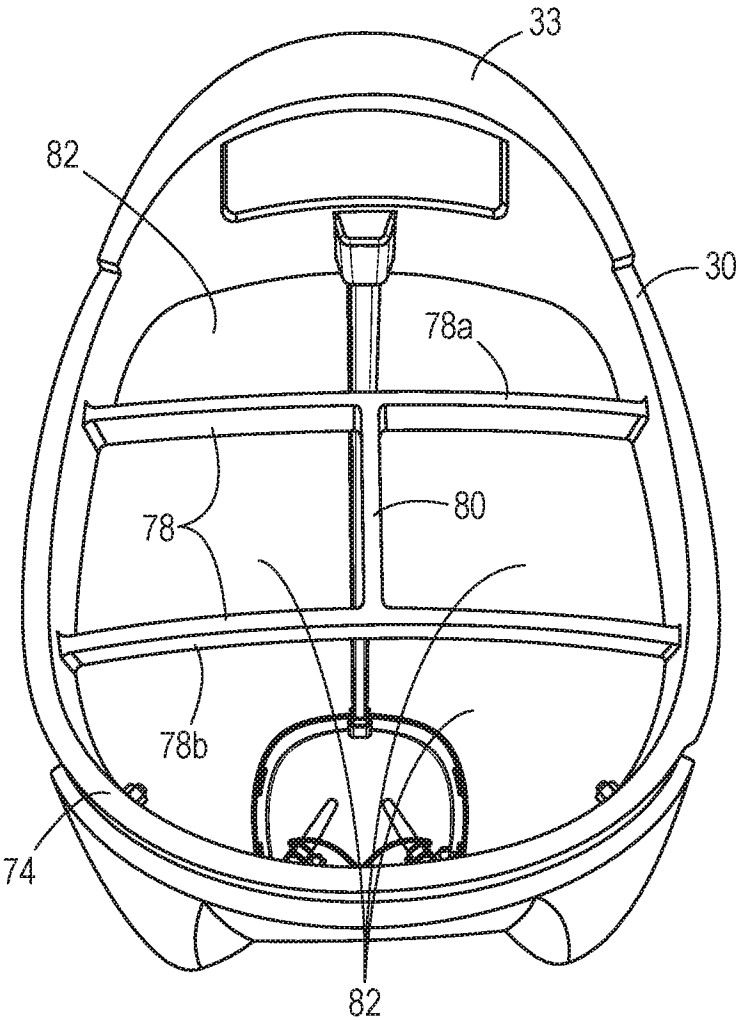
FIG. 8 is a perspective view of a portion of the golf bag of FIG. 7, illustrating the divider top with the divider sleeve removed.

FIG. 7 illustrates the divider top 30 with the divider sleeve 46 attached. The divider top 30 includes an outer ring 74 that defines a perimeter of the divider top 30. The handle 33 is formed with or otherwise connected to the divider top 30, and extends beyond the perimeter defined by the outer ring 74. Referring now to FIG. 8, the divider sleeve 46 is detached to further illustrate the divider top 30. In one embodiment, at least one cross member 78 extends across a portion defined by the outer ring 74 to define a plurality of divider apertures 82. As illustrated, a plurality of cross members 78*a*, 78*b* extend across portions defined by the ring 74, and at least one intermediate member 80 extends between the cross members 78*a*, 78*b* to define the divider apertures 82 in a preferred embodiment. The divider apertures 82 define an entry to a plurality of divider sections 86 (shown in FIG. 7) that extend from the divider top 30 towards the base 34. The divider sections 86 respectively receive one or more golf clubs, allowing a golfer to sort or isolate certain golf clubs while the clubs are received in the golf bag 10. For example, the golfer may isolate woods and/or hybrids from irons. As another example, the golfer may sort irons between a plurality of divider sections 86, such as lower lofted irons (e.g. 4-iron through 7-iron) being in a separate divider section 86 than higher lofted irons (e.g. 8-iron through wedge(s)).

Figure 9:
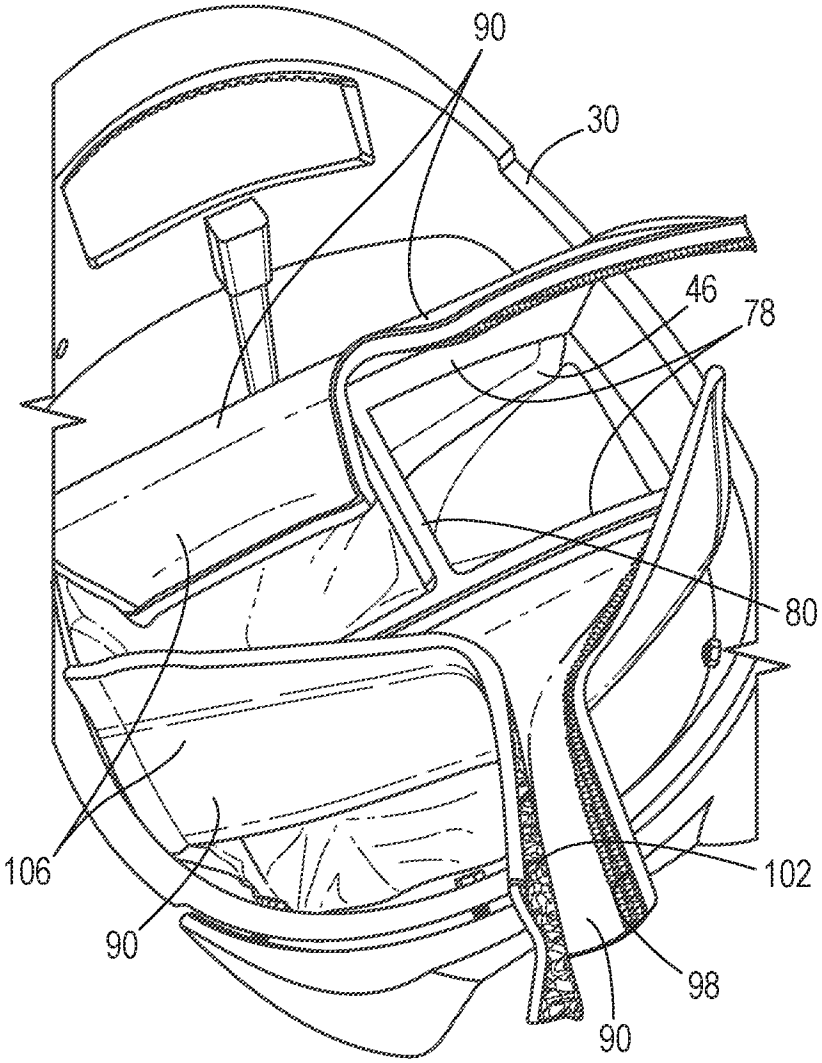
FIG. 9 is a perspective view of a portion of the golf bag of FIG. 7, illustrating a portion of the divider sleeve coupling to a portion of the divider top by a self-fastening engagement.
Figure 10:
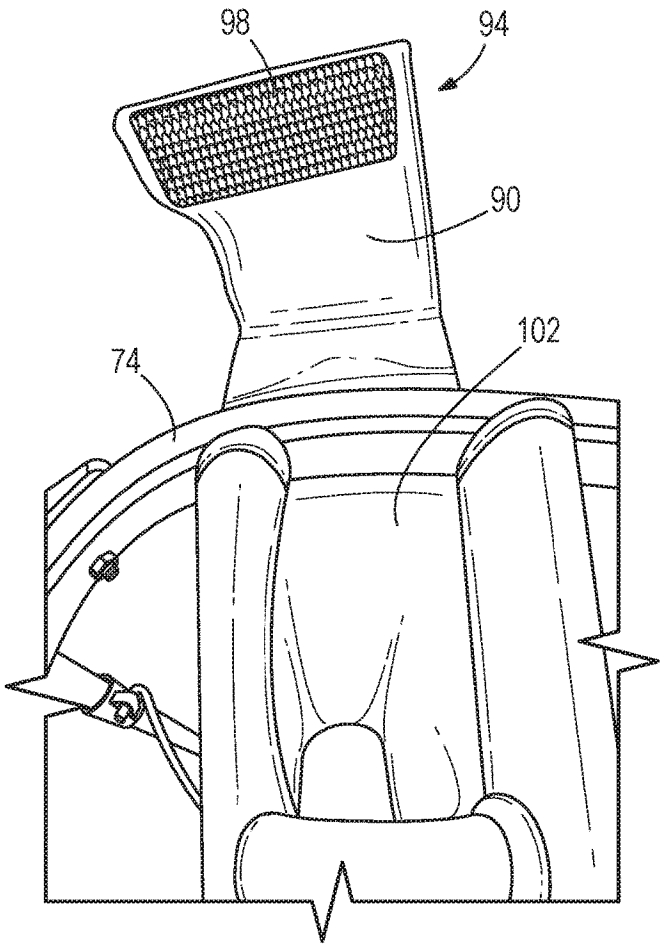
FIG. 10 is a perspective view of a portion of the golf bag of FIG. 7, illustrating a portion of the divider sleeve coupling to a portion of the outer ring of the divider top by a self-fastening engagement.

Referring now to FIGS. 9 and 10, in a preferred embodiment the divider sleeve 46 attaches to the divider top 30 by a self-fastening engagement. An end of the divider sleeve 46 opposite the connection member 50 end includes a plurality of flaps 90. The flaps 90 may be integrated into the divider sleeve 46 and each includes a self-fastener 94, illustrated as a hook-and-loop fastener. As shown in FIG. 10, the self-fastener 94 includes a first self-fastening portion 98 separated from a second self-fastening portion 102. The first and second self-fastening portions 98, 102 are provided on the same side of the flap 90, and separated by a distance sufficient for the flap 90 to wrap around a portion of the divider top 30. The first and second self-fastening portions 98, 102 are illustrated as respective hook 98 and loop 102 portions of the hook-and-loop fastener. However, in other embodiments, any suitable self-fastener 94 may be used, including a button and button hole, a hook-and-eye closure, or a snap fastener. In addition, in other embodiments the first self-fastening portion 98 may be the hook or loop portion of the fastener, while the second self-fastening portion 102 is the other of the loop or hook portion of the fastener. As illustrated in FIG. 9, the flaps 90 that wrap around the cross members 78 and the intermediate member 80 include additional padding or padded material 106 to protect the golf clubs from damage by rubbing against the cross members 78 or intermediate member 80. While the flaps 90 that wrap around a portion of the outer ring 74 are shown without additional padding or padded material, in other embodiments the flaps 90 may include such additional padding or padded material.

Figure 11:
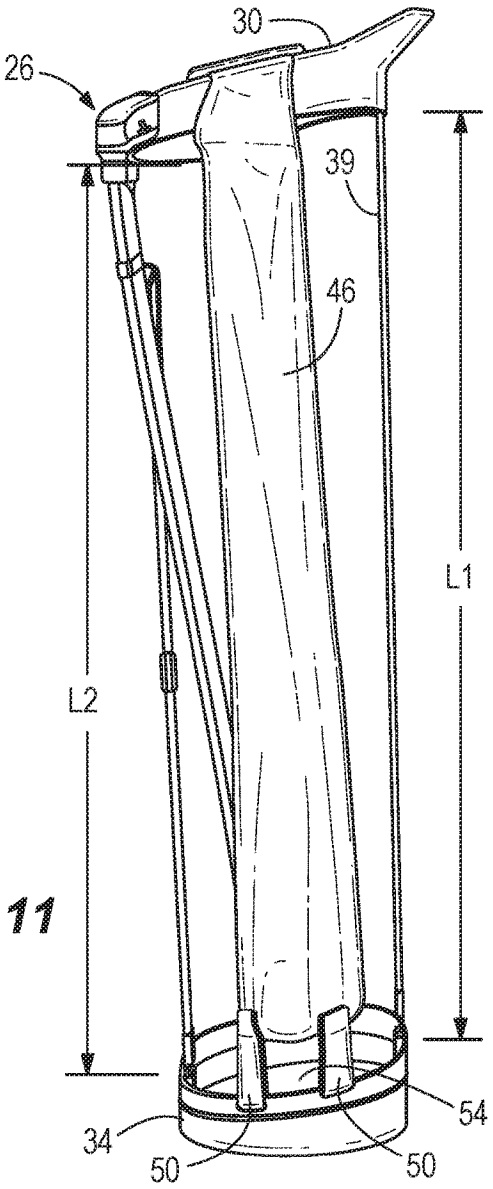
FIG. 11 is a side view of the golf bag sub-assembly of FIG. 3.

In use, the golf bag 10 typically begins in a first position or first configuration with the stand assembly 26 retracted. As illustrated in FIG. 11, in the retracted configuration, the stay 39 extends between the divider top 30 and the base 34 a first length or distance L1. The divider sleeve 46 extends away from the divider top 30 a second length or distance L2, with the second length L2 of the divider sleeve 46 being generally less than the first length L1 of the stay 39. The connection members 50 are also generally taut or have little slack between the divider sleeve 46 and the base 34. In this first configuration, the gap 54 between the divider sleeve 46 and the base 34 provides sufficient space or room between the divider sleeve 46 and the base 34 to allow a golfer to freely insert and remove one or more golf clubs from the golf bag 10.

The golfer will typically transition the golf bag 10 from the first configuration to the second configuration, deploying the stand assembly 26 when setting the golf bag 10 down. The golfer places the base 34 on a support surface with the bottom face 38 resting on the support surface. The golfer then applies a downward force on the divider top 30. By applying the downward force, the spring 41 pivots about the base 34 and pushes the legs 40*a, b* away from the bag 10. Concurrently, the stay 39 tilts about the base 34 sub-assembly towards the stand assembly 26. This also tilts the sub-assembly 42 towards the stand assembly 26, as shown in FIG. 2. It should be appreciated that while the stay 39 tilts about the base 34, the stay 39 maintains a constant distance L1 between the divider top 30 and the base 34 in both the first configuration and the second configuration, while the divider sleeve 46 moves closer to the base 34 in the second configuration than in the first configuration.

Figure 12:
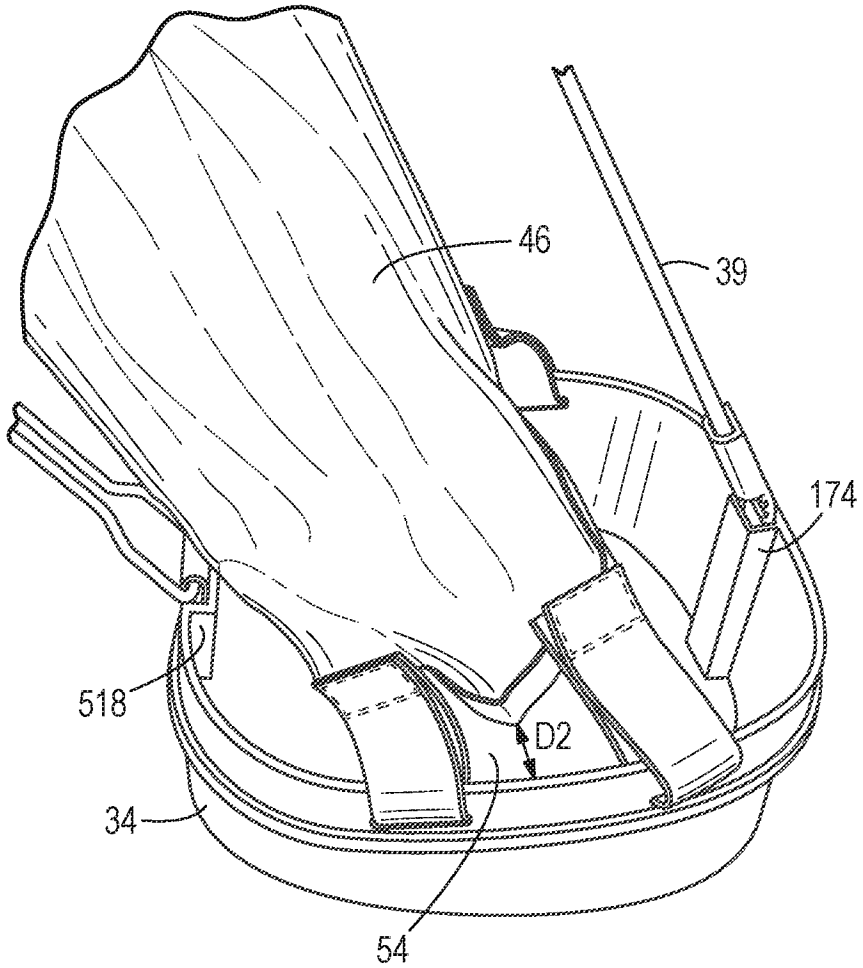
FIG. 12 is a partial perspective view of the golf bag sub-assembly of FIG. 2, taken along line 12-12 of FIG. 2.

Once in the second configuration with the stand assembly 26 deployed, the sub-assembly 42 advantageously improves the golfer's experience with the golf bag 10 by reducing bunching or gathering of the divider sleeve 46 near the base 34, improving golf club insertion and removal from the golf bag 10. Referring to FIG. 12, the gaps 54 between the divider sleeve 46 and base 34 are each reduced to a second, non-zero distance D2, which is less than a respective first distance D1. The gaps 54 provide adequate spacing for the divider sleeve 46 to pivot about the base 34 between the first configuration (FIGS. 3 and 11) and the second configuration (FIGS. 2 and 12) while limiting excess material that can lead to undesirable bunching or gathering of the divider sleeve 46 near the base 34.

A method of manufacturing the sub-assembly 42 includes providing the base 34, and coupling the divider sleeve 46 to the base 34 by the plurality of connection members 50. Each of the plurality of connection members 50 connected to the divider sleeve 46 is received in a respective slot 62 provided in the base 34. Each connection member 50 wraps around a portion of the base 34, forming a self-fastening engagement by connecting the first portion 66 of the connection member 50 to the second portion 70 of the connection member 50. The divider sleeve 46 is then coupled to the divider top 30 at an end of the divider sleeve 46 opposite the connection members 50. The divider sleeve 46 includes a plurality of flaps 90 that wrap around a portion of the divider top 30 and form a self-fastening engagement by connection of the first self-fastening portion 98 to the second self-fastening portion 102.

Once the sub-assembly 42 is manufactured, the golf bag 10 may be manufactured utilizing the sub-assembly 42. The sub-assembly 42 is inserted into the flat 14, base 34 end first. Once inserted, the sub-assembly 42 is fastened to the flat 14, for example by rivets around the perimeter of the base 34 and rivets around the perimeter of the divider top 30. The stay 39 is inserted through a slit (not shown) in the flat 14 where it is inserted at a first end to the divider top 30 and at a second, opposite end to the base 34. The stay 39 may be received in respective stay receiving slots provided in the divider top 30 and base 34. The stand assembly 26 is inserted through a portion of the flat 14, where a portion of the stand assembly 26 that includes a pivot for legs 40*a, b* is coupled to the divider top 30, for example by rivets or other suitable connection member. The spring 41 connected to each leg 40*a, b* is then connected to the base 34, for example by being inserted into a spring receiving slot in the base 34.

The golf bag 10 incorporating the sub-assembly 42 provides advantages over golf bags that are known in the art. Among them, utilizing the sub-assembly 42 improves the golfer's experience with the golf bag 10 by reducing bunching or gathering of the divider sleeve 46 near the base 34, improving golf club insertion and removal from the golf bag 10 when the golf bag is positioning in a tripod configuration with the stand assembly deployed. In addition, the connection members 50 provide the manufacturer the ability to adjust the tension of the divider sleeve 46 (and sub-assembly 42) during manufacture. Further, efficiencies and cost savings are realized during manufacture by reducing installation materials, such as rivets, and decreasing the amount of time to connect the sub-assembly 42 to the divider top 30 and base 34, through the use of self-fasteners 58, 94. In the end, this results in a reduction in total assembly time for a golf bag 10.

Figure 13:
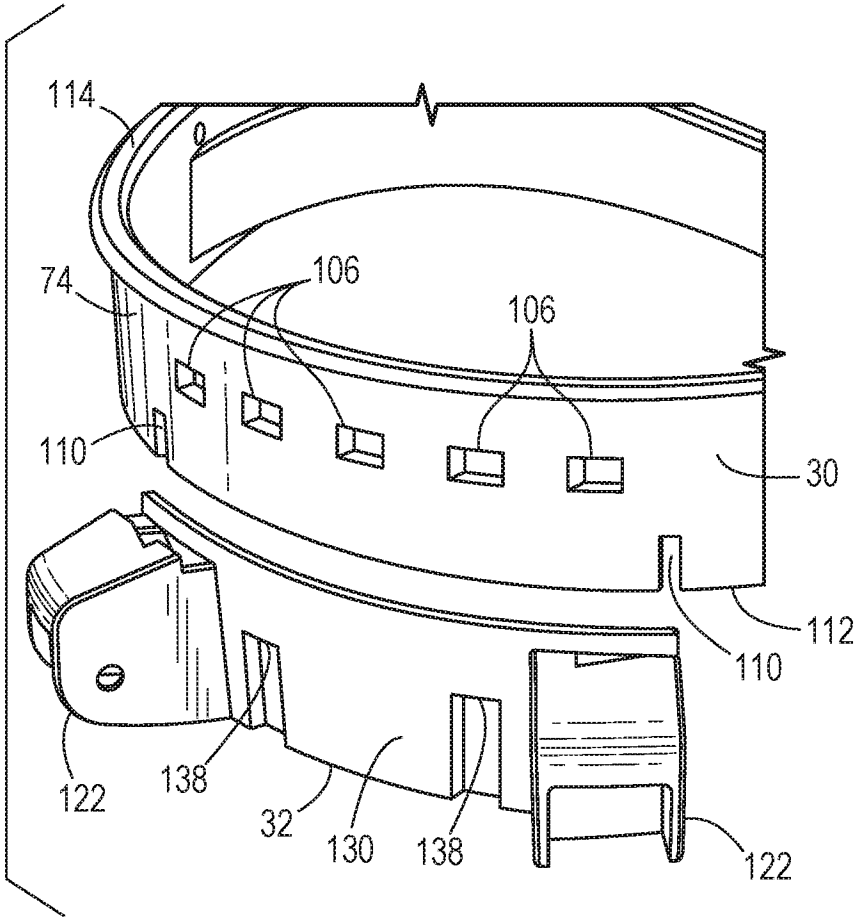
FIG. 13 is a perspective view of a front side of a leg mounting bracket separated from a divider top of the golf bag of FIG. 1.

Referring now to FIGS. 13-29, aspects of a snap-fit sub-assembly are disclosed in additional detail. FIGS. 13-20 illustrate components of a snap-fit stand assembly 26 (shown in FIGS. 2-3). As illustrated in FIG. 13, the divider top 30 is formed with a plurality of apertures 106 through the outer ring 74. The outer ring 74 also includes a plurality of alignment slots 110 provided on a first edge 112, and a rim 114 provided on an edge opposite the first edge 112 that preferably extends around the periphery of the ring 74.

Figure 15:
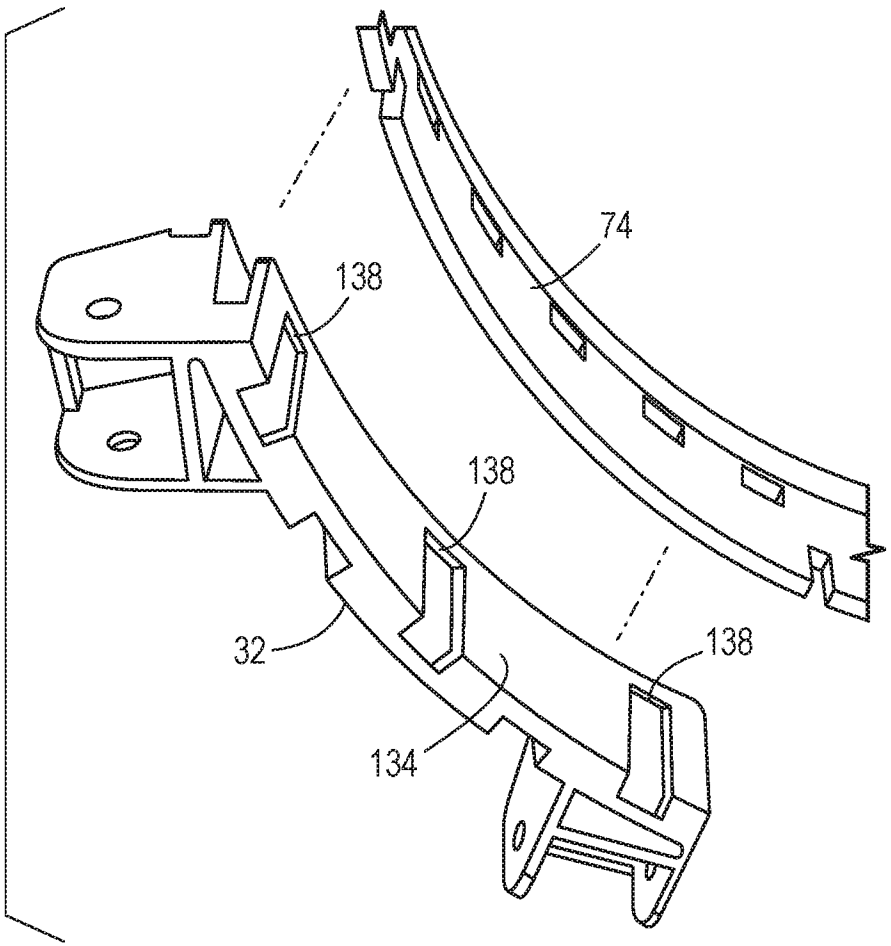
FIG. 15 is a rear perspective view of the leg mounting bracket separated from the divider top of FIG. 13.
Figure 14:
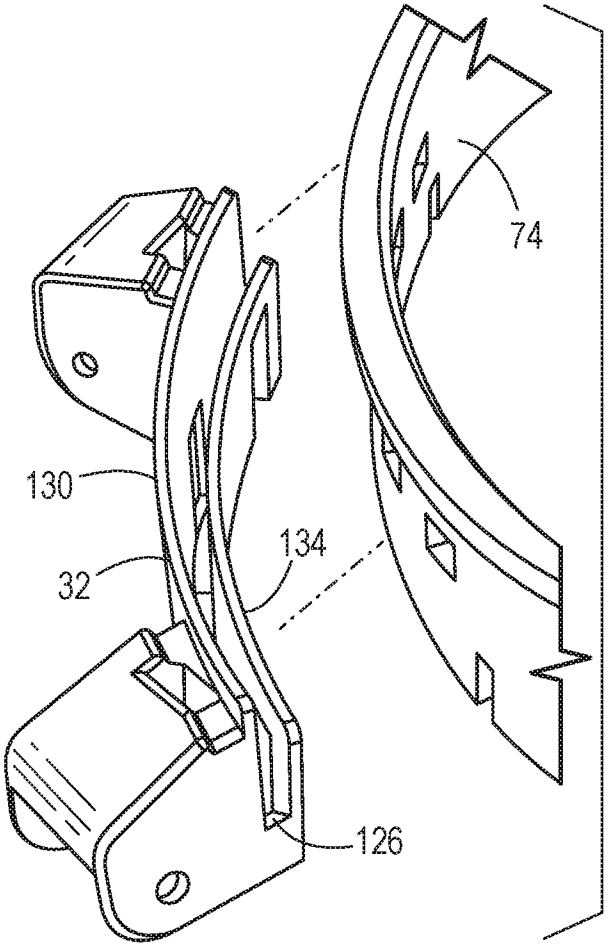
FIG. 14 is a side perspective view of the leg mounting bracket separated from the divider top of FIG. 13.

As shown in FIGS. 13-15, the leg mounting bracket 32 includes a plurality of leg anchors 122 and a mounting portion or channel 126 (shown in FIG. 14). The mounting channel 126 is defined by a front portion 130 and a back portion 134 of the bracket 32. A plurality of snaps or snap members or retention members 138 project from the front and back portions 130, 134 into the channel 126. The channel 126 also includes a plurality of alignment ribs (not shown) that facilitate alignment of the leg mounting bracket 32 with the outer ring 74 of the divider top 30. In the illustrated embodiment, five total snaps 138 are shown, with two projecting from the front portion 130 and three projecting from the back portion 134. In other embodiments, any preferred number of snaps 138 may be used, and the snaps 138 may project into the channel 126 from only the front portion 130, only the back portion 134, or any suitable combination of the front and back portions 130, 134.

The leg mounting bracket 32 generally has an angle of curvature (shown in FIG. 14) that is arcuate or curved, and is complimentary to the outer ring 74 of the divider top 30 to facilitate snap-fit connection of the leg mounting bracket 32 to the divider top 30. The leg mounting bracket 32 may have a linear shape that is complementary to the outer ring of the divider top 30. To form the snap-fit connection, the leg mounting bracket 32 is positioned to receive the first edge 112 of the outer ring 74 into the mounting channel 126. The leg mounting bracket 32 is adjusted about the outer ring 74 until the alignment ribs (not shown) of the leg mounting bracket 32 are received by respective alignment slots 110. Once received, the leg mounting bracket 32 receives the outer ring 74, with each snap 138 engaging (or being received by) a respective aperture 106 of the outer ring 74 to form the snap-fit connection. The rim 114 prevents over insertion of the outer ring 74 into the leg mounting bracket 32, while providing additional structural support for the leg mounting bracket 32 during operation of the golf bag 10. It should be appreciated that in other embodiments the orientation of the leg mounting bracket 32 in relation to the divider top 30 is not limited to engagement from below the divider top 30, and engagement from any other direction may be suitable. In addition, while the snap-fit connection is illustrated as an engagement of snaps 138 with apertures 106, any other suitable mechanical connection that counteracts and supports forces from the stand assembly 26 and locks the leg mounting bracket 32 to the divider top 30 to form a secure, structural connection may be implemented.

The divider top 30 is preferably made of polypropylene or other thermoplastic polymers for flexibility, strength, and light weight construction. Because the leg mounting bracket 32 acts as a hinge point between the legs 40 and the bag portion, it is preferably made of glass-filled nylon for strength. The snap-fit connection maintains the respective material properties of the divider top 34 and the leg mounting bracket 32, while allowing the components to act as a unified part.

Figure 16:
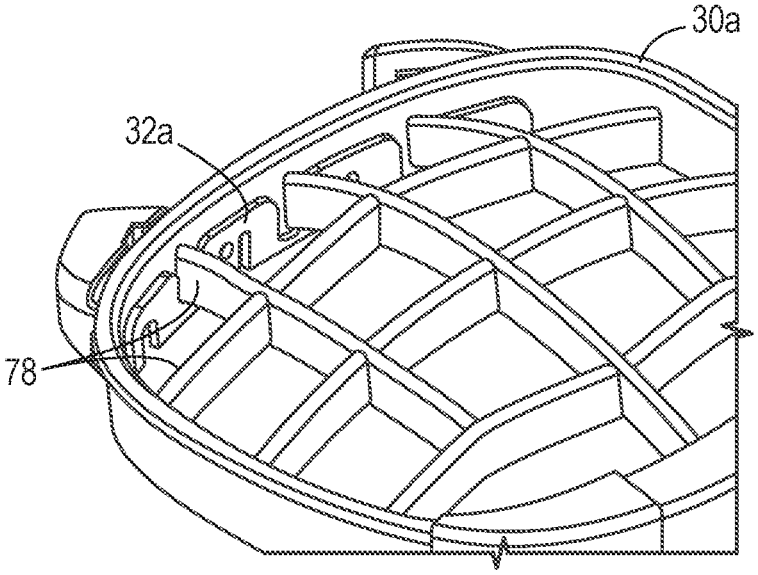
FIG. 16 is a perspective view of an alternative divider top.
Figure 17:
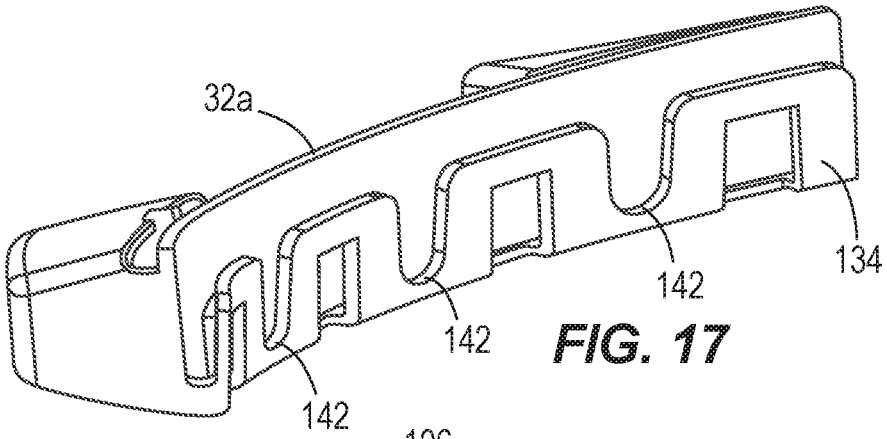
FIG. 17 is a rear perspective view of an alternative leg mounting bracket for use with the divider top of FIG. 16.
Figure 18:
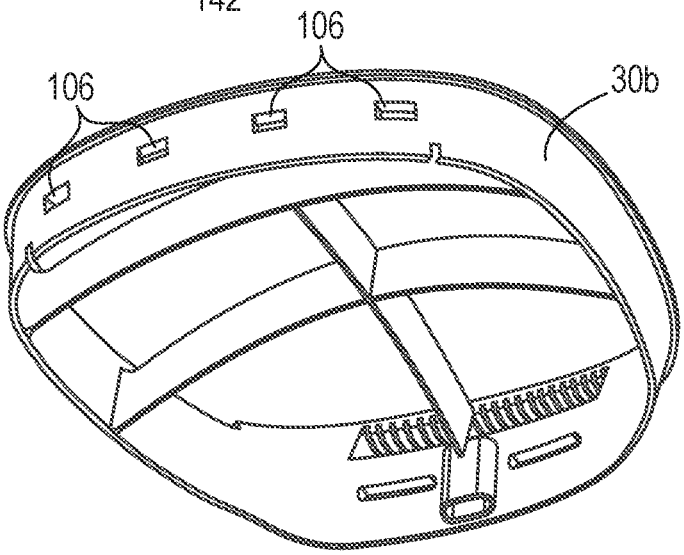
FIG. 18 is a bottom perspective view of an alternative divider top.

FIGS. 16-17 illustrate an alternative embodiment of a divider top 30*a* with a leg mounting bracket 32*a*. In this embodiment, troughs or channels 142 are provided in the back portion 134. The troughs 142 are provided to fit around cross members 78 that define divider sections in the divider top 30*a* (or intermediate members 80 as shown in FIG. 8). The troughs 142 also may act as an additional alignment aid to properly align the leg mounting bracket 32*a* with the divider top 30*a* for snap-fit connection (as disclosed in association with leg mounting bracket 32). FIG. 18 illustrates an additional alternative embodiment of a divider top 30*b* having four apertures 106 for engaging an embodiment of the leg mounting bracket 32, 32*a*.

Figure 19:
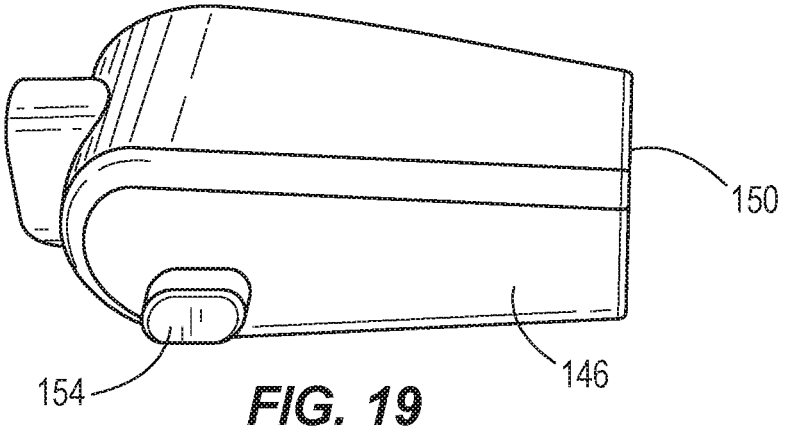
FIG. 19 is a perspective view of an end cap.
Figure 20:
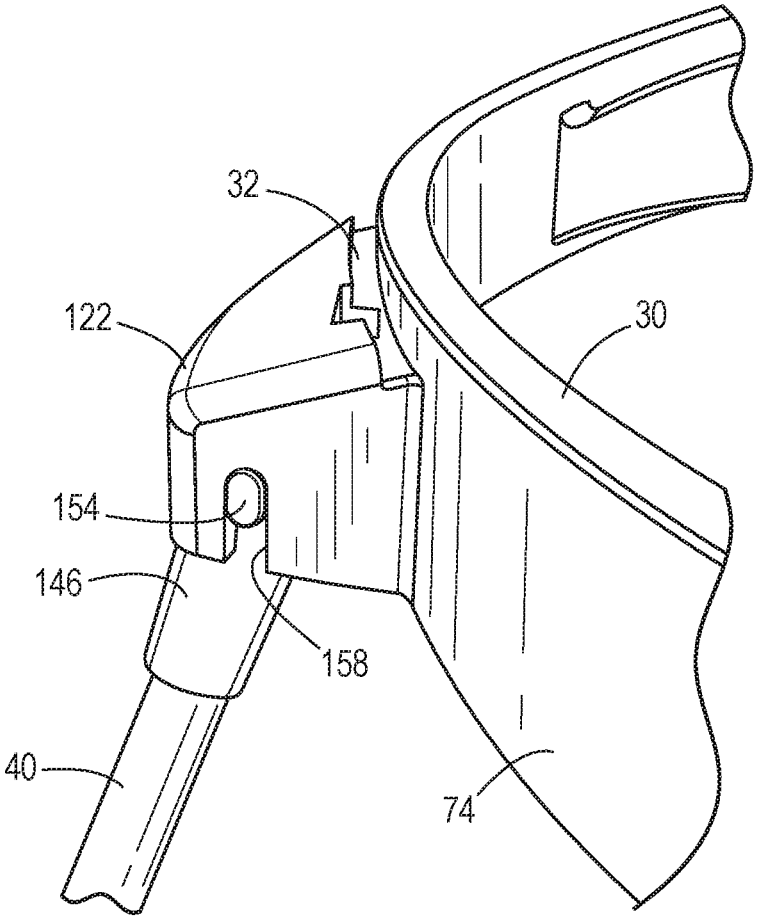
FIG. 20 is a perspective view of a portion of the divider top of the golf bag of FIG. 1, with the leg mounting bracket in snap-fit connection with the divider top, the end cap attached to a leg and received by a leg anchor of the leg mounting bracket.

FIGS. 19-20 illustrate a snap-fit connection between each leg 40 and the leg mounting bracket 32. Referring to FIG. 19, an end cap 146 includes a leg connection end 150, which connects to a leg 40 by a permanent attachment, for example, adhesive or a mechanical connection. The end cap 146 also includes opposing protrusions 154. As illustrated in FIG. 20, each protrusion 154 is received in a respective slot 158 of a leg anchor 122 to form a snap-fit connection between the end cap 146 (and each associated leg 40) and the leg mounting bracket 32. In addition, the engagement of the protrusions 154 with the slots 158 permits each associated leg 40 to pivot in relation to the respective leg anchor 122 about a pivot axis that extends through the opposing protrusions 154. In particular, this allows the legs 40 to pivot between the retracted configuration and the extended tripod configuration. In other embodiments, the slot 158 may be replaced with an aperture or any other suitable connection that provides both a snap-fit retention and pivoting connection between each leg 40 and the leg mounting bracket 32/divider top 30.

Figure 22:
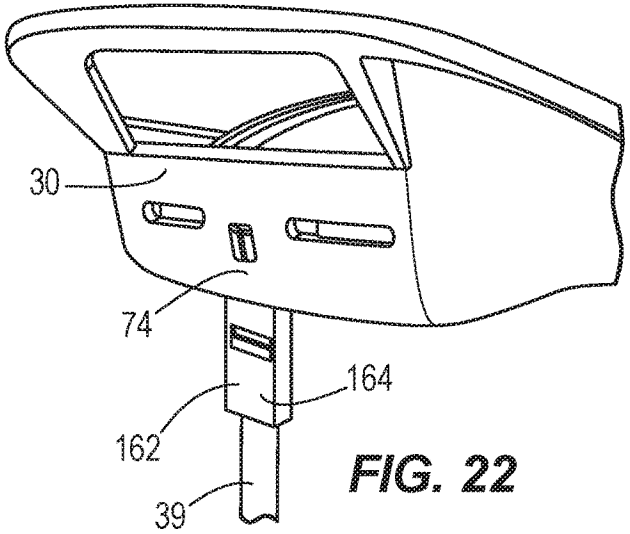
FIG. 22 is a perspective view of the top stay hinge of FIG. 21, with the top stay hinge connected to a first end of the stay and in a second configuration.
Figure 24:
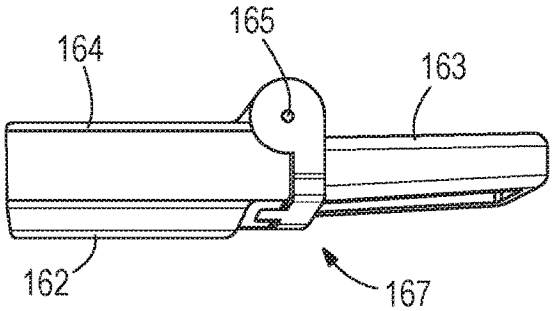
FIG. 24 is a perspective view of the top stay hinge of FIG. 23 in a second, unhinged position.
Figure 21:
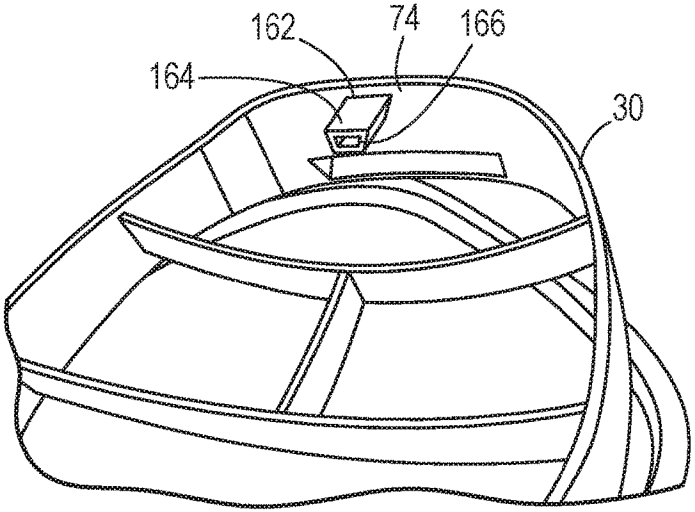
FIG. 21 is a perspective view of a top stay hinge with the stay removed and in a first configuration.
Figure 23:
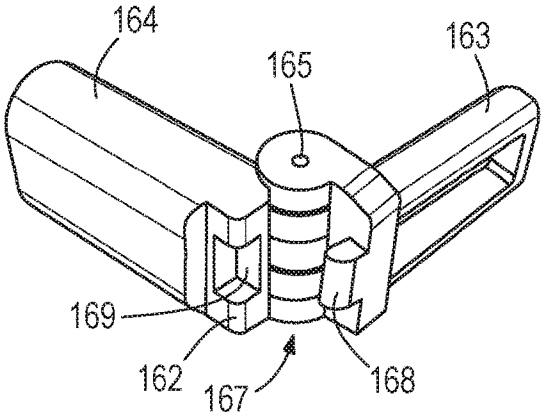
FIG. 23 is a perspective view of a top stay hinge in a first, hinged position for use in the golf bag of FIG. 1.
Figure 26:
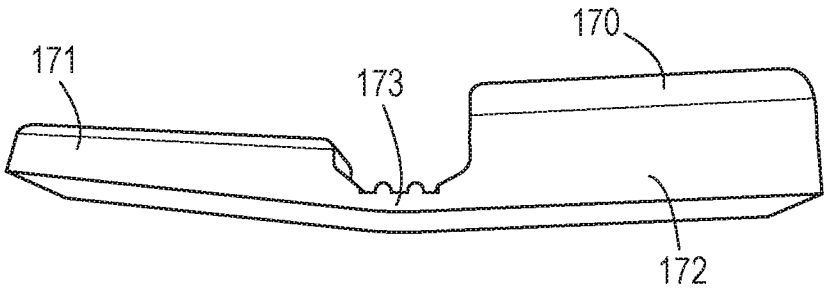
FIG. 26 is an elevation view of a side of a base stay hinge for use in the golf bag of FIG. 1.
Figure 25:
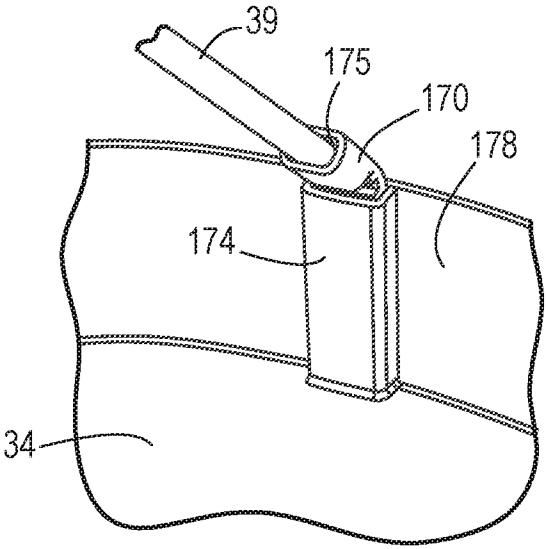
FIG. 25 is a perspective view of a bottom stay hinge connected to a second end of the stay.

FIGS. 21-29 illustrate a snap-fit sub-assembly for the pivoting stay 39 (see FIG. 2). FIGS. 21-22 illustrate a first or top stay hinge 162 pivotally connected to the divider top 30. Referring to FIGS. 25-26, the top stay hinge 162 includes a first portion or first arm 163 pivotably connected to a second portion or second arm 164 by a joint 165. The first arm 163 is connected to the divider top 30 (shown in FIG. 21), while the second arm 164 is connected to the stay 39 (shown in FIG. 22). For example, the first arm 163 can be received in a corresponding channel (not shown) in the divider top 30, while the second arm 164 can define a channel or sleeve portion 166 that receives a first or top end of the stay 39. The top stay hinge 162 pivots at the joint 165 between a first position (shown in FIG. 23) where the first and second arms 163, 164 are arranged at an angle to each other, and a second position (shown in FIG. 24) where the first and second arms 163, 164 form a straight angle to each other (e.g. 180 degrees) or are generally collinear. While the maximum angle formed between the first and second arms 163, 164 in the second position is illustrated as approximately 180 degrees, in other embodiments the maximum angle formed may be any suitable angle less than 180 degrees or greater than 180 degrees. The top stay hinge 162 pivots approximately ninety degrees (90°), from a position where the second arm 164 approximately perpendicular to a portion of the outer ring 74 (as illustrated in FIG. 21) to a position where the second arm 164 is approximately parallel to the portion of the outer ring 74 (as illustrated in FIG. 22)

To limit overextension of the top stay hinge 162 during the transition from the first position (which occurs when the golf bag 10 is collapsed) to the second position (which occurs when the golf bag 10 is deployed), the top stay hinge 162 includes a hinge limit 167. In the illustrated embodiment, the hinge limit 167 includes a hinge projection 168 (positioned on one of the first or second arm 163, 164) received by a notch 169 (positioned on the other of the second or first arm 163, 164). When rotating the top stay hinge 162 from the first position (shown in FIG. 23) to the second position (shown in FIG. 24), the notch 169 receives the projection 168 when the top stay hinge 162 reaches the second position. Portions of the first and second arms 163, 164 then contact each other, further limiting rotation or pivoting of the top stay hinge 162. The hinge limit 167 assists with preventing the divider top 30 from overextending during self-assembly.

Figure 27:
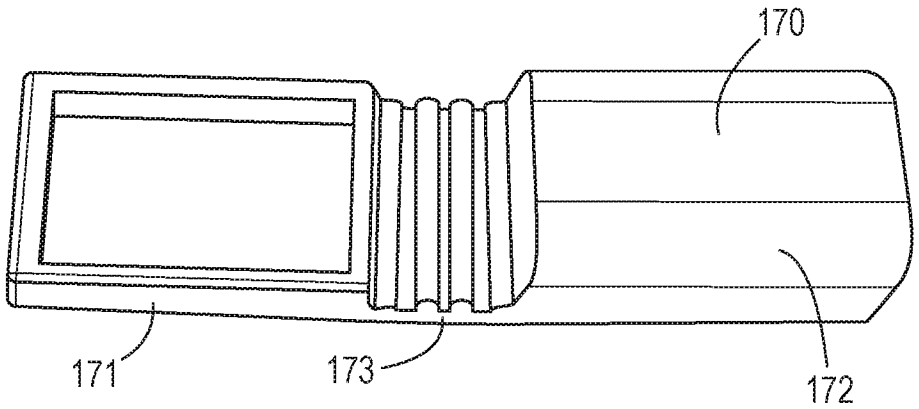
FIG. 27 is an elevation view of a top of the base stay hinge of FIG. 26.
Figure 28:
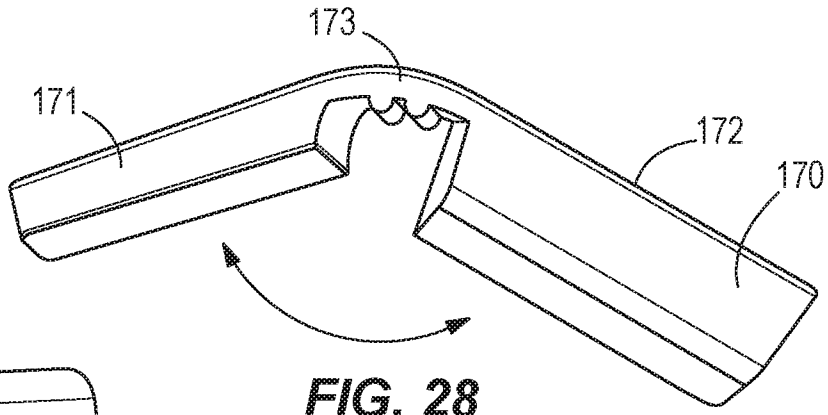
FIG. 28 is an elevation view of a side of the base stay hinge of FIG. 26, illustrating the flexing of the hinge arms.

FIG. 25 illustrates a second or bottom or base stay hinge 170 pivotally connected to the base 34. As illustrated in FIGS. 26-28, the base stay hinge 170 includes a first portion or first arm 171 that is flexibly connected to a second portion or second arm 172 by a spring or biasing portion 173. The first arm 171 is connected to the base 34, while the second arm 173 is connected to the stay 39. For example, the first arm 171 can be received or engages with a stay receiving channel 174 defined by the base 34 (shown in FIGS. 4-5 and 25), while the second arm 172 can define a channel 175 that receives a portion of the stay 39 (shown in FIGS. 5 and 25). As shown in FIG. 28, the hinge 170 flexes at the biasing portion 173. This permits the first and second arms 171, 172 to flex in relation to each other. In turn, the components attached to the first and second arms 171, 172 (e.g., the base 34 and the stay 39, respectively), flex or pivot in relation to each other. The base stay hinge 170 not only facilitates pivoting of the base 34 about the stay 39 to convert the golf bag 10 from the collapsed state to the deployed state, the base stay hinge 170 also assists with tilting the stay 39 about the base 34 as the golf bag 10 transitions from the first configuration (see FIG. 3 with the legs 40 retracted) to the second configuration (see FIG. 2 with the legs 40 extended) during use. The base stay hinge 170 is configured to pivot approximately ninety degrees (90°), from a position approximately perpendicular to a portion of a side wall 178 of the base 39 to a position approximately parallel to the portion of the side wall 178 of the base 39. In some embodiments, the stay hinges 162, 170 are flexibly pivotable rather than mechanically pivotable.

Figure 29:
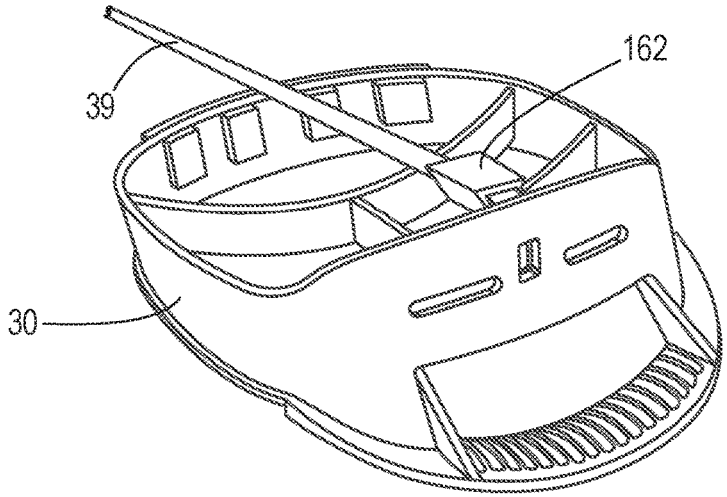
FIG. 29 is a perspective view the top stay hinge of FIG. 21, with the top stay hinge connected to a first end of the stay.

The snap-fit sub-assembly allows the stay 39 to interconnect the divider top 30 and the base 34 by snap-fit connection, while also allowing portions of the sub-assembly (e.g. the divider top 30, the base 34, and the stay 39) to be pivoted flat for more cost effective shipping by reducing packaging volume. The stay hinges 162, 170 allow the divider top 30 and the base 34 to pivot about the stay 39 from a position approximately perpendicular to the stay 39 (such as when the legs 40 are retracted for a stand bag, or in a cart bag), to a position approximately parallel to the stay 39 (as shown in FIG. 29). As a result of the configuration illustrated in FIG. 29, the divider top 30 is offset from the stay 39 and is in a plane generally parallel to the plane of the stay 39. Though not illustrated, the base 34 is also offset from the stay 39 and is in a plane generally parallel to the plane of the stay 39, with the base 34 and divider top 30 being approximately parallel or approximately in the same plane.

Figure 30:
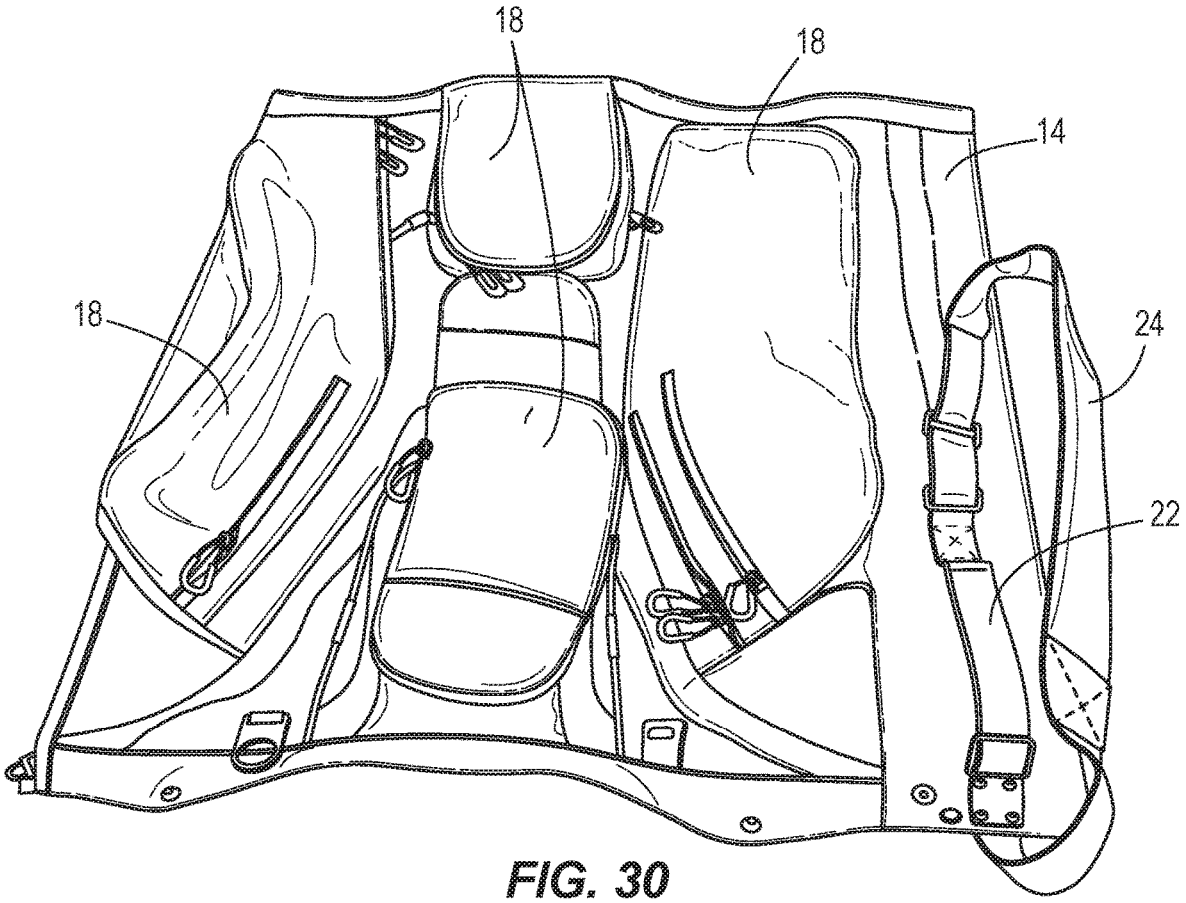
FIG. 30 is a perspective view of an exterior of the flat of the golf bag of FIG. 1.
Figure 31:
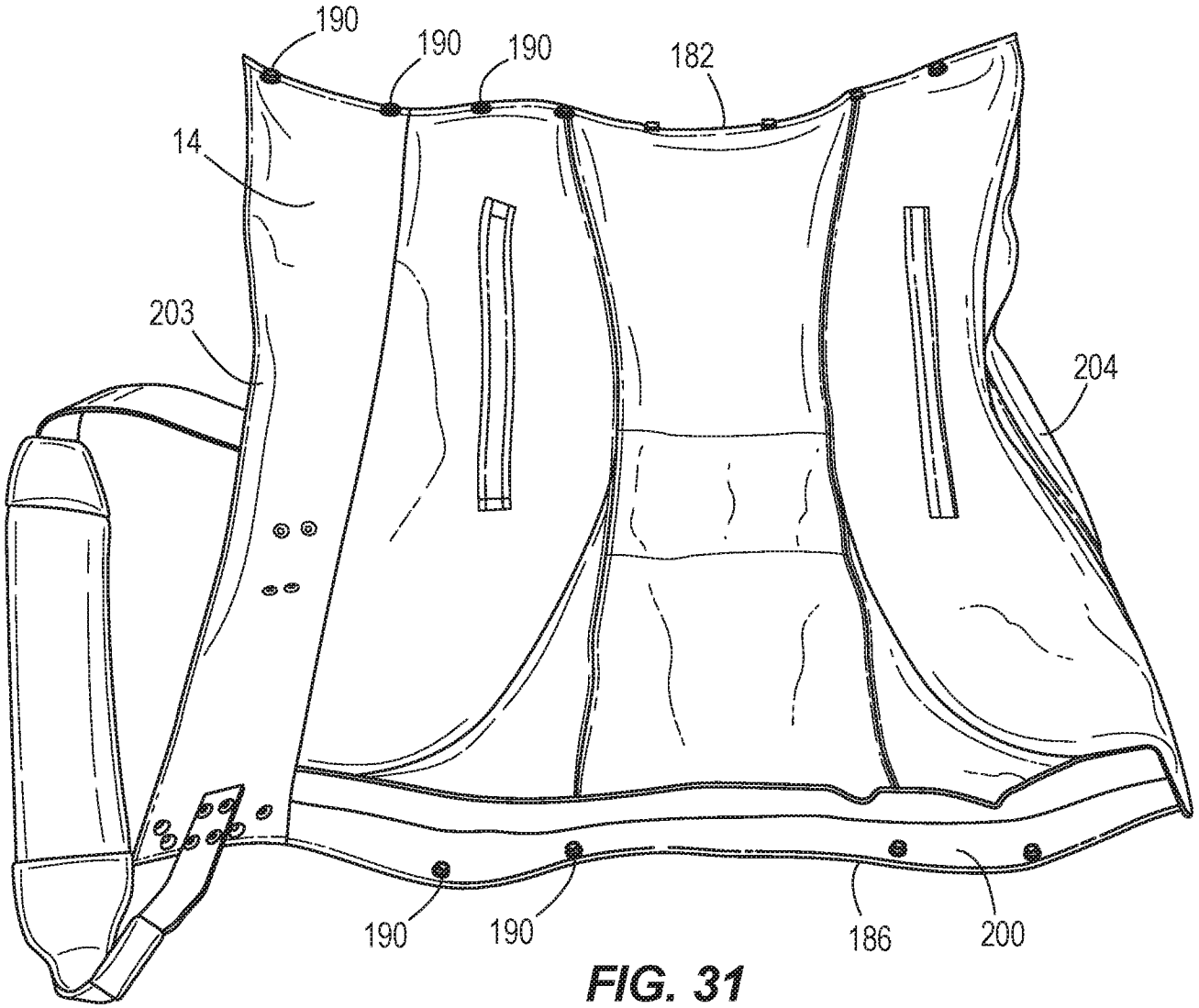
FIG. 31 is a perspective view of an interior of the flat of the golf bag of FIG. 1.

FIGS. 30-31 illustrate the flat 14 that forms a snap-fit connection with the sub-assembly during assembly to form the golf bag 10. FIG. 14 illustrates an exterior or first side of the flat 14. The flat 14 is generally formed of a single material, or two or more materials, with the pockets 18, the handle 22, and the shoulder strap 24 attached thereto. The pockets 18 may be separate and detachable from the flat 14. For example, each pocket 18 may be connected to the flat by a removable attachment, such as by snap fit buttons, hook and loop connectors (e.g. VELCRO®), or one or more zippers. The removable pockets 18 allow for custom configuration or reconfiguration of different pocket 18 sizes, number, or locations on the flat 14.

FIG. 31 illustrates an interior or second side of the flat 14. The flat 14 includes a bottom or base end 182 and a top end 186. Both ends include a plurality of snap-fit connectors 190, illustrated as male or female snap fit buttons 190, for engagement with respective snap-fit connectors 194 provided on the divider top 30 and base 34 of the sub-assembly, illustrated in FIG. 47 as female or male snap fit buttons 194.

Figure 32:
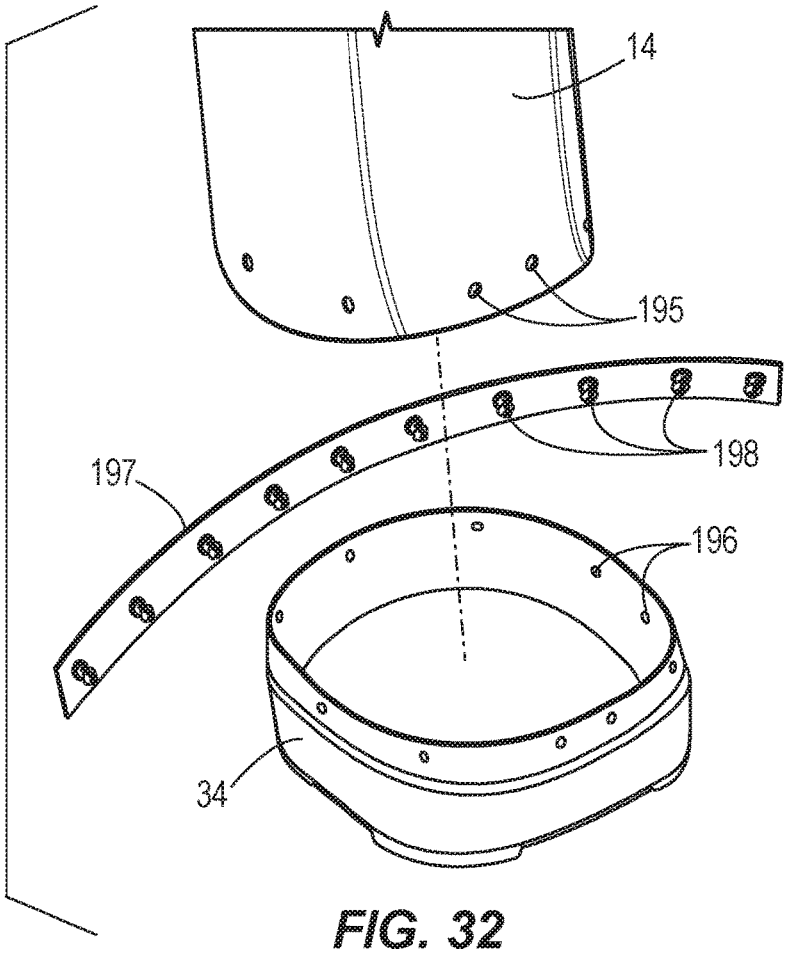
FIG. 32 is a perspective view of an alternative snap-fit attachment between the flat and base by a plurality of snap trees molded onto a strip of flexible material.
Figure 33:
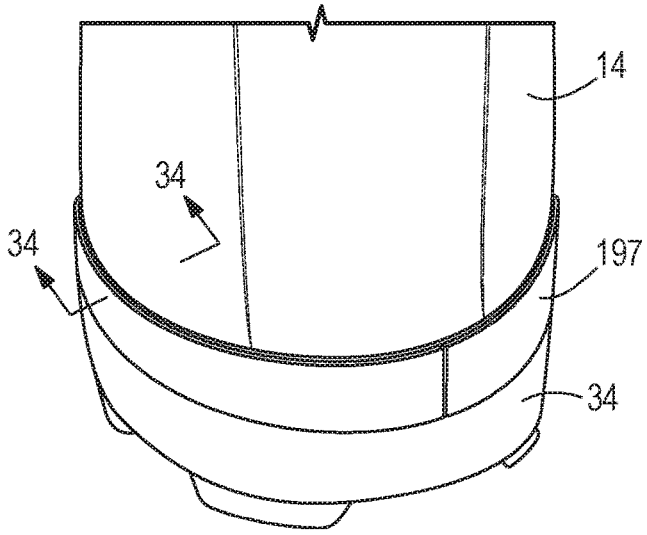
FIG. 33 is a perspective view of the alternative snap-fit attachment between the flat and base of FIG. 32, illustrating the strip of flexible material connecting the flat and the base.
Figure 34:
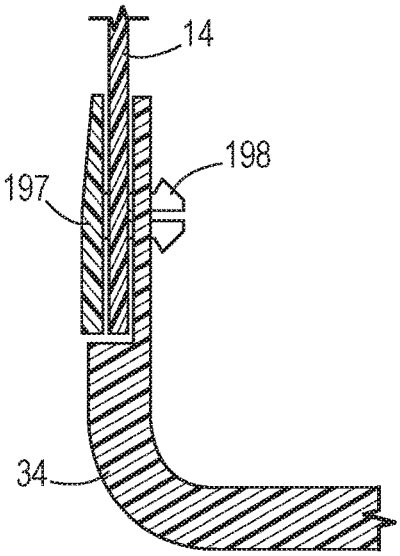
FIG. 34 a side view of a portion of the alternative snap-fit attachment between the flat and base of FIG. 32, taken along line 34-34 of FIG. 33 and illustrating a single snap tree received by corresponding holes in the flat and the base.

An alternative snap-fit connection between the flat 14 and the divider top 30 and/or base 34 is illustrated in FIGS. 32-34. The embodiment of the flat 14 includes a plurality of die cut holes 195 around the perimeter, while the embodiment of the base 34 includes a corresponding plurality of die cut holes 196 around the perimeter. The die cut holes 195 of the flat 14 and the die cut holes 196 of the base 34 are positioned in alignment, and a strip 197 of flexible molded snap trees or snap tree members 198 engages the aligned die cut holes 195, 196, with each aligned hole 195, 196 of the flat 14 and the base 34 receiving a single tree 198 (see FIG. 34). While FIGS. 32-34 illustrate an alternative snap-fit connection between the flat 14 and the base 34, the same alternative snap-fit connection may be used between the flat 14 and the divider top 30. In still other embodiments, the flat 14 may form a snap-fit attachment with the sub-assembly 42 by a hook and loop fastener (e.g. VELCRO®), hook and hook fastener, buttons, or any other suitable snap-fit fastener or securing assembly.

The flat 14 also includes a reinforcing ring 200 at the top end 186 to provide additional reinforcement and rigidity around the divider top 30 (see FIG. 31). The flat 14 may also include a plurality of windows (not shown) that respectively allow the anchors 122 of the leg mounting bracket 118 to protrude through, exposing the anchors 122 to facilitate the snap-fit and pivotal connection with the legs 40. This permits the flat 14 to be interchangeable between a cart bag sub-assembly and a carry (or stand) bag sub-assembly. In addition, the flat 14 includes a seam 202 (see FIG. 52) that is defined by a first seam edge 203 opposite a second seam edge 204 (see FIG. 31). Following attachment to the sub-assembly 42, the seam edges 203, 204 of the flat 14 are connected by a single zipper, two zippers, a hook and loop fastener (VELCRO®), mounting tracks with a tongue that fits within associated rails, snap fit buttons, or any other suitable snap-fit fastener or securing assembly. In one construction, a single zipper attaches the edges 203, 204 at a middle portion of the flat 14, with the top and/or bottom of the flat 14 secured with snap fit buttons, a hook and loop fastener (VELCRO®), etc. In another construction, two zippers connect two separate seams of the flat 14 to the sub-assembly 42. In yet another embodiment the flat 14 may be split apart into multiple portions that attach to the sub-assembly 42 by snap-fit attachment. An advantage of a single seam, however, is easier waterproofing of the flat 14, and a single attachment line for wrapping the flat 14 around the sub-assembly 42.

Figure 35:
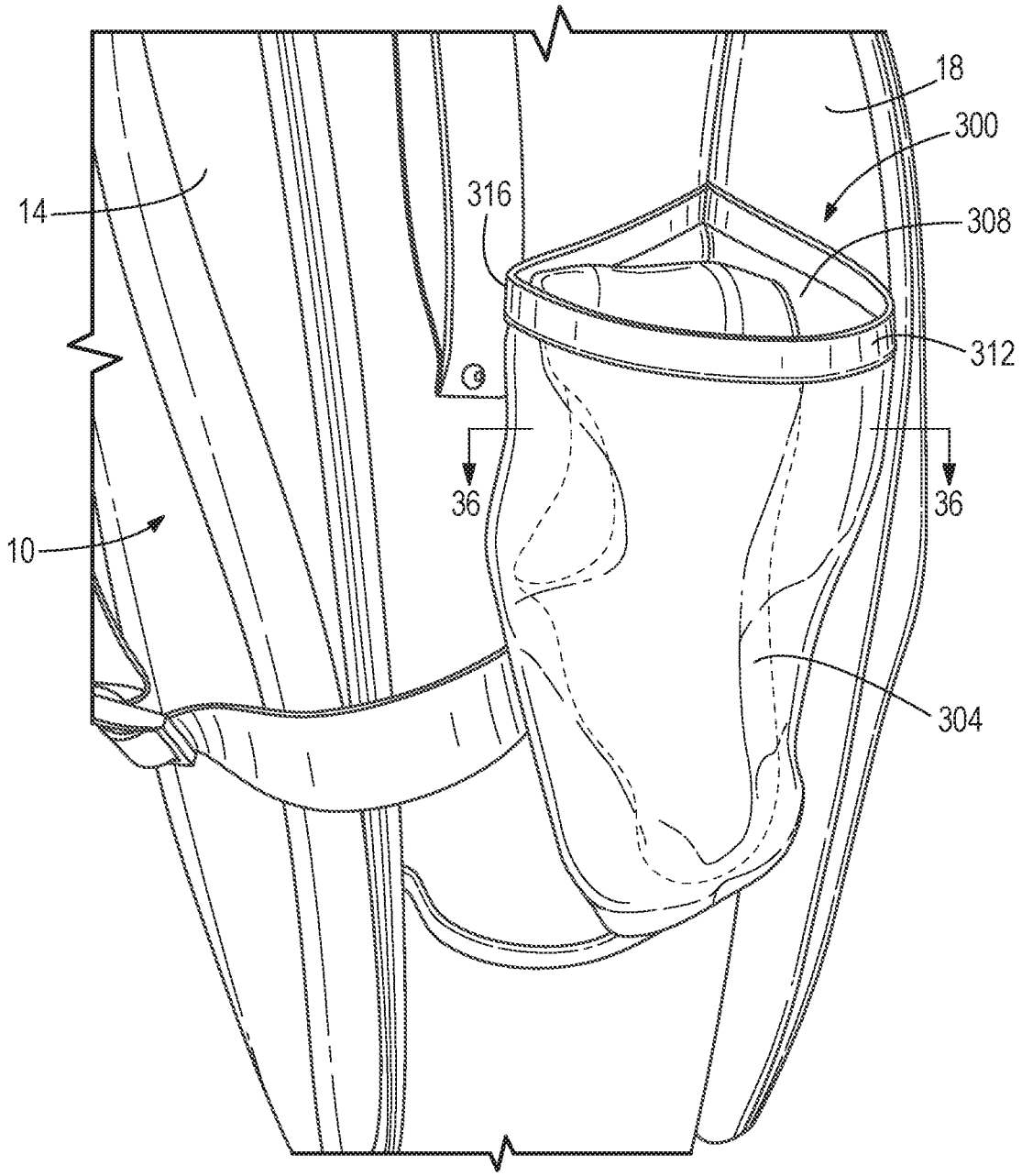
FIG. 35 is a perspective view of an embodiment of a deployable pocket assembly for a golf bag, the pocket assembly shown in a deployed configuration and containing a shoe.

FIGS. 35-46 illustrate a deployable shoe pocket assembly 300 that is attached to the golf bag 10. The shoe pocket assembly 300 is deployable between a first (or deployed) configuration (shown in FIGS. 35-36) and a second (or stored) configuration (shown in FIG. 37). Referring specifically to FIG. 35, the shoe pocket assembly 300 includes a shoe pocket 304 that defines a compartment 308 configured to receive a shoe (or a pair of shoes). One end of the shoe pocket 304 defines an opening 312 to provide access to the compartment 308. The perimeter of the opening 312 can include or at least partially enclose an elastic material 316 that is biased inward, or otherwise configured to constrict in its relaxed position, to minimize a size of the opening 312. This facilitates retention of a shoe (or shoes) received by the shoe pocket 304, while also reducing the size of the shoe pocket 304 when not in use.

Figure 36:
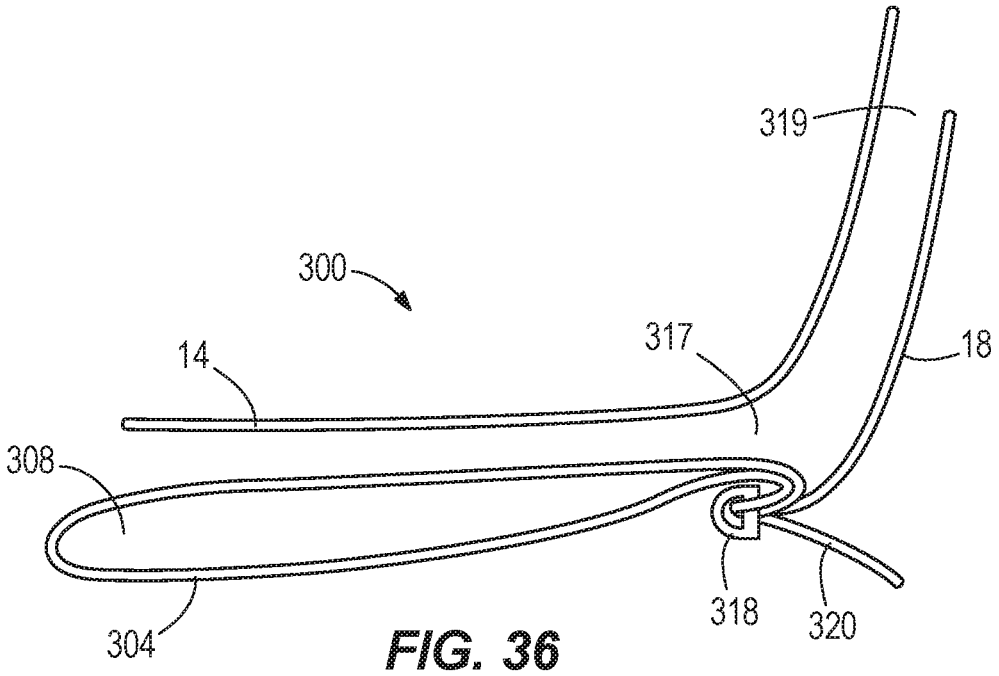
FIG. 36 is a top down view of the deployable pocket assembly of FIG. 35 in a deployed configuration, taken along line 36-36 of FIG. 35, and showing a shoe pocket with the shoe removed.

FIG. 36 illustrates the shoe pocket 304 in the first or deployed configuration. The pocket 18 can be attached to the flat 14 along a seam (or other suitable fastener). A portion of the seam can define an access port 317 to a storage channel 319 that is partially defined by the flat 14 and partially defined by the pocket 18 (see FIGS. 36 and 37). The shoe pocket 304 is attached to the pocket 18 by a fastener 318 (e.g., a clip, stitching, etc.) at a gusset 320. The gusset 320 can be positioned at an edge of the pocket 18 or at any other suitable portion of the pocket 18. In other embodiments, the shoe pocket 304 can be attached to a portion of the flat 14 (e.g., at a gusset on the flat 14, etc.).

Figure 37:
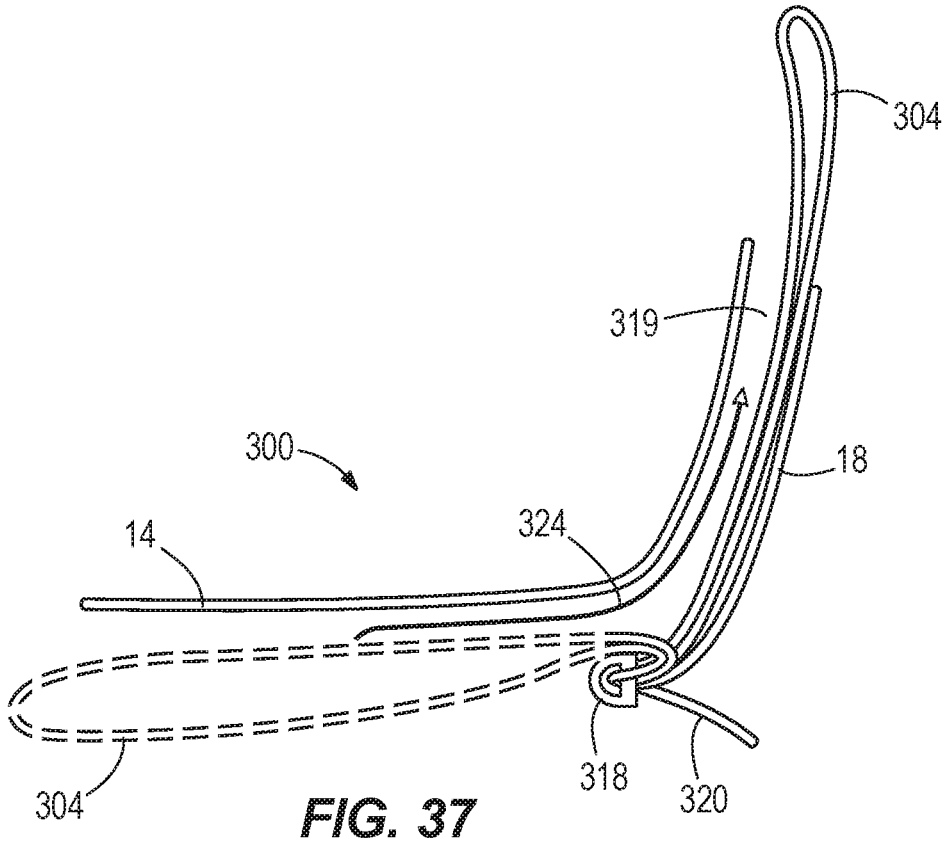
FIG. 37 is a top down view of the deployable pocket assembly of FIG. 35, showing the shoe pocket in the stored configuration in solid lines and in the deployed configuration in broken lines.

FIG. 37 illustrates the shoe pocket 304 in the second or stored configuration. In this configuration, the shoe pocket 304 is positioned into the storage channel 319 (the shoe pocket 304 is shown in broken lines in the deployed configuration), as indicated by arrow 324. Accordingly, this allows a user to selectively deploy the shoe pocket 304 to store a shoe or shoes, and then retract the shoe pocket 304 into the stored configuration when not in use.

Figure 39:
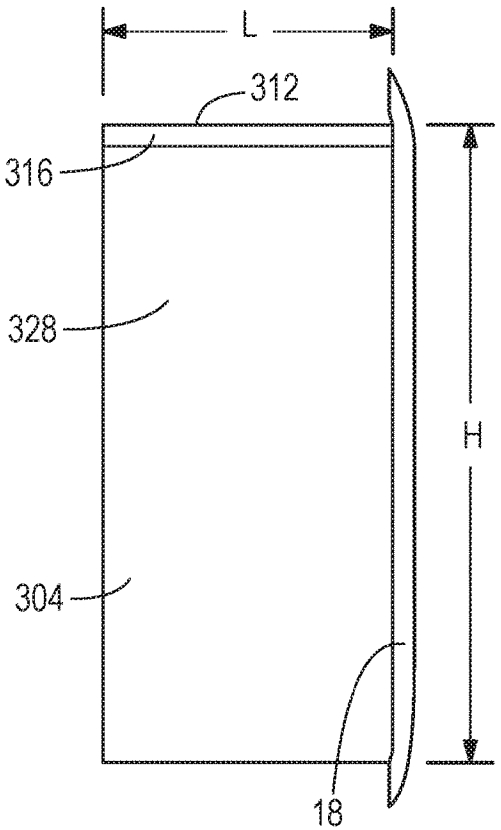
FIG. 39 is a side view of the shoe pocket.
Figure 38:
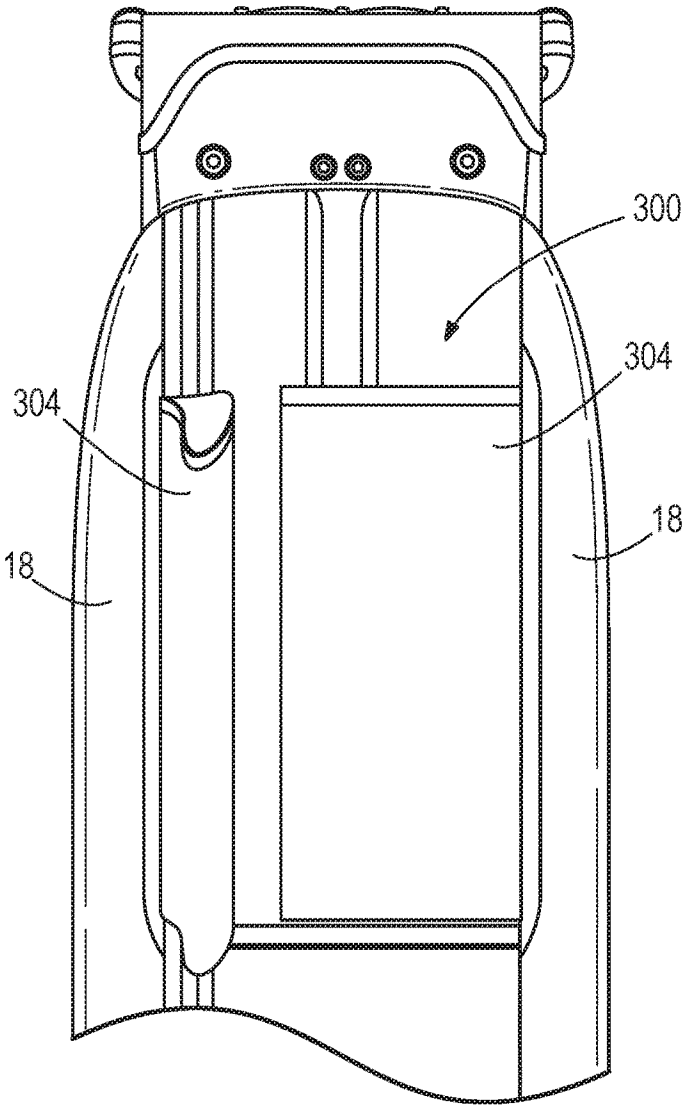
FIG. 38 is a perspective view of the golf bag of FIG. 35 illustrating two shoe pockets in the deployed configuration.
Figure 40:
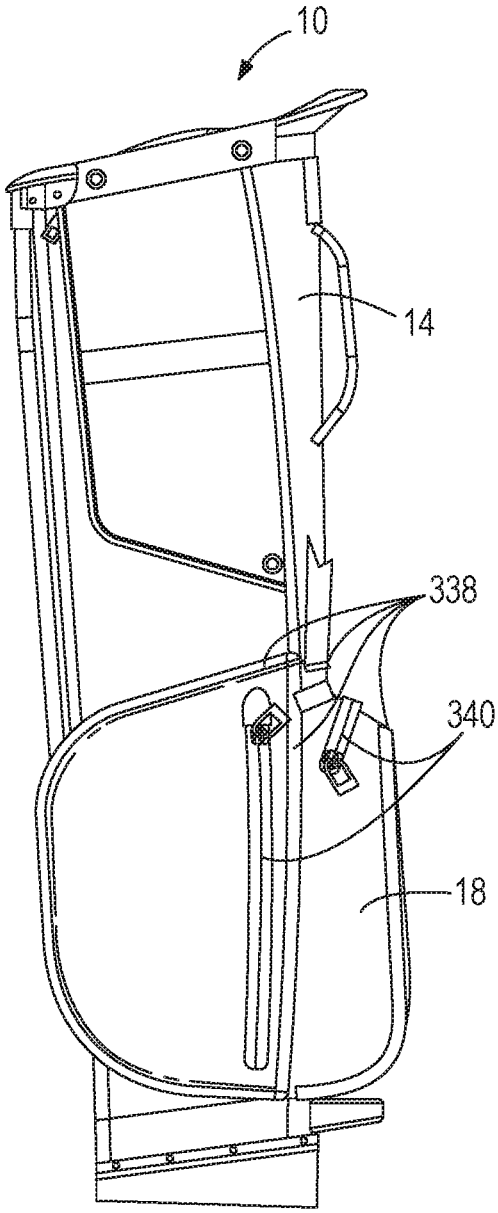
FIG. 40 is a side view of a first side of another embodiment of a golf bag.
Figure 41:
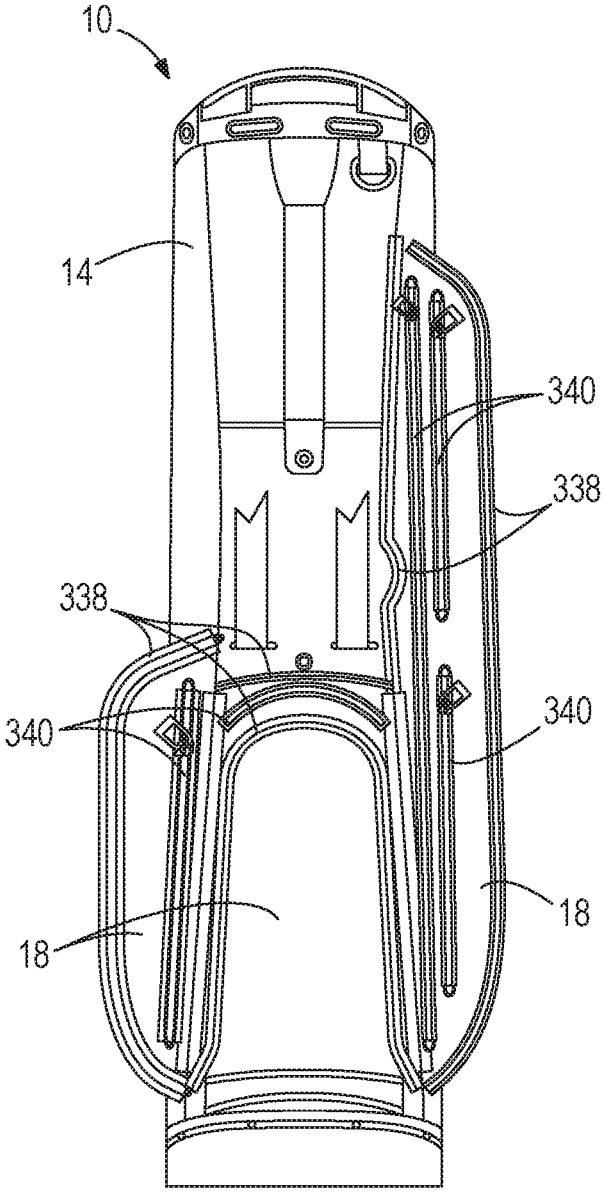
FIG. 41 is a side view of a second side of the golf bag of FIG. 38.
Figure 42:
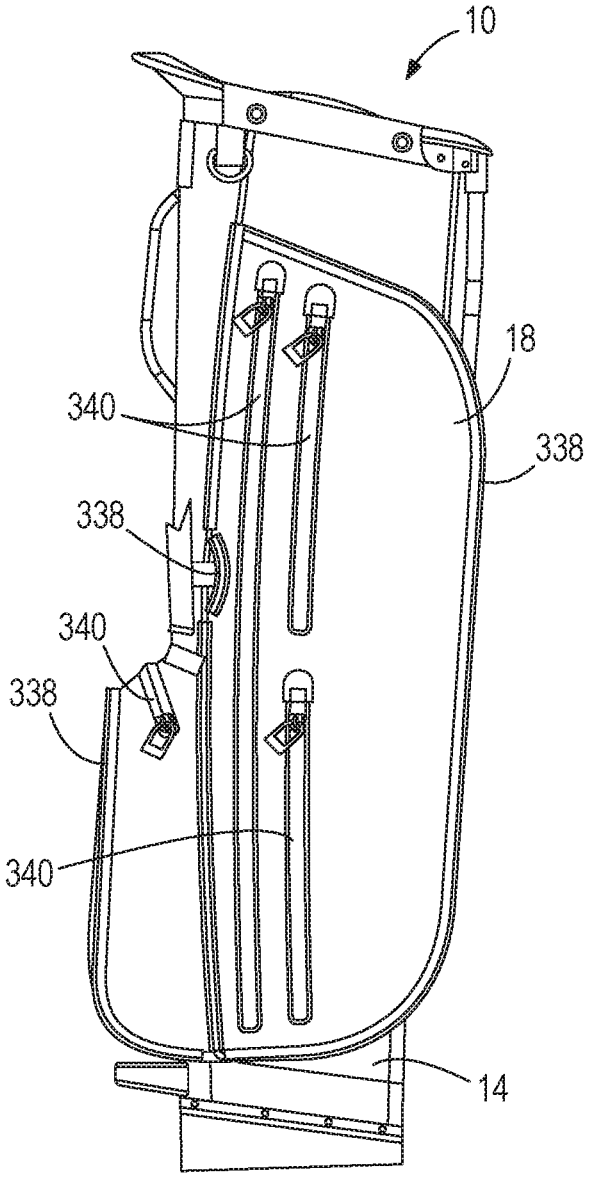
FIG. 42 is a side view of a third side of the golf bag of FIG. 38, opposite the first side.
Figure 43:
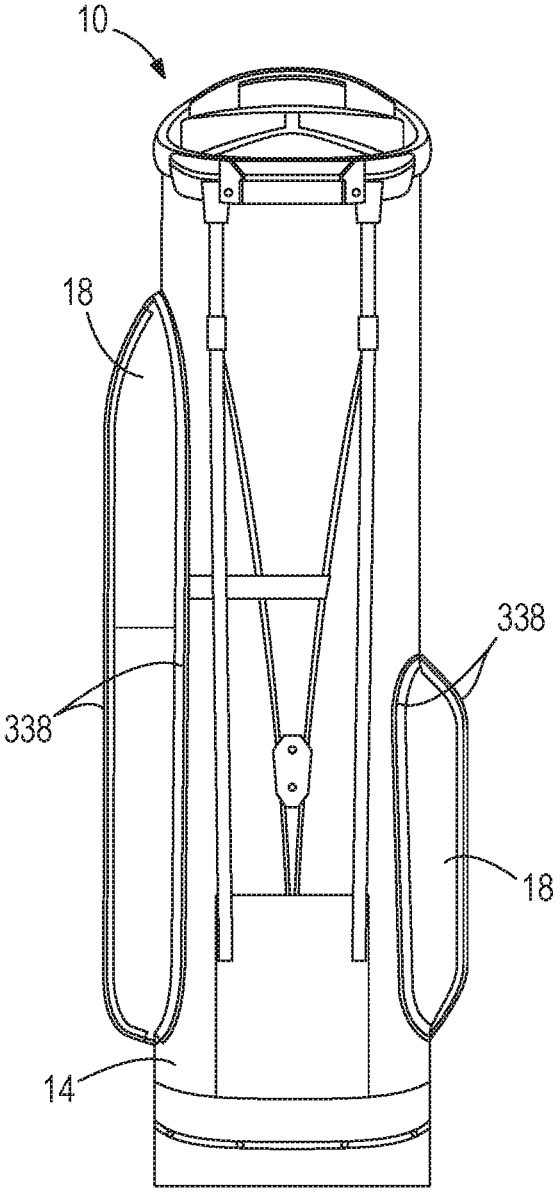
FIG. 43 is a side view of a fourth side of the golf bag of FIG. 38, opposite the second side.
Figure 44:
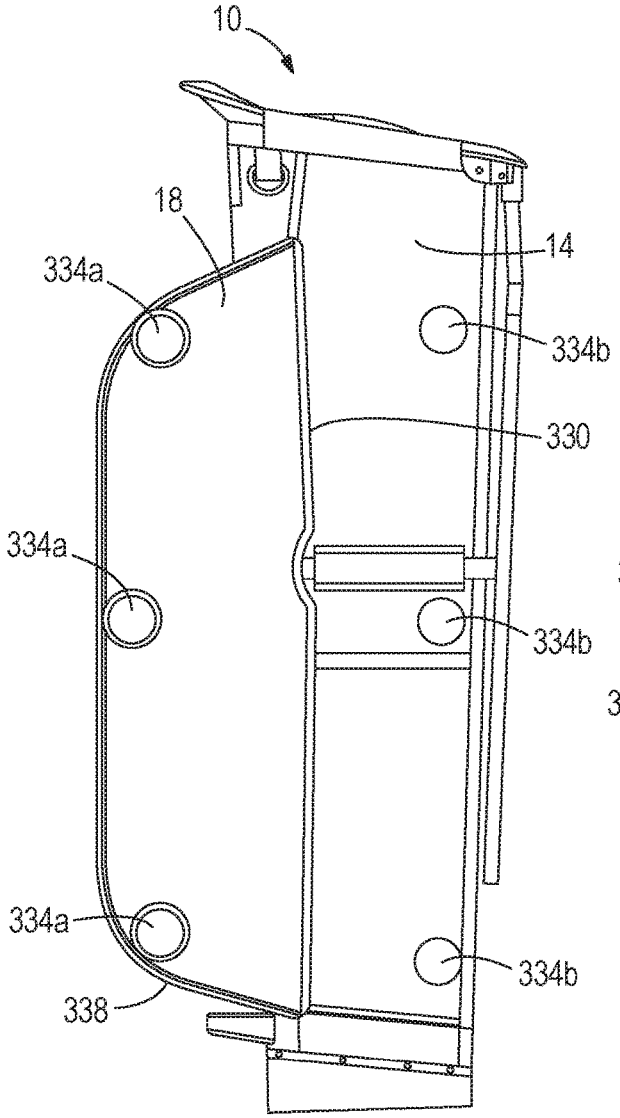
FIG. 44 is a side view of the golf bag of FIG. 40 with the pocket pivoted along a seam.
Figure 45:
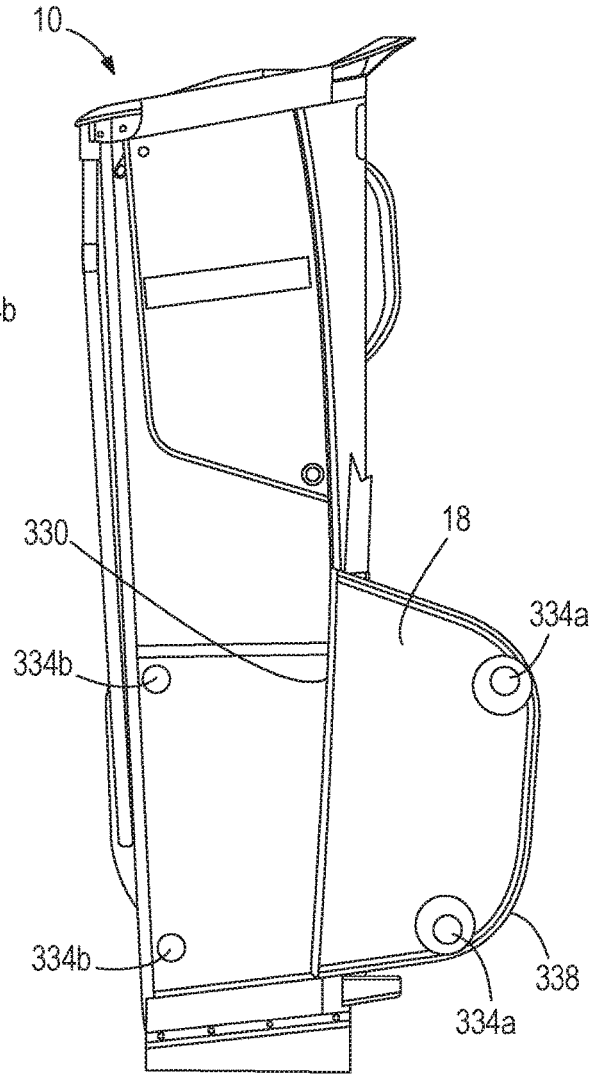
FIG. 45 is a side view of the golf bag of FIG. 38 with the pocket pivoted along a seam.
Figure 46:
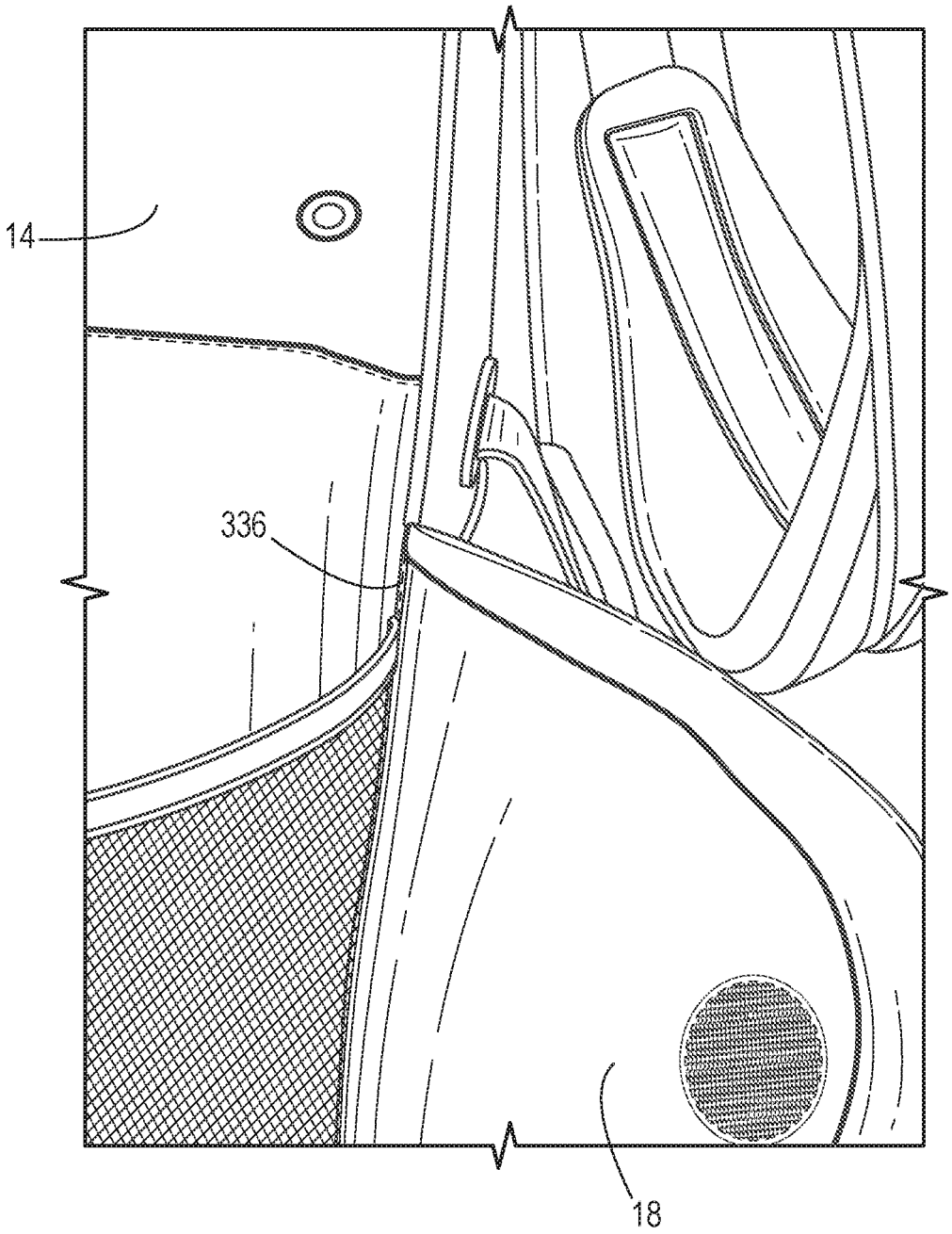
FIG. 46 is a perspective view of the golf bag of FIG. 38 illustrating the seam between the pocket and the flat that receives a waterproofing treatment.

In the illustrated embodiment, the shoe pocket assembly 300 is positioned on a side of the golf bag 10 opposite the handle 22 and/or straps 24 (e.g., a "belly" side of the golf bag 10). In other embodiments, the shoe pocket assembly 300 can be positioned at any suitable location on the golf bag 10. Further, the illustrated embodiment shows a single shoe received in the shoe pocket 304. Accordingly, the shoe pocket assembly 300 can include two shoe pockets 304 to accommodate a pair of shoes, as illustrated in FIG. 38. In the embodiment illustrated in FIG. 38, the shoe pockets 304 are attached to separate pockets 18. However, in other embodiments the shoe pockets 304 can both be attached to a single pocket 18. As shown in FIG. 39, each shoe pocket 304 is formed of an elastic or stretch mesh material 328. In other embodiments, the shoe pocket 304 can be formed of any suitable material (e.g., nylon, polyester, etc.). In addition, each shoe pocket 304 is sized to receive and carry a shoe. The shoe pocket 304 can have a height H of approximately thirty (30) centimeters, and a length L of approximately seventeen and a half (17.5) centimeters, which defines a perimeter of the opening 312 of approximately thirty-five (35) centimeters. In other embodiments, the shoe pocket 304 can be any suitable size to carry one shoe, or sized to carry a pair of shoes. The shoes received in the shoe assembly 300 can include any suitable shoes (e.g., golf shoes when the golf bag 10 is being transported away from a golf course, street shoes when the golf bag 10 is being transported on or around the golf course, etc.).

FIGS. 40-46 illustrate an embodiment of the golf bag 10 that includes waterproofing to reduce water penetration into one or more compartments of the golf bag 10. For example, pockets 18 can be manufactured out of a coated polyester material, and more specifically a double coated polyester material. As an example, the coating for the polyester can be a polyester-polyurethane resin coating and/or a polyurethane resin coating. Coated polyester advantageously does not shrink in high temperature weather conditions (e.g., above ninety degrees Fahrenheit, etc.). The pockets 18 can be manufactured, coated, and then attached to the flat 14 (e.g., sewn, etc.). With additional reference to FIGS. 44-45, once the pockets 18 are attached to the flat 14, the securement points 330 (e.g., seams, etc.) can be coated with the waterproofing. The pockets 18 can be selectively coupled to the flat 14 at an edge opposite the securement point 330 by a plurality of complementary fasteners 334*a*, 334*b* (e.g., hook and loop fasteners, etc.). The fasteners 334*a*, 334*b* (shown in FIGS. 44-45) and/or an edge of the pockets 18, or a seam 336 where each pocket 18 connects to the flat 14 (shown in FIG. 46), or a zipper 340 or other access opening to each pocket 18 (shown in FIGS. 40-45) can be coated with the waterproofing. The waterproofing reduces penetration of water or other liquids into the treated pockets 18 or portions of the flat 14, which assists in keeping items stored within the pockets 18 dry in adverse weather conditions or inadvertent exposure to water (e.g., positioning the golf bag 10 near an irrigation head, etc.). Referring to Table 1, the golf bag 10 having waterproofing, as described herein, resulted in an overall reduction in water retention of approximately 26%-73%, and a reduction in water detection in the pockets 18 of approximately 6%-44%, compared to various commercial waterproof golf bags.

TABLE 1

Water Retention and Detection of Various Waterproof Golf Bags

| | Water Retention (gallons) | Percent Positive Water Detection in Pockets |
|---|---|---|
| Golf bag 10 having waterproofing | 0.023 | 0.0 |
| Commercial waterproof golf bag 1 | 0.085 | 6.3 |
| Commercial waterproof golf bag 2 | 0.031 | 6.3 |
| Commercial waterproof golf bag 3 | 0.049 | 43.8 |

FIGS. 47-53 illustrate a method of snap-fit assembly of an embodiment of the golf bag 10. The embodiment illustrated in FIGS. 47-53 is a cart golf bag 10, however the method is the same for assembling a carry bag or stand bag unless otherwise noted. It should also be appreciated that FIGS. 47-53 illustrate a sub-assembly 52, which may be the same as sub-assembly 42. The sub-assembly 52 includes a divider top 37, a base 44, and a divider sleeve 88. The divider top 37 may be the same as the divider top 30, 30*a*, 30*b*, the base 44 may be the same as the base 34, and the divider sleeve 88 may be the same as the divider sleeve 46.

Figure 47:
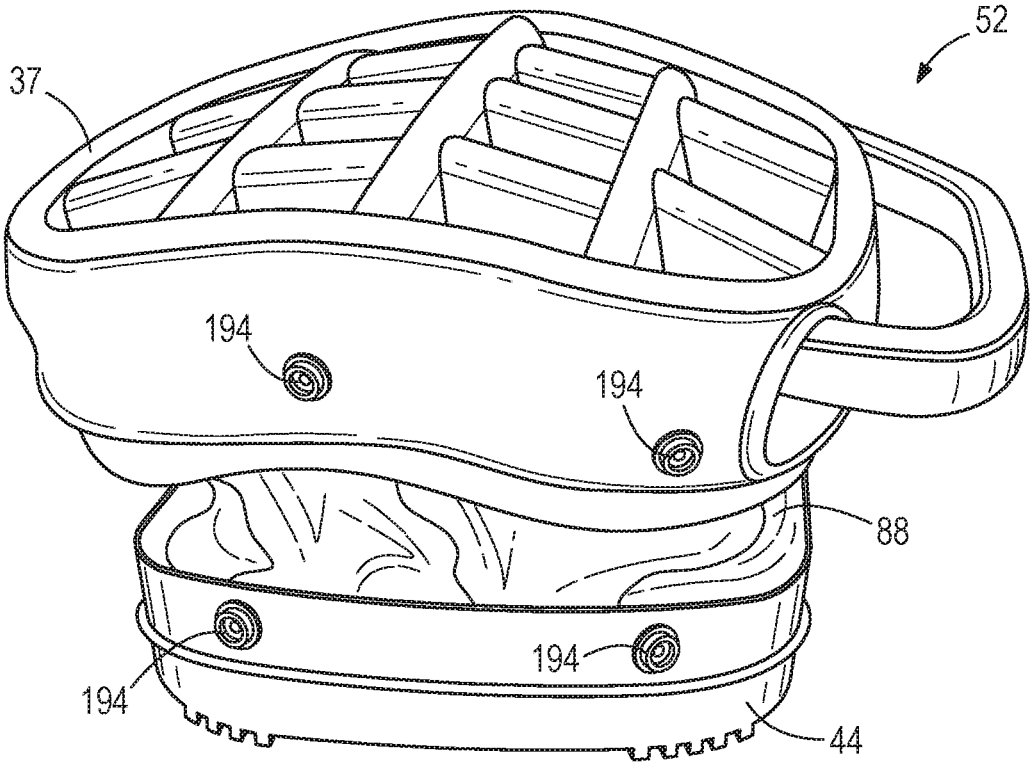
FIG. 47 is a perspective view of an embodiment of a sub-assembly for a golf bag in a collapsed configuration.

Referring to FIG. 47, the sub-assembly 52 is provided in a collapsed configuration, which is the configuration the sub-assembly 52 is in when shipped for assembly. In the illustrated collapsed configuration, the divider top 37 and the base 44 are interconnected by the divider sleeve 88, with the divider top 37 and base 44 being offset and in an approximate parallel orientation to each other. Both the divider top 37 and the base 44 have a plurality of snap-fit connectors 194 that connect to the snap-fit connectors 190 on the flat 14. In other embodiments of the sub-assembly 52, such as the sub-assembly 42 illustrated in FIG. 3 for a stand golf bag 10, the collapsed configuration has the divider top 30 and the base 34 interconnected by the stay 39, with the divider top 30 and the base 34 offset from and approximately parallel to the stay 39.

Figure 48:
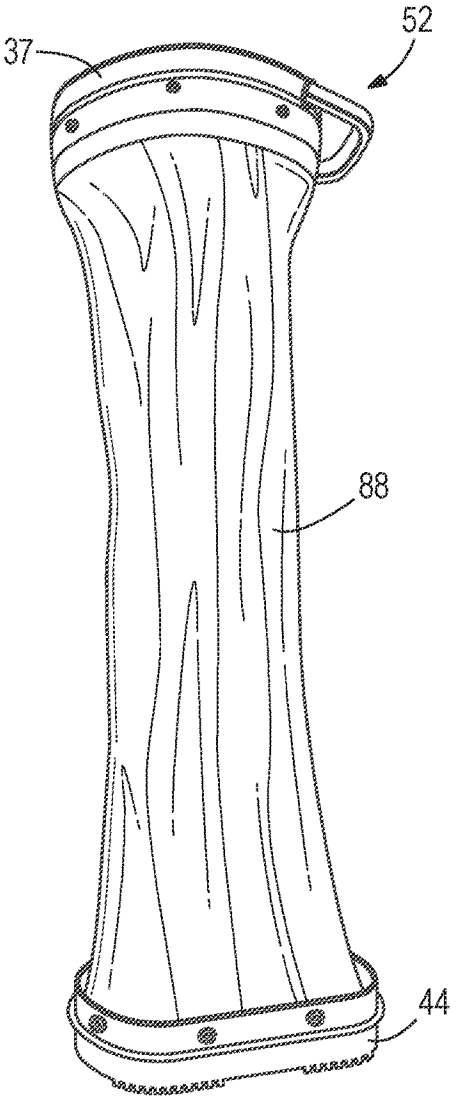
FIG. 48 is a perspective view of the sub-assembly of FIG. 47 in an extended configuration.

Next, as illustrated in FIG. 48, the sub-assembly 52 is extended or otherwise transitioned to an extended configuration. In the illustrated extended configuration, the divider top 37 is drawn in a direction opposite the base 44, extending the divider sleeve 88. In the extended configuration, the sub-assembly 52 is prepared for snap-fit attachment with the flat 14. In some constructions, one or more stays 39 may be inserted into the sub-assembly 52 of the flat 14 to provide additional rigidity and support for the golf bag 10. In other embodiments of the sub-assembly 52, such as the sub-assembly 42 illustrated in FIG. 3 for a stand golf bag 10, the sub-assembly 42 is transitioned to the extended position by pivoting the divider top 30 and the base 34 about the respective stay hinge 162, 170 such that both the divider top 30 and the base 34 are approximately perpendicular or orthogonal to the stay 39 (as shown in FIG. 22). The stand bag sub-assembly 42 has additional assembly steps before snap-fit installation of the flat 14. The leg mounting bracket 32 is attached to the divider top 30 by snap-fit connection (as illustrated in FIGS. 2 and 13-15 and previously described). The spring 41 is also installed into the base 34 (see FIG. 2), and the divider sleeve 46 is attached to the divider top 30 and the base 34 (see FIGS. 2-10). The additional assembly steps for the stand bag sub-assembly 42 are provided for purposes of illustration, and are not limited to the order in which each step is disclosed.

Figure 49:
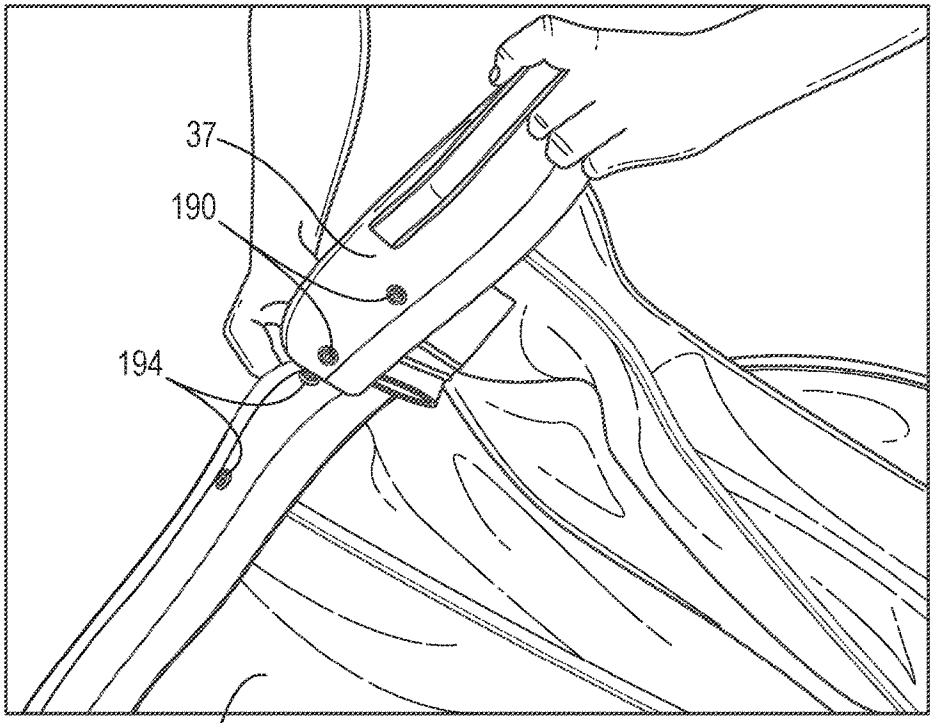
FIG. 49 is a perspective view of the sub-assembly of FIG. 47, illustrating an end of the flat being placed in snap-fit connection with the divider top.

Next, as shown in FIG. 49, the flat 14 is snap-fit connected to the divider top 37. The flat 14 is positioned into a desired or necessary orientation with the sub-assembly 52 (such as proper positioning of the straps 24 in relation to the divider top 37 and base 44). Each of the plurality of snap-fit connectors 190 on the flat 14 is then placed into snap-fit engagement with a respective one of the plurality of snap-fit connectors 194 on the divider top 37. In the illustrated embodiment, each male or female snap-fit button 190 engages an associated female or male snap-fit button 194. The flat 14 wraps around the outer perimeter of the divider top 37 as the snap-fit connectors 190, 194 are placed in snap-fit engagement. In other embodiments of the sub-assembly 52, such as the sub-assembly 42 illustrated in FIG. 2 for the stand golf bag 10 of FIG. 1, the leg anchors 122 of the leg mounting bracket 32 are positioned to extend through openings (not shown) in the flat 14 to expose the leg anchors 122 to the exterior side of the flat 14.

Figure 50:
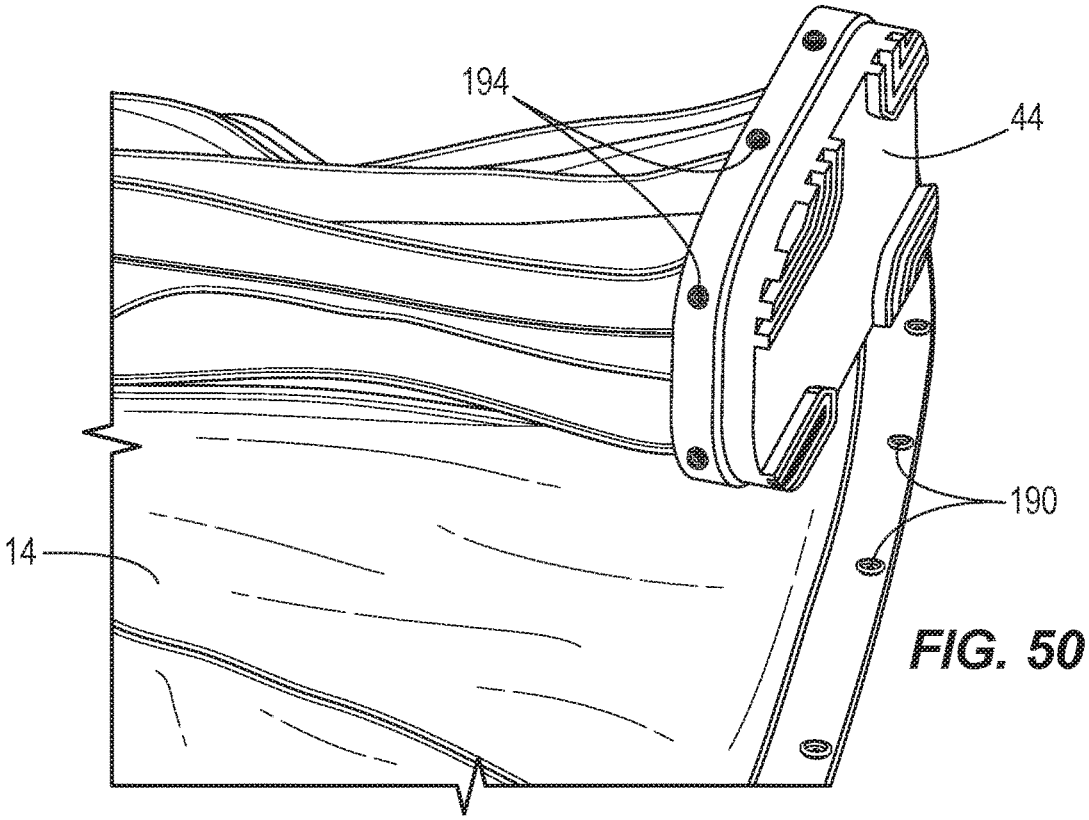
FIG. 50 is a perspective view of the sub-assembly of FIG. 47, illustrating an end of the flat being placed in snap-fit connection with the base.
Figure 51:
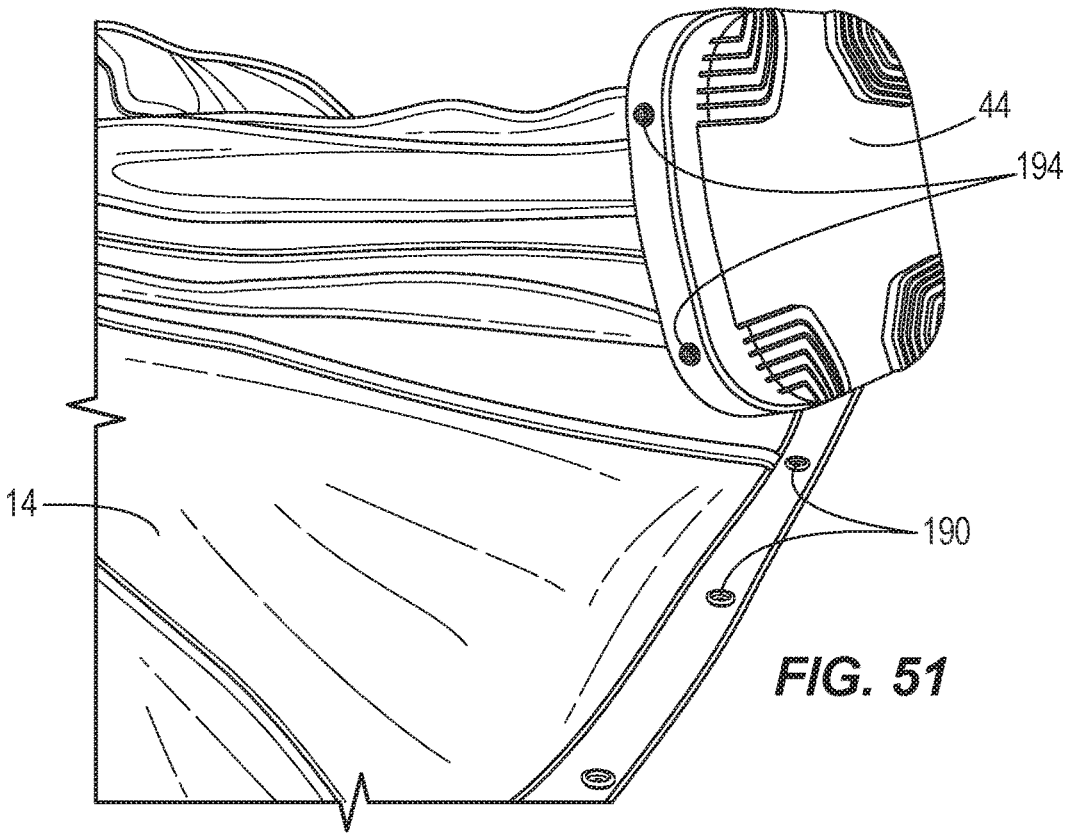
FIG. 51 is a perspective view of the sub-assembly of FIG. 47, illustrating an end of the flat being placed in snap-fit connection with the base and additional snap-fit connections.

As shown in FIGS. 50-51, the flat 14 is then snap-fit connected to the base 44, i.e., each of the plurality of snap-fit connectors 190 on the flat 14 is placed into snap-fit engagement with a respective one of the plurality of snap-fit connectors 194 on the base 44. In the illustrated embodiment, each male or female snap-fit button 190 engages an associated female or male snap-fit button 194. The flat 14 wraps around the outer perimeter of the base 44 as the snap-fit connectors 190, 194 are placed in snap-fit engagement.

Figure 52:
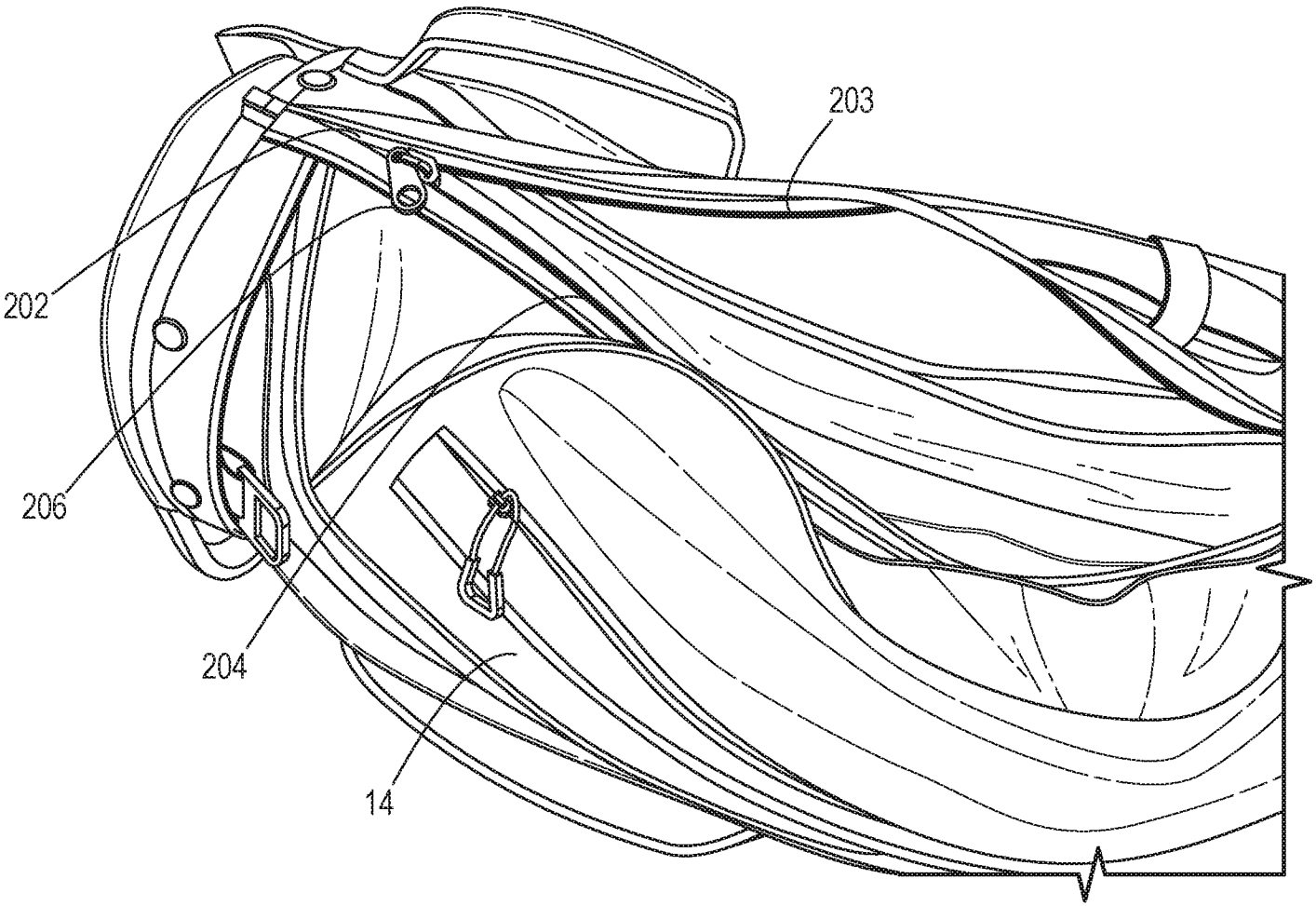
FIG. 52 is a perspective view of the sub-assembly of FIG. 47, illustrating the flat in snap-fit connection with both the divider top and the base, and a seam of the flat being sealed.

Once the flat 14 is placed in snap-fit connection with the divider top 37 and the base 44, the seam 202 of the flat 14 is sealed to complete the snap-fit connection. As shown in FIG. 52, the seam 202 is sealed by closure of a connecting member 206 along the seam edges 203, 204. The connecting member 206 is illustrated as a single zipper 206, however in other embodiments the connecting member 206 may be two zippers, a hook and loop fastener (VELCRO®), mounting tracks with a tongue that fits within associated rails, snap fit buttons, or any other suitable snap-fit fastener or securing assembly, as previously described. As discussed above, the pockets 18 may also be removed and/or adjusted by any previously described snap-fit fastener to allow for custom configuration or reconfiguration of different pocket 18 sizes, number, or locations on the flat 14. In other embodiments of the sub-assembly 52, such as the sub-assembly 42 illustrated in FIG. 2 for the stand golf bag 10 of FIG. 1, the legs 40 are attached by snap-fit and pivotal connection of each end cap 146 with the respective leg anchor 122 of the leg mounting bracket 32. Once the legs 39 are attached, the spring 41 is respectively coupled to each leg 40*a, b* (see FIG. 2).

Figure 53:
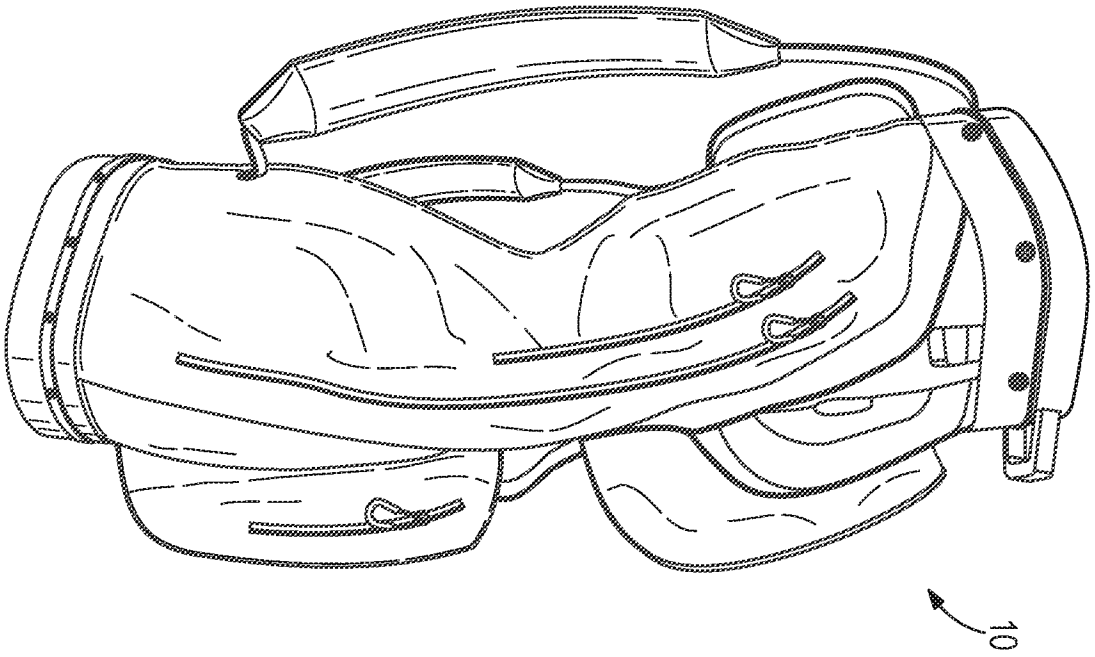
FIG. 53 is a perspective view of the assembled snap-fit golf bag.

After installation of all sub-assembly 52 components, attachment of the flat 14 to the sub-assembly 52, and sealing of the flat 14 seam 202, the golf bag 10 is assembled (shown in FIG. 53).

Referring now to FIGS. 54-72, a self-assembly kit 400 (shown in FIG. 57) for a collapsible golf bag 10 is illustrated. The kit 400 includes the golf bag 10 and a self-assembly system 700 that allows a recipient to assemble the golf bag 10 upon receipt.

Figure 54:
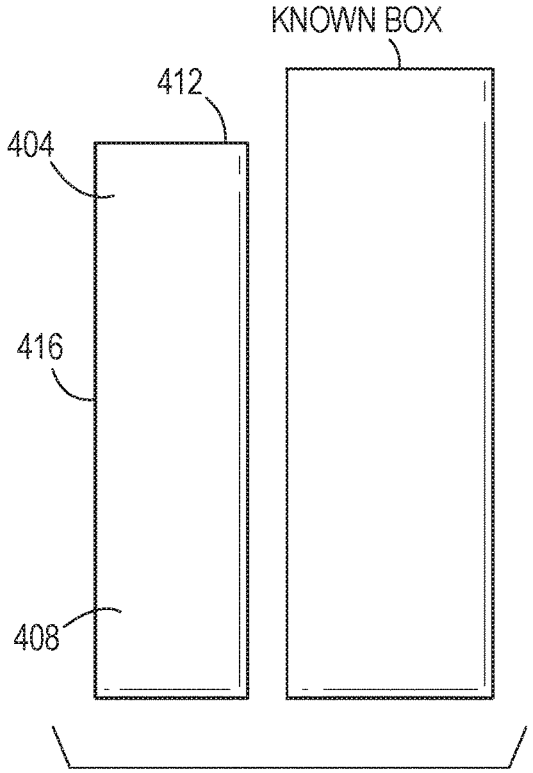
FIG. 54 is an elevation view of a top face of a box for use in shipping a disassembled golf bag and associated self-assembly system, the box positioned next to a larger known box showing the top face and that is used for shipping an assembled golf bag.
Figure 55:
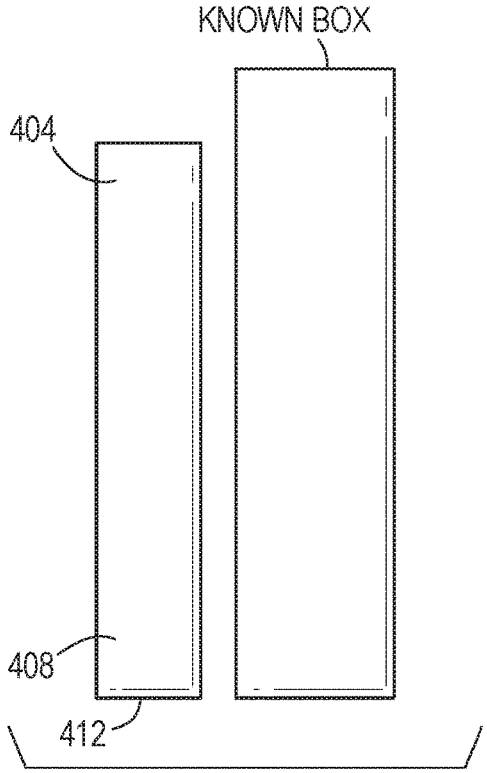
FIG. 55 is an elevation view of a side face of the box of FIG. 54, the box positioned next to a larger known box showing the side face and that is used for shipping an assembled golf bag.

As illustrated in FIGS. 54-55, the self-assembly kit 400 includes a box or container or shipping package 404 that is used to ship the golf bag 10 in a partially assembled state. The box 404 includes a top or face side 408 that can be integrally formed with a flap or flap portion 412. The face side 408 is connected to a portion of the box 404, and more specifically to a side of the box, by a fold 416. The face side 408 defines a portion of the outer surface of the box 404, while also providing access to the interior of the box 404 by pivoting about the fold 416. The flap portion 412 defines an engagement surface to facilitate closure of the box 404. The engagement surface can include one or more tabs (not shown) that can be received by a respective slot 418 (shown in FIG. 57) that is defined by a portion of the box 404 separate from the face side 408 and the flap 412 (e.g., the slots can be defined by one or more sides of the box 404, etc.). It should be appreciated that the tab and slot closure is provided for purposes of a closure illustration, and any closure suitable for engaging the face side 408 and/or the flap portion 412 with a portion of the box 404 may be implemented.

The box 404 of the self-assembly kit 400 is shown in FIGS. 54-55 next to a known box currently used for shipping a fully assembled golf bag. The comparison is illustrative of the reduced size of the box 404 in relation to the known box. More specifically, the box 404 has a volume of approximately 2,040 cubic inches ($in^3$), while the known box has a volume of approximately 5,190 cubic inches ($in^3$). While the volumes of the boxes are approximate, the box 404 has approximately 60% less volume than the known box. The box 404 has a reduced size and a reduced volume over known boxes, with the volume reduction ranging from approximately 15% to approximately 70%, and more specifically from approximately 25% to approximately 65%, and more specifically from approximately 35% to approximately 60%, and more specifically exceeding 50% from known boxes used for shipping assembled golf bags.

Figure 56:
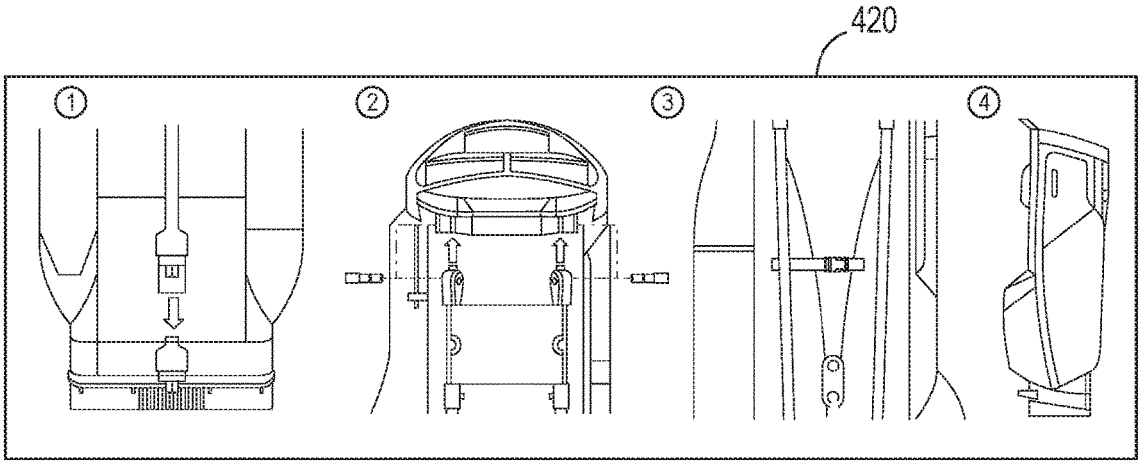
FIG. 56 is an elevation view of indicia printed on a portion of the box of FIG. 54, the indicia illustrated as assembly instructions.

To provide guidance to a recipient with regard to self-assembly of the golf bag 10, the box 404 can include indicia 420. As illustrated in FIG. 56, the indicia 420 include instructions for assembling the golf bag 10. The assembly instructions can include one or more illustrations or detailed figures to provide guidance and/or illustrate each assembly step. In the illustrated embodiment of the box 404, the indicia 420 is printed on the inside of the face side 408 (i.e. when the box 404 is closed, the indicia 420 faces the interior of the box 404) and oriented such that when a recipient pivots the face side 408 about the fold 416 to open the box, the indicia 420 faces the recipient in a readable orientation. While the indicia 420 is disclosed as printed on the box 404, in other embodiments the indicia 420 may be separately included in the box (e.g., as an instruction manual, etc.).

Figure 57:
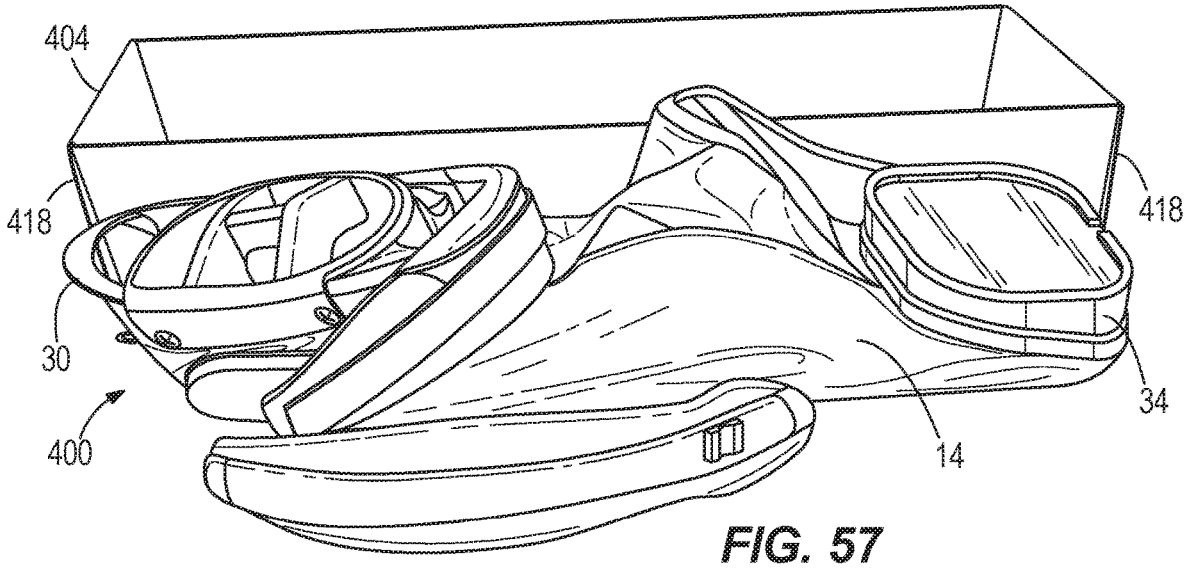
FIG. 57 is a perspective view of a golf bag in a collapsed, partially assembled state as contained during shipment.

FIG. 57 illustrates the golf bag 10 in a first, partially assembled, collapsed state or configuration. The golf bag 10 is shipped in this state in the box 404. In FIG. 57, the golf bag 10 is shown removed from the box 404 and includes the divider top 30, the base 34, and the stay 39 (shown in FIG. 22). The flat 14 is attached to the divider top 30 and to the base 34. The golf bag 10 is collapsed with the divider top 30 and the base 34 each pivoted about the stay 39. In the illustrated embodiment, the divider top 30 and the base 34 are each pivoted towards each other about the stay 39 approximately ninety degrees. In other examples of embodiments, the divider top 30 and the base 34 can each be pivoted about the stay 39 at any angle suitable to collapse the golf bag 10 for shipment in the box 404.

In addition to the collapsible golf bag 10, the kit 400 includes the self-assembly system 500. The self-assembly system 500 includes one or more components of the golf bag 10 assembled by the recipient.

Figure 58:
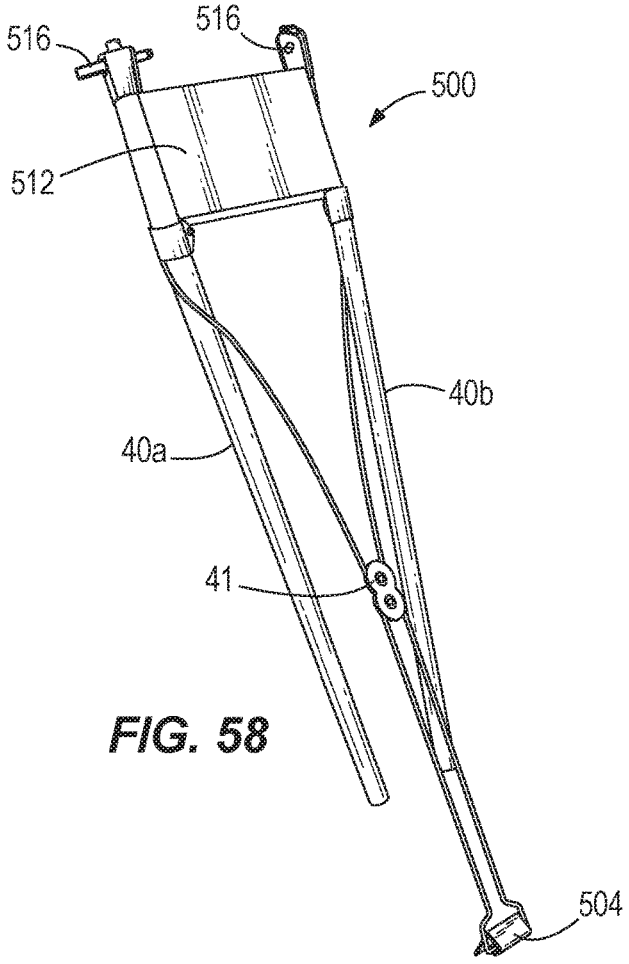
FIG. 58 is a perspective view of an embodiment of a self-assembly system for assembling the golf bag of FIG. 57.

With reference to FIG. 58, a first example of an embodiment of the self-assembly system 500 is illustrated. The illustrated system 500 can include a spring self-assembly system 501 (shown in FIG. 59) and a leg self-assembly system 502 (shown in FIG. 61). The system 500 in FIG. 58 includes a portion of the stand assembly 26, and more specifically the legs 40*a, b* and the attached spring 41. The spring 41 includes a connector 504 having a base engaging hook 508 (shown in FIG. 59). The system 500 also includes an alignment aid 512 that assists a recipient with aligning the legs 40*a, b* with the mounting bracket 32 (shown in FIG. 66) for attachment. The system 500 further includes rod pins or pins 516 for pivotably attaching the legs 40*a, b* to the mounting bracket 32.

Figure 59:
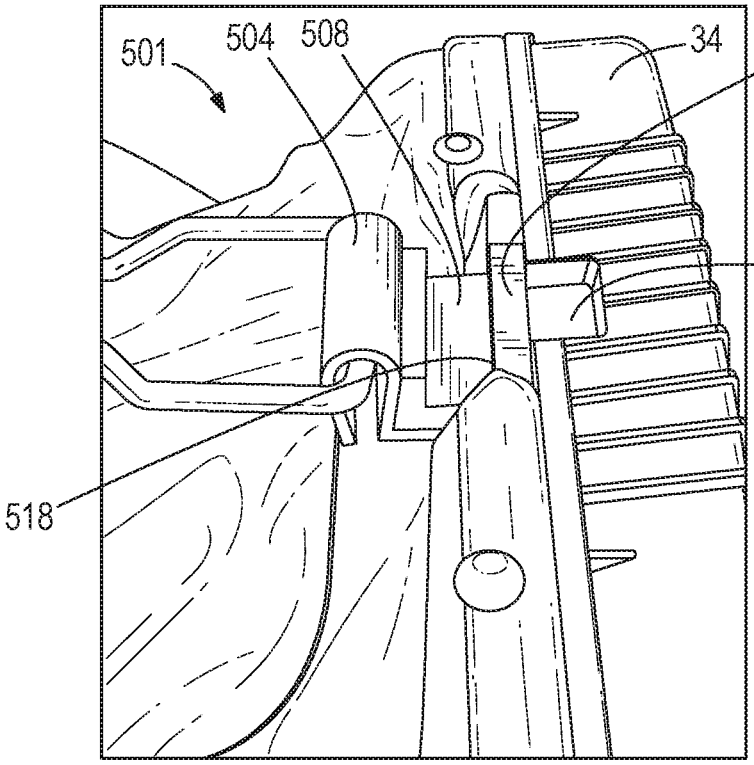
FIG. 59 is a perspective view of a connector for a stand assembly spring, and a portion of the base that engages the connector to facilitate self-assembly.
Figure 60:
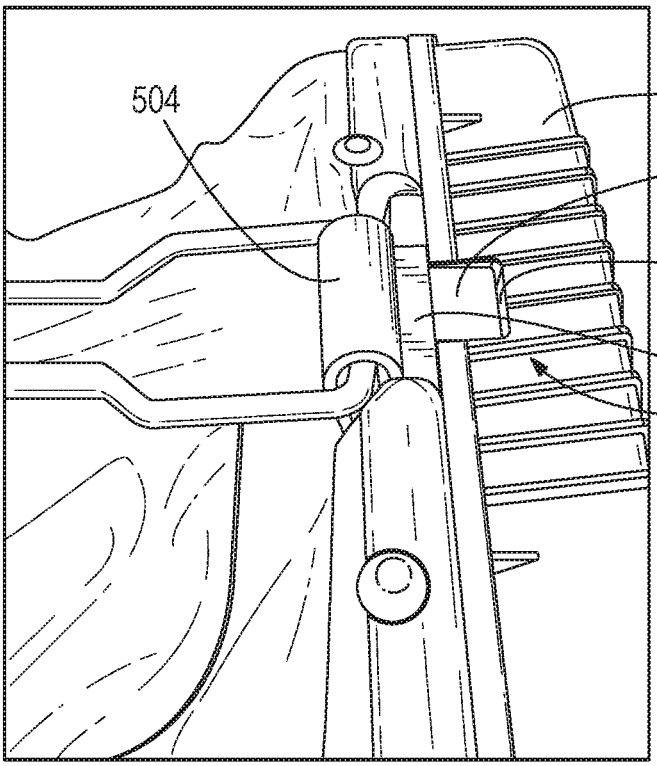
FIG. 60 is a perspective view of the connector of FIG. 59 shown engaging the base after self-assembly.

FIGS. 59-60 further illustrate the spring self-assembly system 501. The system 501 includes the connector 504 that facilitates self-assembly of the spring 41 and the base 34. With reference to FIG. 59, the base engaging hook 508 on the connector 504 includes a channel or hook portion (not shown) configured to receive or otherwise engage a portion of the base 34. In the illustrated embodiment, the base 34 defines a spring receiving slot or channel similar to channel 174 (shown in FIG. 25). The channel receives or engages with a portion of the connector 504. An aperture or window 520 is defined by a portion of the base 34, and more specifically a portion of the spring receiving slot 518 in the base 34. A portion of the perimeter of the aperture 520 is defined by a member or cross-member 524 configured to be received within a gap or slot of the connector 504. To facilitate self-assembly, the recipient positions the connector 504 in the spring receiving slot 518. The recipient then engages the connector 504 with the base 34, allowing the base engaging hook 508 to receive the member 524. Once received, the base engaging hook 508 is received by the aperture 520, which is shown in FIG. 60. This forms the self-assembly connection between the connector 504 and the base 34, and more broadly between the spring 41 and the base 34. It should be appreciated that the self-assembly connection can be removable to allow disengagement or withdrawal of the connector 504 from the base 34. For example, the connection can be removed in order to replace a damaged portion of the stand assembly 26 (e.g., a broken leg 40, a broken spring 41, etc.) by a replacement self-assembly system 500.

Figure 61:
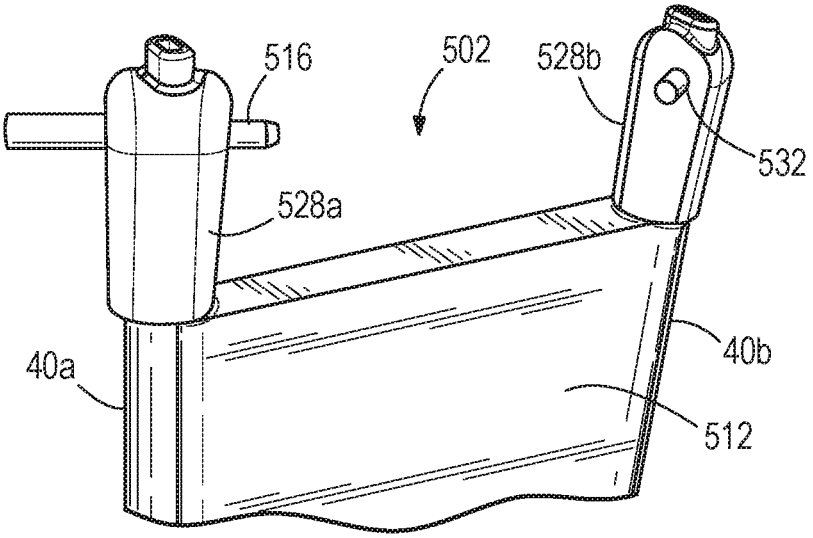
FIG. 61 is a perspective view of a portion of a leg self-assembly system, specifically end caps connected to respective legs and having removable pins for connecting the legs to a mounting bracket of the golf bag of FIG. 57.
Figure 62:
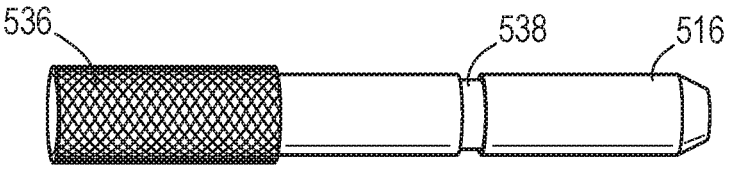
FIG. 62 is an elevation view of a pin illustrated in FIG. 61.

FIGS. 61-67 illustrate the leg self-assembly system 502. With reference to FIG. 61, the system 502 includes end caps 528*a, b* connected to each respective leg 40*a, b*. Each end cap 528 includes an aperture or pin aperture 532 configured to receive a pins 516. As shown in FIG. 62, each pin 516 includes an end or portion having a surface texture or roughness 536 to assist with grasping the pin 516 during removal and/or installation. The portion having the surface texture 536 can also have a larger cross sectional diameter than the remainder of the pin 516 to prevent over insertion during installation. Each pin 516 can also include a circumferential groove 538. The groove 538 can optionally receive or engage a projection or member (not shown) in the end cap 528 or mounting bracket 32 (shown in FIG. 66) to provide an indication of proper insertion and/or assist with retaining the pin 516 following self-assembly. In the illustrated embodiment, each pin 516 is positioned in an end cap 528*a, b* either during shipping or when the leg self-assembly system 502 is removed from the box 404. In other embodiments, the pins 516 may be stored or contained in the box 404 in any suitable manner (e.g., contained in packaging within the box 404, such as a sealed plastic bag, etc.).

Figure 63:
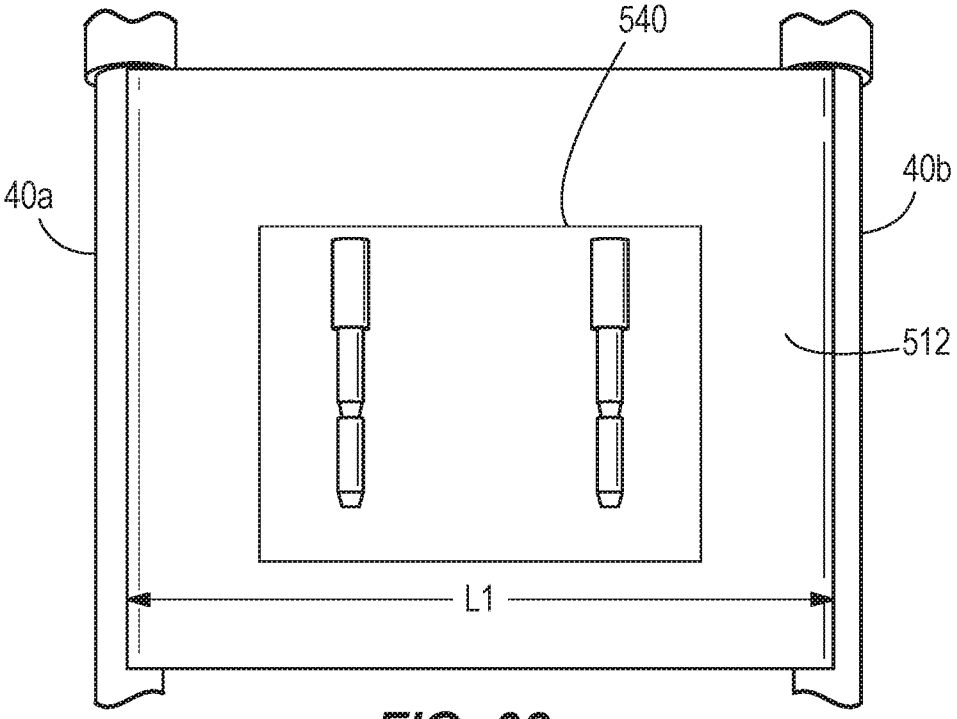
FIG. 63 is an elevation view of an alignment aid removably connected to the legs, along with two removable pins.
Figure 65:
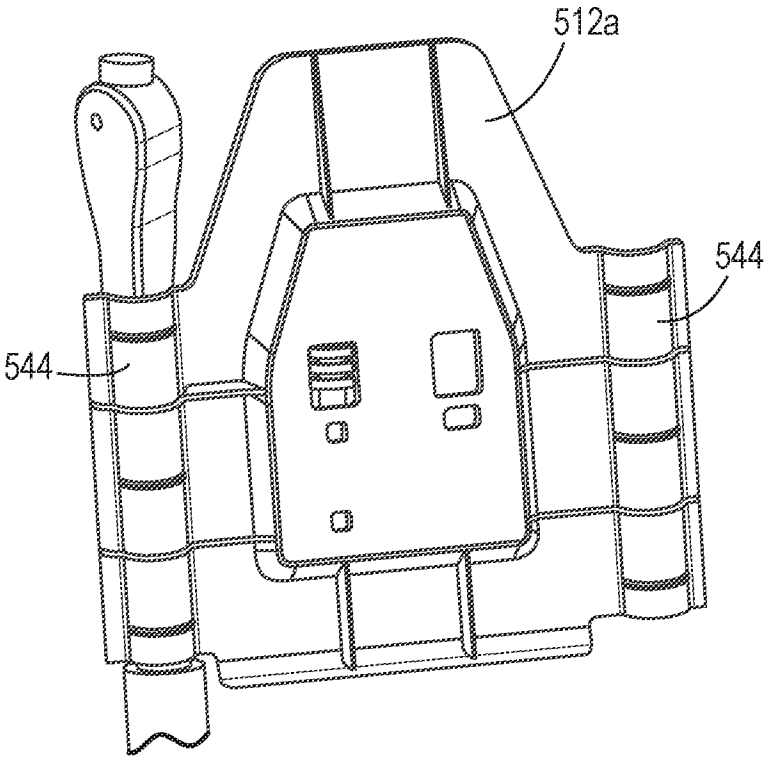
FIG. 65 is a perspective view of a second side of the alignment aid of FIG. 64.
Figure 64:
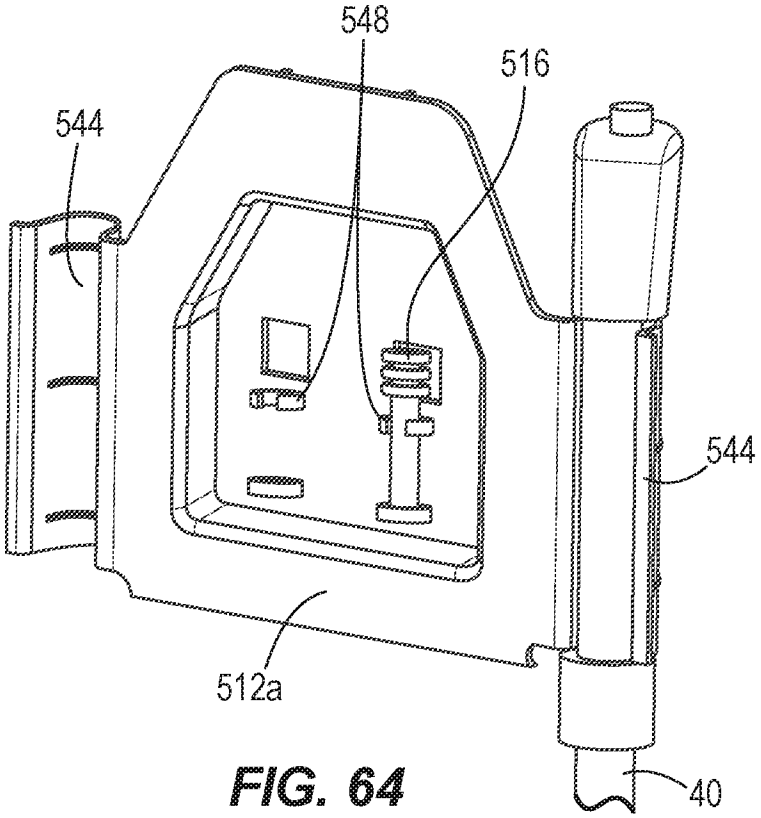
FIG. 64 is a perspective view of a first side of an alternative embodiment of the alignment aid illustrating one leg attached and one pin attached for purposes of illustration.

FIG. 63 illustrates the alignment aid 512 connected to the legs 40*a, b*. The alignment aid 512 has a length $L_1$ that, when attached to the legs 40*a, b*, positions the legs 40*a, b* a predetermined distance apart to facilitate engagement with the mounting bracket 32 (shown in FIG. 66). After installation of the legs 40*a, b* with the mounting bracket 32, the alignment aid 512 is removed from the legs 40*a, b*. To inform the recipient of the intended removal after installation, the alignment aid 512 can include a second indicia or instructions 540 directing the recipient to remove the alignment aid 512 after self-assembly. In the illustrated embodiment, the alignment aid 512 is constructed of paper or cardboard and removably attached to the legs 40*a, b* by an adhesive tape. In other embodiments, the alignment aid 512 can be any suitable structure or formed of any suitable material that facilitates alignment of the legs 40*a, b* with the mounting bracket 32. For example, FIGS. 64-65 illustrate an alternative embodiment of the alignment aid 512*a*. The alignment aid 512*a* includes a pair of arcuate leg supporting channels 544 that each carry a respective leg 40 (e.g., legs 40*a, b*) by an interference or friction fit. The alignment aid 512*a* can also include one or more pin supporting channels or prongs 548 that each retain a respective pin 516. The alignment aid 512*a* forms snap-fit connections with the legs 40 and pins 516, facilitating organized storage of the legs 40 and pins 516 during shipping, and easy removal of the legs 40 and pins 516 during (and following) assembly. The illustrated alignment aid 512*a* is formed of plastic, but in other embodiments may be constructed of any suitable material.

Figure 66:
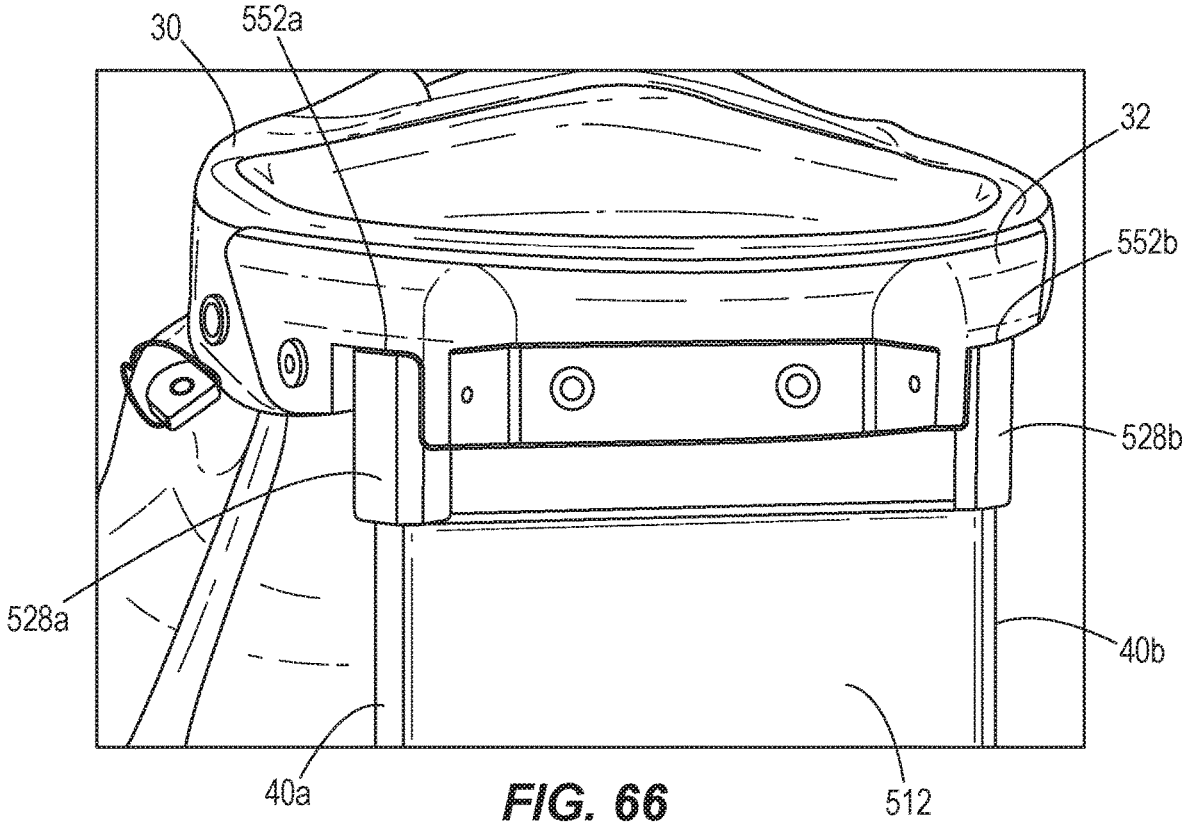
FIG. 66 is a perspective view of a portion of the leg self-assembly system of FIG. 58, the leg self-assembly system aligned with and received by the golf bag mounting bracket during assembly.

Now referring to FIG. 66, the alignment aid 512 is illustrated during assembly of the legs 40*a, b* to the mounting bracket 32 on the divider top 30. The mounting bracket 32 defines mounting channels 552*a, b* configured to receive a corresponding leg 40*a, b* by the end cap 528*a, b*. The length $L_1$ (shown in FIG. 63) of the alignment aid 512 is such that the distance between the end caps 528*a, b* matches the distance between the mounting channels 552*a, b*. This allows the recipient to easily and simply align and insert the end caps 528*a, b* into the mounting channels 552*a, b*.

Each channel 552*a, b* also includes opposing apertures (not shown) on sides of the channel 552*a, b*. The opposing apertures align with the pin aperture 532 (shown in FIG. 61) through each end cap 528*a, b* when the end cap 528*a, b* is received by the respective channel 552*a, b*. When in alignment, the pin 516 can be inserted by the recipient to connect and retain the legs 40*a, b* to the mounting bracket 32. The alignment aid 512 assists with aligning the opposing apertures (not shown) with the pin aperture 532 (shown in FIG. 61) to facilitate insertion of the pin 516 by the recipient. In addition to connecting the legs 40*a, b* to the mounting bracket 32, each pin 516 defines a pivot axis about which the legs 40*a, b* pivot in relation to the mounting bracket 32 (e.g., to facilitate pivoting of the legs 40*a, b* between the first configuration where the stand assembly 26 is retracted, and the second configuration where the stand assembly 26 is extended).

Figure 67:
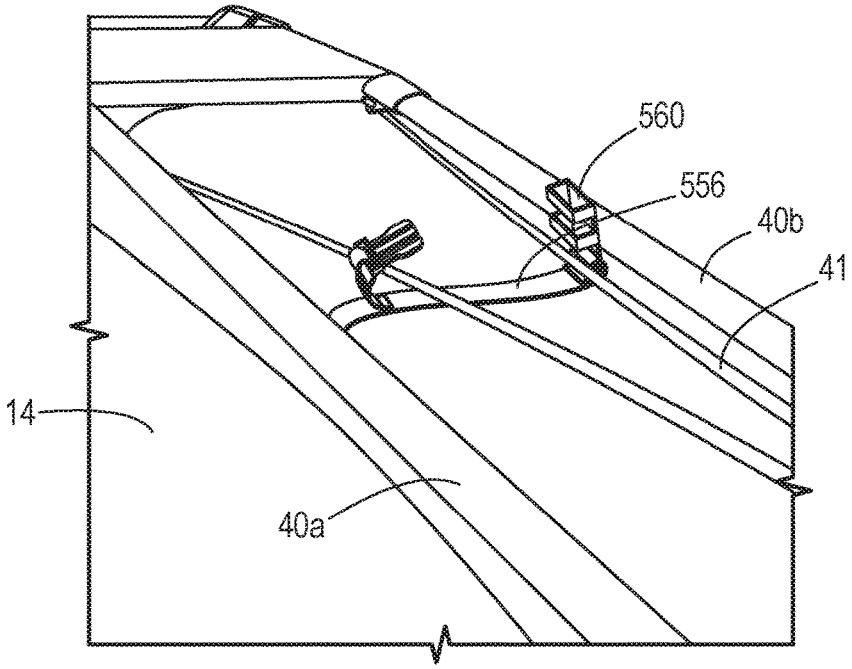
FIG. 67 is a perspective view of a portion of the golf bag of FIG. 57 illustrating a strap surrounding a portion of the spring and in an unlatched configuration.
Figure 69:
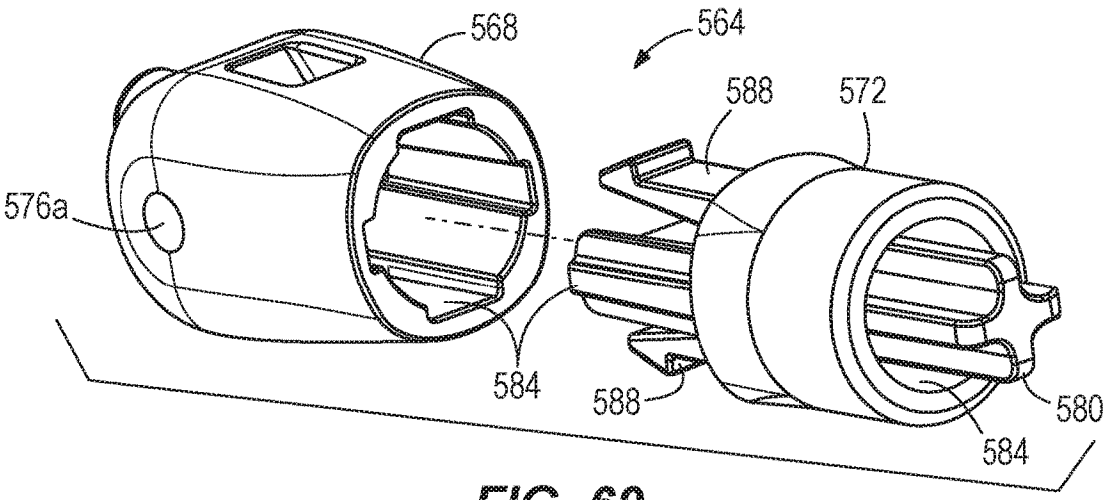
FIG. 69 is a perspective view of a first side of the multi-component end cap of FIG. 68 showing a first piece separated from a second piece.
Figure 70:
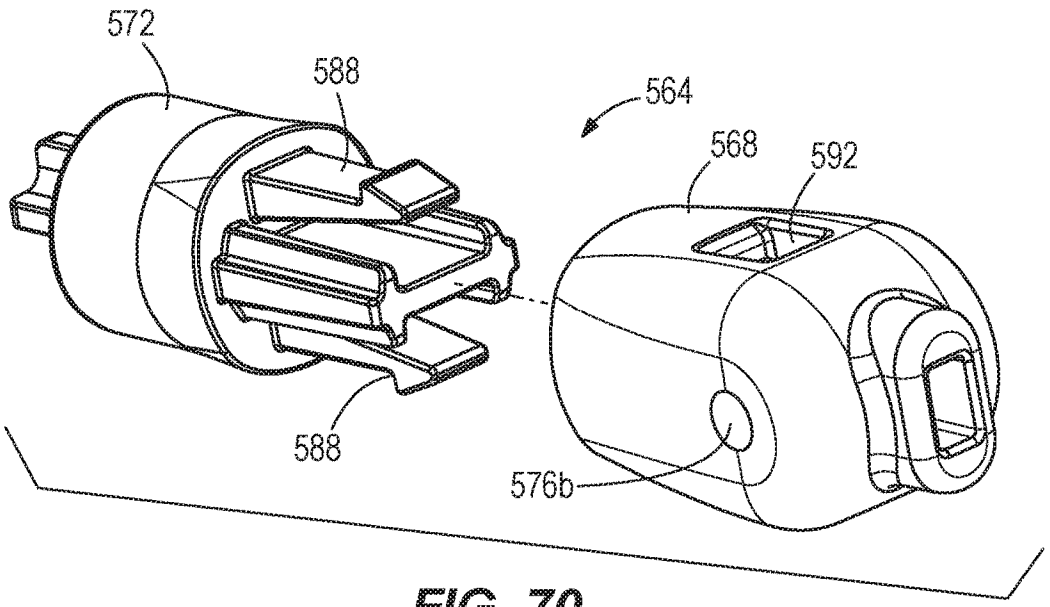
FIG. 70 is a perspective view of a second side of the multi-component end cap of FIG. 69.
Figure 68:
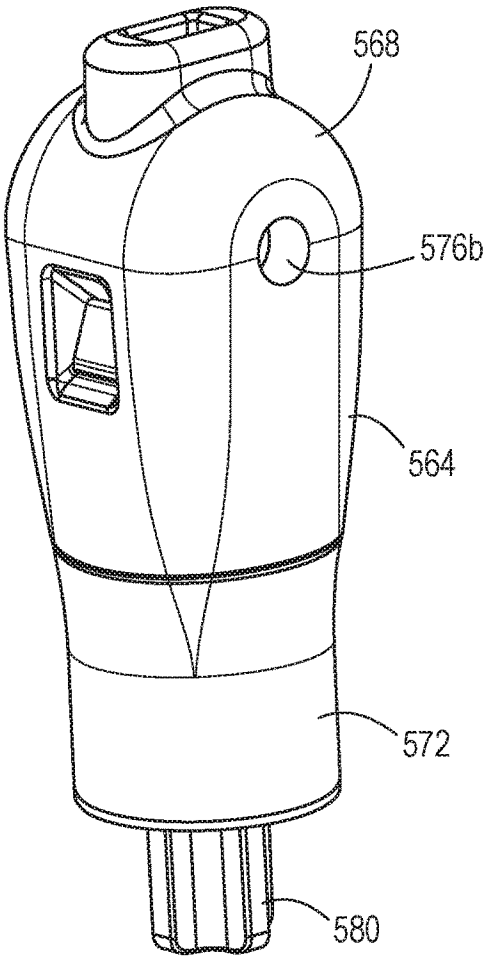
FIG. 68 is a perspective view of a multi-component end cap for use with the leg self-assembly system of FIG. 58.
Figure 72:
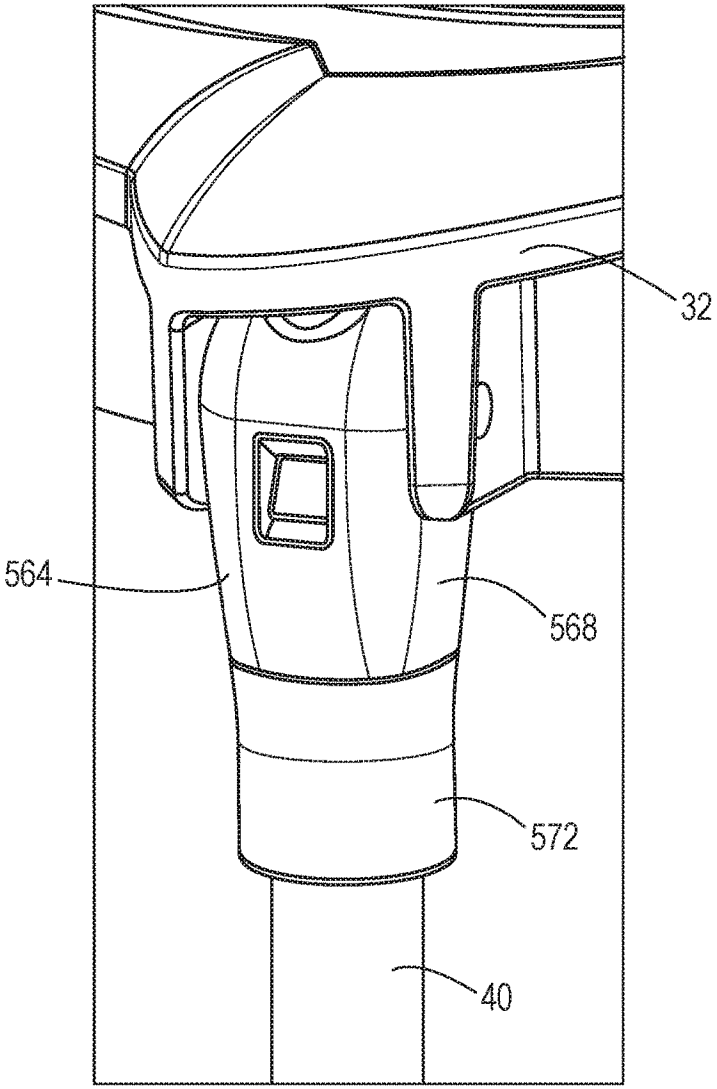
FIG. 72 is a perspective view of the multi-component end cap of FIG. 68, illustrating the completed self-assembly of the leg attached to the mounting bracket.
Figure 71:
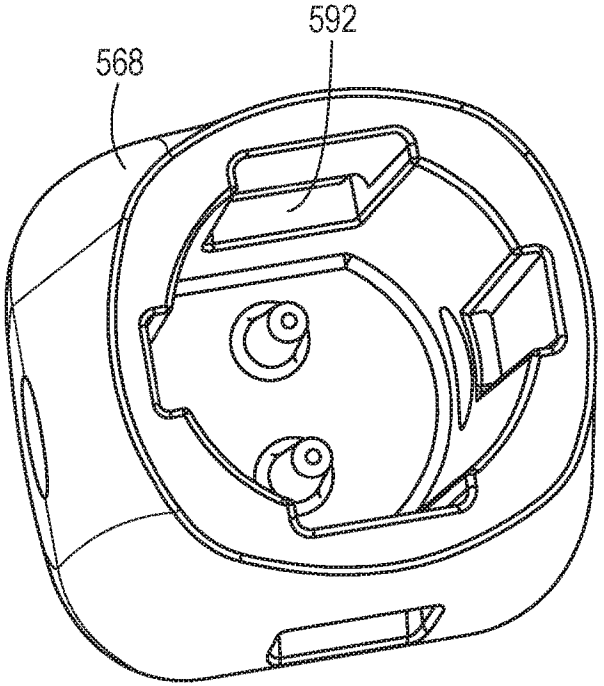
FIG. 71 is a perspective view of the first piece of the multi-component end cap of FIG. 69, illustrating an interior having a detent for retaining the second piece.

Following assembly of the legs 40*a, b* to the mounting bracket 32, the recipient can attach a strap 556 around a portion of the spring 41. As illustrated in FIG. 67, the strap or gravity strap 556 is attached to the flat 14 of the golf bag 10 and includes a latch assembly or buckle 560 to facilitate self-attachment of the strap 556. The length of the strap 556 can be adjusted based on user preference. By extending the strap 556 around the spring 41, the strap 556 assists with constraining the legs 40*a, b*, by the spring 41, when the golf bag 10 is carried by a user (e.g., a user is carrying the golf bag 10 by shoulder straps 24). This constraint assists with limiting the legs 40*a, b* from hanging or extending away from the golf bag 10 (i.e. the constraint assists with maintaining the legs 40*a, b* in the first, retracted configuration when the golf bag 10 is carried).

Referring now to FIGS. 68-72, an alternative embodiment of the end cap 528 for use with the leg self-assembly system 502 is illustrated. In this embodiment, the end cap 528 is a multi-component end cap 564 that interconnects by a snap-fit. By using the end cap 564, the leg self-assembly system 502 eliminates the need for the pins 516.

FIGS. 68-72 illustrate an embodiment of the multi-component end cap 564. The end cap 564 includes a first piece or first portion 568 and a second piece or second portion 572. When used in the leg self-assembly system 502, the first piece 568 is pre-attached to the mounting bracket 32, for example by opposing apertures 576*a, b* that define a pivot axis to allow the legs 40 to extend between the first and second configurations. The second piece 572 is pre-attached to each leg 40, for example each leg 40 can receive a projection 580 that extends from the second piece 572. Further, each leg 40 can be partially received by a recess 584 defined by the second piece 572. While the projection 580 is illustrated as having a cross sectional shape of a cross or plus-sign, in other embodiments the projection 580 can have any suitable shape to facilitate engagement with a leg 40. In addition, while the illustrated embodiment of the second piece 572 provides a friction or interference fit with a leg 40, any suitable connection or engagement sufficient to retain each leg 40 with each second piece 572 may be used.

To attach each leg 40 to the mounting bracket 32 during self-assembly, the recipient connects the second piece 572 to the first piece 568. To facilitate the connection, the multi-component end cap 564 includes a snap fit assembly 584 (shown in FIG. 69). In the illustrated embodiment, the second piece 572 includes at least one flexible catch 588 (shown in FIGS. 69-70) sized to engage and be retained by associated detents 592 positioned within the first piece 568 (shown in FIGS. 70-71). Once the first piece 568 and the second piece 572 are attached by the snap fit assembly 584, the legs 40 are attached to the mounting bracket 32 (see FIG. 72).

Figure 75:
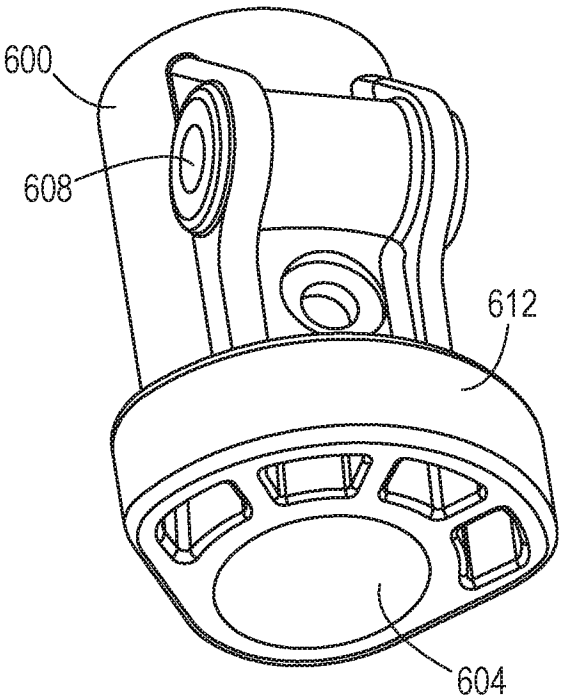
FIG. 75 is a second perspective view of the bracket of FIG. 73.
Figure 74:
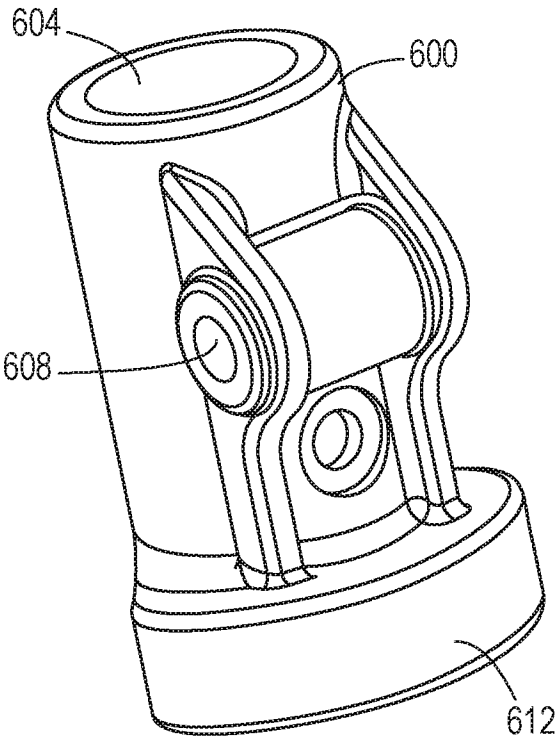
FIG. 74 is a first perspective view of the bracket of FIG. 73.
Figure 73:
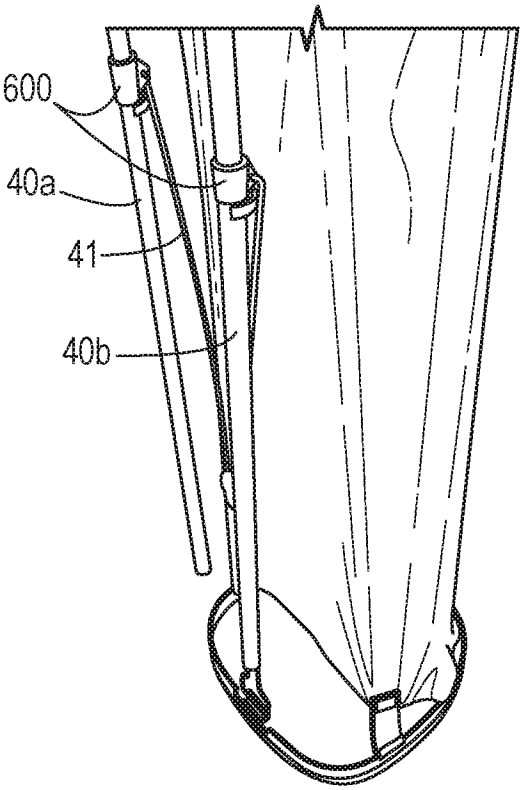
FIG. 73 is a perspective view of a portion of the golf bag of FIG. 57 illustrating a bracket connecting the spring to each leg.

FIGS. 73-75 illustrate an example of an embodiment of a bracket 600 that attaches the spring 41 to each leg 40*a, b*. The bracket 600 includes a leg receiving channel 604 configured to receive the leg 40*a* or 40*b*, facilitating mounting of a bracket 600 on each respective leg 40*a, b*. The bracket 600 also includes a spring receiving channel 608 configured to receive a portion of the spring 41, attaching the spring 41 to each leg 40*a, b*. In the illustrated embodiment, the spring receiving channel 608 is offset from and approximately perpendicular to the leg receiving channel 604. The bracket 600 includes an arcuate projection or bumper 612 on an outer surface of the bracket 600. As shown in FIG. 36, the bumper 612 separates the legs 40*a, b* from the spring 41, and more specifically allows the legs 40*a, b* to be offset from the spring 41 and the flat 14 (not shown in FIG. 73, but shown in FIG. 1). By positioning the legs 40*a, b* as offset from the spring 41 by the bumper 612 on each bracket 600, the legs 40*a, b* do not become entangled with the spring 41 during deployment of the legs 40*a, b* from the first configuration (where the stand assembly 26 is retracted) to the second configuration (where the stand assembly 26 is extended).

Figure 76:
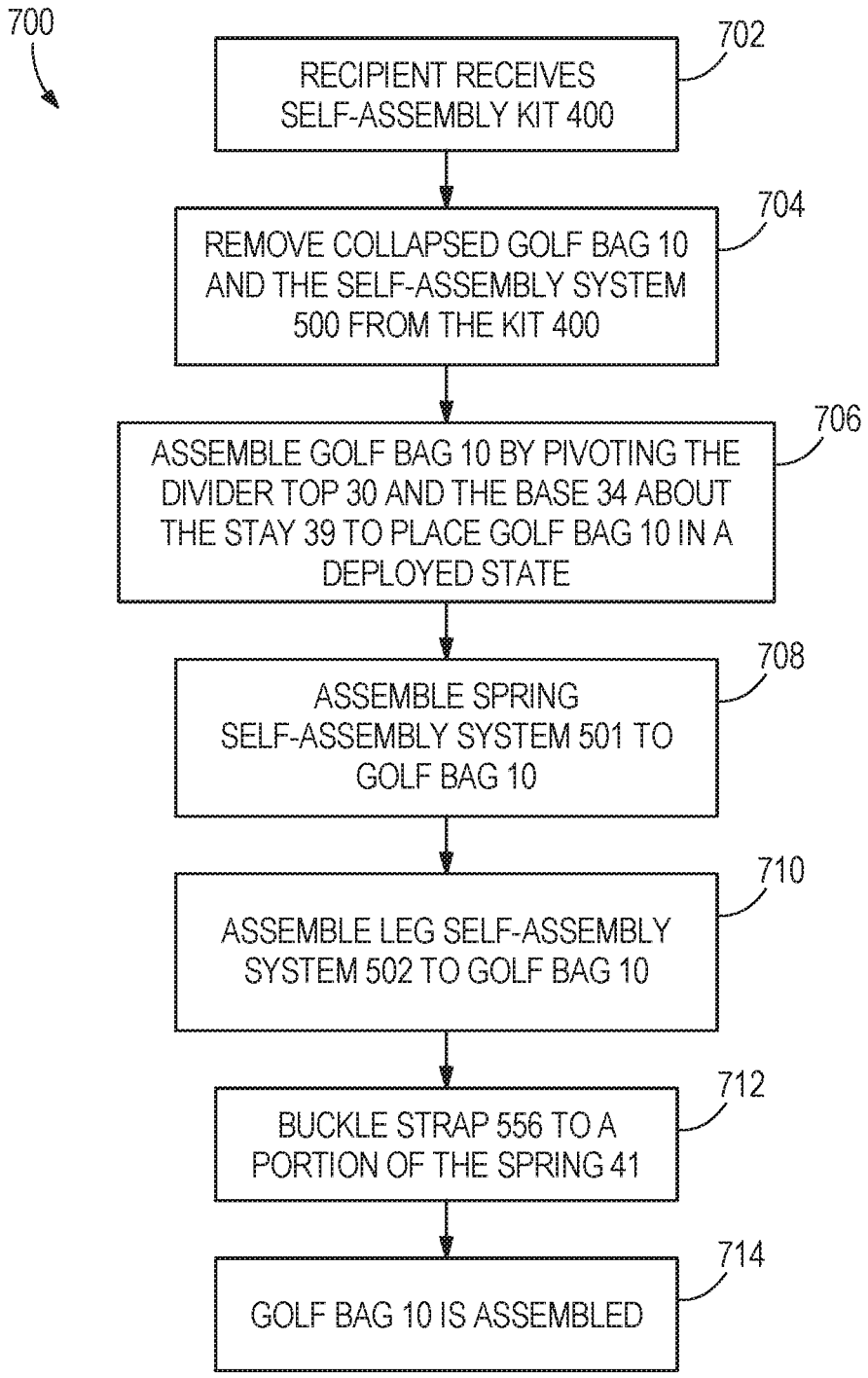
FIG. 76 is a schematic diagram of a method of assembling the collapsed, partially assembled golf bag of FIG. 57.

FIG. 76 illustrates an example of a method of self-assembling a golf bag 700 by the self-assembly system 500. The method includes a series of assembly steps that are executed by a recipient, the steps being depicted in flow diagram form. It should be appreciated that the method steps are provided as an example, and the method 700 may include fewer than all of the disclosed steps. The method 700 begins at step 702, where the recipient receives the self-assembly kit 400. The self-assembly kit 400 includes the collapsible golf bag 10 and the self-assembly system 500. The self-assembly kit 400 can be delivered to the recipient by the box 404.

Next, at step 704, the recipient removes the golf bag 10 (in its collapsed form) and the self-assembly system 500 from the self-assembly kit 400. For example, the recipient removes the golf bag 10 out of the box 404. The recipient can also orient the indicia 420 (or instructions for assembling) in a readable orientation.

At step 706 the recipient pivots the divider top 30 about the stay 39 (by the top stay hinge 162), and the base 34 about the stay 39 (by the base stay hinge 170). This converts the golf bag 10 from the collapsed state to a deployed state.

At step 708, the recipient assembles the spring self-assembly system 501 to the golf bag 10. More specifically, the recipient connects the spring connector 504 to the base 34 (e.g., by positioning the base engaging hook 508 within the aperture 520 and concurrently having the channel defined by the hook 508 receive the member 524).

Next at step 710, the recipient assembles the leg self-assembly system 502 to the golf bag 10.

For example, in the embodiment illustrated in FIGS. 61-66, the recipient removes each pin 516 from the respective end cap 528*a, b* (or alignment aid 512*a*). The recipient then aligns each end cap 528*a, b* with the respective mounting channels 552*a, b* of the mounting bracket 32. This alignment is facilitated (or streamlined) by the alignment aid 512, 512*a*. Once aligned, the recipient inserts each pin 516 through the opposing apertures (not shown) on the sides of the channel 552*a, b* and the pin aperture 532 through the end cap 528*a, b*. The recipient then removes the alignment aid 512, 512*a* from the legs 40*a, b*.

Alternatively, in the embodiment illustrated in FIGS. 68-72, the recipient connects the second piece 572 of the multi-component end cap 564 (which is attached to each leg 40*a, b*) to the respective first piece 568 (which is attached to the mounting bracket 32 in the respective mounting channels 552*a, b*). The first and second pieces 568, 572 snap fit together by the snap fit assembly 584 to connect the legs 40*a, b* to the mounting bracket 32.

At step 712, the recipient buckles the strap 556 about a portion of the spring 41 to constrain the legs 40*a, b* by the spring 41. At step 714, the process in complete and the recipient has assembled the golf bag 10.

A method of manufacturing the collapsible golf bag 10 includes inserting the sub-assembly 42 into the flat 14, base 34 end first. Once inserted, the sub-assembly 42 is fastened to the flat 14. The stay 39 is inserted through a slit (not shown) in the flat 14 where it is inserted at a first end to the divider top 30 and at a second, opposite end to the base 34. The divider top 30 and the base 34 are then pivoted about the stay 39 into a collapsed configuration. The golf bag 10, in this collapsed configuration, is then placed in the shipping box 404, along with a portion of the stand assembly 26 for user self-assembly. Instructions for self-assembly are included in the shipping box, and more specifically are printed on the shipping box.

The golf bag 10 incorporating the snap-fit components disclosed herein provides advantages over golf bags that are known in the art. Among them, utilizing the snap-fit components provides manufacturers with less machinery and equipment overhead for golf bag assembly. Further, shipping volume of the snap-fit components is reduced by approximately 30% to 50%, providing for more efficient use of package volume during shipping and limiting excess shipping costs due to oversized or bulky components. In addition, the snap-fit components can be assembled by a manufacturer at an assembly facility, or alternatively the components can be direct shipped to an end user for assembly. Further, the snap-fit components provide interchangeable parts, allowing for replacement of worn components and customization by a manufacturer or end user.

The golf bag self-assembly kit 400, which incorporates the collapsible golf bag 10 and the self-assembly system 500 provides advantages over golf bags that are known in the art. Among them, the collapsible golf bag has a reduced shipping box size than pre-assembled golf bags. This leads to a reduction in shipping costs, especially shipping costs based on box size or volume. In addition, less material is used for manufacturing the shipping box, reducing the cost of manufacturing. Further, by shifting assembly of the golf bag to a recipient, the manufacturer does not incur those additional assembly costs. The collapsible golf bag and self-assembly system provides easy assembly by the recipient based on clear assembly instructions, and components that are easily aligned and assembled. These and other advantages are may be realized from one or more embodiments of the golf bag, golf bag self-assembly kit, and golf bag self-assembly system disclosed herein.

Clause 1. A self-assembly kit for a golf bag comprising:

a collapsible golf bag, the collapsible golf bag including a stay pivotably connected at one end to a golf bag divider top and on an opposite end to a golf bag base;

an outer shell; and a self-assembly system for assembling the golf bag from a collapsed state to a deployed state.

Clause 2. The self-assembly kit of clause 1, wherein the self-assembly system includes a spring self-assembly system for assembling a spring to the golf bag base that is configured to bias legs connected to the golf bag.

Clause 3 The self-assembly kit of clause 2, wherein the spring self-assembly system includes a spring having a connector positioned at one end, the connector configured to engage the base to attach the spring to the base.

Clause 4. The self-assembly kit of clause 3, wherein the spring is pivotably connected to a plurality of legs.

Clause 5. The self-assembly kit of clause 4, wherein the plurality of legs are pivotably connected to the divider top.

Clause 6. The self-assembly kit of clause 1, wherein the self-assembly system includes a leg self-assembly system for assembling a plurality of legs to the golf bag base.

Clause 7. The self-assembly kit of clause 6, wherein the leg self-assembly system includes a plurality of legs that are connected to and spaced apart by a leg alignment aid, the plurality of legs configured to engage the divider top.

Clause 8. The self-assembly kit of clause 7, wherein each of the plurality of legs includes an end cap, the end cap carries a removable pin.

Clause 9. The self-assembly kit of clause 8, wherein the removable pin is configured to disengage the end cap before connection of the end cap with the divider top, and then reengage the end cap and the divider top after connection of the end cap with the divider top.

Clause 10. The self-assembly kit of clause 9, wherein the divider top includes a mounting bracket, the mounting bracket defines a plurality of mounting channels configured to receive the end cap of each leg.

Clause 11. The self-assembly kit of clause 10, wherein the removable pin is configured to disengage the end cap before connection of the end cap with the respective mounting channel, and reengage the end cap and the respective mounting channel after connection of the end cap with the mounting bracket.

Clause 12. The self-assembly kit of clause 11, wherein the pin connects each leg to the mounting bracket.

Clause 13. The self-assembly kit of clause 6, wherein the leg self-assembly system includes a plurality of legs, each of the legs includes a first portion of a multi-component end cap configured to connect to a second, mating portion of the multi-component end cap connected to the mounting bracket.

Clause 14. The self-assembly kit of clause 13, wherein the second, mating portion of the multi-component end cap is pivotably connected to the mounting bracket.

Clause 15. The self-assembly kit of clause 13, wherein the first portion and the second portion of the multi-component end cap are configured to connect by a snap fit connection.

Clause 16. The self-assembly kit of clause 1, wherein the divider top is pivotably connected to the stay by a hinge.

Clause 17. The self-assembly kit of clause 16, wherein the hinge includes a hinge limit that limits the pivot distance of the hinge.

Clause 18. The self-assembly kit of clause 17, wherein the hinge limit is configured to restrict the pivot distance to no more than a straight angle formed between the stay and the divider top connected to the hinge.

Clause 19. The self-assembly kit of clause 1, wherein the collapsible golf bag and the self-assembly system are configured to be shipped in a box.

Clause 20. The self-assembly kit of clause 19, wherein the box includes indicia printed on the box providing self-assembly instructions.

Clause 21. The self-assembly kit of clause 20, wherein the indicia include at least one illustration.

Clause 22. A collapsible golf bag comprising:

a divider top pivotably connected to a first end of a stay by a first hinge;

a base pivotably connected to a second end of the stay by a second hinge; and an outer shell connected to the divider top and the base, the outer shell including at least one shoulder strap, wherein the golf bag is configured to be shipped in a collapsed configuration in which the divider top and the base are pivoted about the stay.

Clause 23. The collapsible golf bag of clause 22, wherein the first hinge comprises a first arm that is pivotably connected to a second arm.

Clause 24. The collapsible golf bag of clause 23, wherein the first arm is coupled to the divider top and the second arm is coupled to the stay.

Clause 25. The collapsible golf bag of clause 23, wherein the first arm is configured to cooperate with the second arm to restrict the pivot distance of the first and second arms.

Clause 26. The collapsible golf bag of clause 23, wherein the first arm is configured to cooperate with the second arm to restrict the pivot distance of the first arm in relation to the second arm to no more than a straight angle formed between the first and second arms.

Clause 27. The collapsible golf bag of clause 23, wherein one of the first or second arms includes a projection, and one of the other of the second or first arms includes a notch, wherein the projection is configured to receive the notch to restrict a pivoting angle of the first and second arms.

Clause 28. A method of self-assembling a golf bag comprising:

pivoting a divider top about a stay via a first hinge from a collapsed configuration to a deployed configuration;

pivoting a base about the stay via a second hinge from a collapsed configuration to a deployed configuration; and attaching a portion of a stand assembly to one of a mounting bracket or the base.

Clause 29. The method of clause 28, further comprising removing the golf bag in a collapsed configuration from a shipping box prior to the first pivoting step.

Clause 30. The method of clause 29, further comprising orienting assembly instructions printed on the shipping box into a readable orientation.

Clause 31. The method of clause 28, the attaching step further comprising coupling a spring to the base.

Clause 32. The method of clause 28, the attaching step further comprising securing a plurality of legs to the mounting bracket.

Clause 33. The method of clause 32, the attaching step further comprising:

removing a pin carried by an end cap on at least one leg of the plurality of legs;

aligning the end cap with the mounting bracket; and inserting the pin through a portion of the mounting bracket and a portion of the end cap to connect the end cap to the mounting bracket.

Clause 34. The method of clause 33, wherein the pin forms a pivotable connection between the end cap and the mounting bracket.

Clause 35. The method of clause 32, the attaching step further comprising:

aligning a first portion of an end cap carried by at least one leg of the plurality of legs with a second portion of the end cap carried by the mounting bracket;

inserting the first portion of the end cap into the second portion of the end cap; and connecting the first and second portions of the end cap by a snap fit connection.

Clause 36. The method of clause 28, further comprising connecting a strap coupled to an outer shell of the golf bag about a portion of a spring included in the stand assembly.

Clause 37. A method of manufacturing a collapsible golf bag comprising:

inserting a sub-assembly into an outer shell, the sub-assembly comprising a divider top, a base, and a divider sleeve coupled to the divider top and extending towards the base, the divider sleeve coupled to the base by a plurality of flexible connection members connected to the divider sleeve, wherein the divider sleeve includes a bottom edge that extends a distance from the base; and coupling a stay to the sub-assembly, such that the stay extends between the divider top and the base, the divider top being pivotably connected to the stay by a first hinge, and the base being pivotably connected to the stay by a second hinge.

Clause 38. The method of manufacturing the golf bag of clause 37, wherein after the inserting step, fastening the sub-assembly to the outer shell.

Clause 39. The method of manufacturing the golf bag of clause 38, wherein the fastening step further comprises fastening the sub-assembly to the outer shell at the base and at the divider top.

Clause 40. The method of manufacturing the golf bag of clause 37, further comprising:

inserting the golf bag in a collapsed configuration, with one of the divider top and the base being pivoted about the stay, into a shipping box; and inserting a portion of a stand assembly into the shipping box for user self-assembly.

Clause 41. The method of manufacturing the golf bag of clause 40, further comprising including instructions in the shipping box for user self-assembly.

Clause 42. The method of manufacturing the golf bag of clause 40, further comprising printing instructions on the shipping box for user self-assembly.

Clause 43. A golf bag comprising:

a collapsible sub-assembly including a divider top and a base;

a plurality of first snap-fit connectors provided around a portion of an outer perimeter of the divider top; and a flat having a divider top end opposite a base end, an interior side, and an exterior side, the flat including a plurality of second snap-fit connectors provided along a portion of the divider top end, wherein the flat attaches to the sub-assembly by mating snap-fit engagement of the plurality of first snap-fit connectors around the divider top with the plurality of second snap-fit connectors along the divider top end.

Clause 44. The golf bag of clause 43, further comprising a stay hingedly connected to the divider top.

Clause 45. The golf bag of clause 44, wherein the divider top is configured to pivot relative to the stay by up to 90 degrees.

Clause 46. The golf bag of clause 44, wherein the stay is hingedly connected to the base.

Clause 47. The golf bag of clause 46, wherein the base is configured to pivot relative to the stay by up to 90 degrees.

Clause 48. The golf bag of clause 43, further comprising a leg mounting bracket having a mounting channel and a retention member that extends into the mounting channel, wherein an outer ring of the divider top defines an aperture and further wherein a portion of the outer ring is received in the mounting channel and the aperture receives the retention member.

Clause 49. The golf bag of clause 48, wherein the leg mounting bracket includes a plurality of leg anchors.

Clause 50. The golf bag of clause 49, further comprising at least one pocket removably attached to the flat.

Clause 51. The golf bag of clause 49, further comprising an end cap that forms a snap-fit connection with one of the leg anchors.

Clause 52. The golf bag of clause 51, wherein the end cap includes a pair of opposing protrusions that define a pivot axis, the protrusions being received by a mounting portion of the leg anchor to provide a snap-fit connection between the end cap and the leg anchor.

Clause 53. The golf bag of clause 52, wherein the flat defines at least one aperture, the at least one aperture configured to receive one of the leg anchors.

Clause 54. A sub-assembly of a golf bag comprising:

a divider top having an outer ring defining a perimeter and a plurality of apertures; and a leg mounting bracket having a mounting channel and a plurality of retention members extending into the mounting channel, wherein a portion of the outer ring is received in the mounting channel and each of the plurality of apertures receives one of the plurality of retention members to form a snap-fit connection.

Clause 55. The sub-assembly of clause 54, wherein the leg mounting bracket includes a front portion and a back portion that define the mounting channel, at least one of the plurality of retention members extends from the front portion into the mounting channel and from the back portion into the mounting channel.

Clause 56. The sub-assembly of clause 55, wherein the mounting channel has a shape that is complementary to the shape of the outer ring.

Clause 57. The sub-assembly of clause 55, wherein the mounting channel has an arcuate shape.

Clause 58. The sub-assembly of clause 55, wherein the leg mounting bracket includes a leg anchor configured to pivotally retain a leg.

Clause 59. The sub-assembly of clause 58, wherein the leg includes an end cap having a pair of opposing protrusions that define a pivot axis, a mounting portion of the leg anchor being configured to receive the protrusions to provide a snap-fit connection between the end cap and the leg anchor.

Clause 60. The sub-assembly of clause 59, wherein the mounting portion of the leg anchor is configured to receive the protrusions to provide a pivoting connection between the end cap and the leg anchor to facilitate pivoting about the pivot axis.

Clause 61. A snap-fit bracket for connecting a pair of legs to a golf bag comprising:

a leg mounting bracket having a pair of leg anchors provided on a front portion of the bracket; and a pair of legs, each leg includes an end cap having a pair of opposing protrusions that define a pivot axis, each leg anchor being configured to provide a snap-fit connection between the end cap and the leg anchor.

Clause 62. The snap-fit bracket of clause 61, further comprising a mounting portion in each leg anchor, the mounting portion of each the leg anchor being configured to receive the protrusions to provide a pivoting connection between the end cap and the leg anchor to facilitate pivoting about the pivot axis.

Clause 63. The snap-fit bracket of clause 62, wherein the mounting portion in each leg anchor is configured to receive the protrusions to provide the snap-fit connection between the end cap and the leg anchor.

Clause 64. The snap-fit bracket of clause 63, wherein the mounting portion is a mounting channel.

Clause 65. The snap-fit bracket of clause 63, wherein the mounting portion is a mounting aperture.

Clause 66. A golf bag comprising:

a collapsible sub-assembly including a divider top, a base defining a perimeter, and a plurality of first apertures provided through a portion of the base about the perimeter;

a flat having a divider top end opposite a base end, and a plurality of second apertures through the flat along the base end; and a strip having a plurality of snap tree members, the flat being configured to overlap a portion of the base to align the first apertures with the second apertures, each of the aligned first and second apertures being configured to receive one of the plurality of snap tree members to couple the flat to the base.

Clause 67. The golf bag of clause 66, further comprising:

a plurality of third apertures provided through a portion of the divider top about a perimeter defined by the divider top;

a plurality of fourth apertures through the flat along the divider top end; and a second strip having a plurality second snap tree members, the flat being configured to overlap a portion of the divider to align the third apertures with the fourth apertures, each of the aligned third and fourth apertures being configured to receive one of the plurality of second snap tree members to couple the flat to the divider top.

Clause 68. The golf bag of clause 66, wherein a divider sleeve interconnects the divider top and the base.

Clause 69. The golf bag of clause 66, wherein the plurality of first apertures are die cut apertures.

Clause 70. The golf bag of clause 66, wherein the plurality of second apertures are die cut apertures.

The invention claimed is:

1. A golf bag comprising:

a divider top;

a base;

a flat extending between the divider top and the base;

a pocket coupled to the flat; and a shoe pocket coupled to the pocket;

wherein the shoe pocket is configuration to be adjusted between a deployed configuration and a stored configuration; and wherein the shoe pocket is configured to pivot relative to the pocket between the deployed configuration and the stored configured.

2. The golf bag of claim 1 wherein the shoe pocket is positioned between the flat and the pocket in the stored configuration.

3. The golf bag of claim 1, further comprising a storage channel configured to receive the shoe pocket in the stored configuration.

4. The golf bag of claim 3, wherein the storage channel is partially defined by the flat, and partially defined by a pocket coupled to the flat.

5. The golf bag of claim 3, further comprising an access port positioned along a portion of a seam between the flat and a pocket coupled to the flat, the access port configured to provide access to the storage channel.

6. The golf bag of claim 1, wherein in the deployed configuration, the shoe pocket is exposed, and wherein in the stored configuration, the shoe pocket is received by a storage channel.

7. The golf bag of claim 1, wherein the shoe pocket defines an opening that leads to a compartment, the opening including an elastic material configured to bias inward to reduce the size of the opening.

8. The golf bag of claim 1, wherein the flat includes a first end coupled to the divider top, and a second end coupled to the base.

9. The golf bag of claim 1, further comprising:

a plurality of first apertures provided through a portion of the base;

a plurality of second apertures provided though the flat at a base end; and a strip having a plurality of fasteners positioned on the strip, the flat configured to overlap a portion of the base to align the first apertures with the second apertures, each of the aligned first and second apertures configured to receive one of the fasteners on the strip to couple the flat to the base.

10. The golf bag of claim 9, further comprising:

a plurality of third apertures provided through a portion of the divider top;

a plurality of fourth apertures provided though the flat at a divider top end; and a second strip having a plurality of second fasteners positioned on the strip, the flat configured to overlap a portion of the divider top to align the third apertures with the fourth apertures, each of the aligned third and fourth apertures configured to receive one of the second fasteners on the second strip to couple the flat to the divider top.

11. The golf bag of claim 1, further comprising a stay having a first hinge coupled to one end of the stay and a second hinge coupled to a second, opposing end of the stay, wherein the divider top is coupled to the first hinge and the base is coupled to the second hinge, and wherein the divider top is configured to pivot at the first hinge relative to the stay, and the base is configured to pivot at the second hinge relative to the stay.

12. A golf bag comprising:

a divider top;

a base;

a flat extending between the divider top and the base; and a shoe pocket coupled to a portion of the flat;

wherein the shoe pocket is configured to be adjusted between a deployed configuration and a stored configuration;

wherein in the deployed configuration, the shoe pocket is exposed, and wherein in the stored configuration, the shoe pocket is received by a storage channel.

13. The golf bag of claim 12, further comprising a pocket coupled to the flat, wherein the shoe pocket is positioned between the flat and the pocket in the stored configuration.

14. The golf bag of claim 13, wherein the flat and the pocket define the storage channel configured to receive the shoe pocket in the stored configuration.

15. The golf bag of claim 14, further comprising an access port positioned along a portion of a seam between the flat and a pocket coupled to the flat, the access port configured to provide access to the storage channel.

16. The golf bag of claim 12, wherein the shoe pocket defines an opening that leads to a compartment, the opening including an elastic material configured to bias inward to reduce the size of the opening.

17. The golf bag of claim 12, further comprising:

a plurality of first apertures provided through a portion of the base;

a plurality of second apertures provided through the flat at a base end; and a strip having a plurality of fasteners positioned on the strip, the flat configured to overlap a portion of the base to align the first apertures with the second apertures, each of the aligned first and second apertures configured to receive one of the fasteners on the strip to couple the flat to the base.

18. The golf bag of claim 17, further comprising:

a plurality of third apertures provided through a portion of the divider top;

a plurality of fourth apertures provided through the flat at a divider top end; and a second strip having a plurality of second fasteners positioned on the strip, the flat configured to overlap a portion of the divider top to align the third apertures with the fourth apertures, each of the aligned third and fourth apertures configured to receive one of the second fasteners on the second strip to couple the flat to the divider top.

19. The golf bag of claim 12, further comprising a stay having a first hinge coupled to one end of the stay and a second hinge coupled to a second, opposing end of the stay, wherein the divider top is coupled to the first hinge and the base is coupled to the second hinge, and wherein the divider top is configured to pivot at the first hinge relative to the stay, and the base is configured to pivot at the second hinge relative to the stay.

* * * * *